US008261378B2

(12) United States Patent
Kanetis

(10) Patent No.: US 8,261,378 B2
(45) Date of Patent: Sep. 11, 2012

(54) COVERED POOL

(75) Inventor: Stefan Kanetis, Del Mar, CA (US)

(73) Assignee: HWPS US, LLC, Del Mar, CA (US)

( * ) Notice: Subject to any disclaimer, the term of this patent is extended or adjusted under 35 U.S.C. 154(b) by 1375 days.

(21) Appl. No.: 11/716,576

(22) Filed: Mar. 12, 2007

(65) Prior Publication Data

US 2007/0220667 A1 Sep. 27, 2007

Related U.S. Application Data

(60) Provisional application No. 60/781,898, filed on Mar. 13, 2006.

(51) Int. Cl.
*E04H 4/00* (2006.01)

(52) U.S. Cl. ..... 4/501; 4/498; 4/500

(58) Field of Classification Search ..... 4/498, 500–501
See application file for complete search history.

(56) References Cited

U.S. PATENT DOCUMENTS

| | | | | |
|---|---|---|---|---|
| 3,000,017 | A | | 9/1961 | Skovira |
| 3,045,253 | A | | 7/1962 | Price |
| 3,413,661 | A | | 12/1968 | Jack |
| 3,631,545 | A | | 1/1972 | Orndorff |
| 3,670,343 | A | | 6/1972 | Gansloser |
| 4,229,843 | A | * | 10/1980 | Belanger ..... 4/495 |
| 4,532,745 | A | | 8/1985 | Kinard |
| 4,937,896 | A | | 7/1990 | Niimura |
| 5,347,773 | A | | 9/1994 | Thil |
| 5,678,253 | A | | 10/1997 | Baker |
| 6,105,180 | A | | 8/2000 | Kramer |
| 6,202,355 | B1 | | 3/2001 | Uram et al. |
| 6,571,919 | B1 | | 6/2003 | Stewart |
| 6,640,504 | B2 | | 11/2003 | Pearlson et al. |

FOREIGN PATENT DOCUMENTS

| | | |
|---|---|---|
| DE | 1806673 A1 | 5/1970 |
| WO | WO-0006856 A1 | 2/2000 |

* cited by examiner

*Primary Examiner* — Gregory Huson
*Assistant Examiner* — Karen L Younkins
(74) *Attorney, Agent, or Firm* — Michael A. Whittaker; Acuity Law Group, P.C.

(57) ABSTRACT

A water pool with a cover that may be raised and lowered is presented herein. In one embodiment, the cover of the pool is a patio. In a further embodiment, the cover is raised and lowered by a lifting mechanism that is a hydraulic cylinder. A cover of a pool of the invention may be lowered to any point from the highest point to the lowest, providing a pool of variable depth at the discretion of the user.

9 Claims, 60 Drawing Sheets

COVERED POOL

CROSS-REFERENCE TO RELATED APPLICATIONS

This application claims priority to pending U.S. Provisional Patent Application No. 60/781,898, filed on Mar. 13, 2006, and having a common inventor, Stefan Kanetis. That application is incorporated by reference herein in its entirety.

BACKGROUND OF THE INVENTION

The following includes information that may be useful in understanding the present inventions. It is not an admission that any of the information provided herein is prior art, or material, to the presently described or claimed inventions, or that any publication or document that is specifically or implicitly referenced is prior art.

1. Field

The present invention relates to, but is not limited to, the fields of construction and use of pools and covered pools. Pools may include, but are not limited to, swimming pools, hot tubs, pools used for therapy, reflecting pools, wave pools, whirlpools, and wading pools.

2. Background

A variety of pools that can be built on a property or purchased ready-made are available. These pools are popular and are often a desired home improvement project.

Many of the available options for providing a pool on a property have disadvantages. For example, they may require a large piece of open land, which is then used solely for a pool. Unfortunately, many homes or other areas where a pool might otherwise be desirable do not have a large piece of land available for dedication for use as a pool. Many available pools are also expensive and/or inefficient to construct. They may also be expensive to heat to a desired temperature. Once a desired temperature has been attained, maintaining that temperature may be difficult. Furthermore, when a pool is not in use debris may accumulate in the pool, or chemicals that are used to maintain a clean, sanitary pool may be degraded by sunlight.

BRIEF SUMMARY OF THE INVENTION

The present invention relates generally to the field of a covered pool having a lowering and raising cover, more generally to the field of covered pools, and even more generally to the field of pools. Pool covers of the present invention may function as a patio. Pools of the present invention may be added to almost any size plot of land. For example, a pool of the invention may be used in the yard of a house, apartment building, or rehabilitation center. Pools of the invention allow a portion of land to be used alternately as a pool and as a patio. Furthermore, pools of the invention allow a single pool to be used alternately as a swimming pool, baby pool, child's pool, hot tub, or whirlpool.

Embodiments of the invention include a water pool that is adapted as a patio when covered and a water pool when uncovered. A rigid or semi-rigid platform or cover can be positioned at the open top of the water pool. When the pool is not in use and the cover is in a raised position, the cover can act as a patio. In a further embodiment, the cover may substantially seal the pool, preventing exposure of the water to sunlight and debris. Debris may include, for example, dust, dirt, or leaves.

In one embodiment, the supporting mechanism of the movable platform is in an umbrella form with a central 1-3 stage lifting hydraulic cylinder; the lightweight platform supported by radiating arms (from 1-2 feet long) attached inwardly to a central rim secured at the top of the lifting cylinder, and attached outwardly to a substantial band, or belt, that defines the circumference of the outer end of the platform arms, which functions to tie the radiating arms together, and provide space for connecting the piston cylinders; the circumference band or rim is attached from below to a series of stabilizing hydraulic piston cylinders that are secured to the bottom of the pool circling the central lifting cylinder, and which can number from 2 to 16; the piston cylinders articulate up and down with the movement of the platform and when they are operating with sufficient hydraulic pressure, function to stabilize the platform and support the platform's load bearing capacity; a tapered cylinder cap, rising from the end of the central lifting cylinder, inserts into the bottom of the inner connecting rim (to which are attached the platform supporting arms) to form a pressure fit for maximum strength. A belt may surround the rim to provide additional tension and further secure the stabilizing arms.

The patio segments are preferably small and light enough for two men to handle, for easy fabrication. All automated functions of the pool, mechanical, electrical and electronic, may be controlled by a central electric Controller managed by proprietary software. The modular construction of the pool wall may be fabricated of foam blocks that are factory finished and include all the appropriate pool systems, and structural forms, such as plumbing, electrical, and stairs.

The pool platform may be sealed against the pool wall with a urethane (or other suitable material) seal, which is to be an air tight gasket when patio is in a locked position. The pool wall may include a clearly visible LCD depth indicator that reads out the depth of the pool. The construction of the pool can include tables or benches to the side of the pool that also function with hydraulic lifts to move them into the desired position. Movable and submersible benches designed to slide from the side of the pool onto the pool platform may be included, for use in the water when seating is desired (for example, when the pool is being used as a whirlpool). A pool can be constructed of factory finished fiberglass, (or other suitable materials), formed into sections that can be secured together when at the construction site.

A patio/pool of the invention may include a lift mechanism involving a column that uses the pool's water to apply lifting force. In a further embodiment, the lift mechanism may be a hydraulic cylinder that uses the pool's water as the hydraulic fluid. In either case, any fluid escaping from the lift mechanism returns harmlessly to the pool for recirculation. This design provides sufficient lift pressure from the fluid being pumped in for raising or lowering the patio/pool platform, while allowing for any amount of fluid escape through the gasket (if one is present) between the lift piston and its surrounding tube as long as the fluid being pumped in is less than the amount leaking out.

In one embodiment, a spur rack gear is attached to the side of the central lift cylinder for providing a locking mechanism. The contour of the tube enclosing the lift cylinder accommodates the round piston mechanism with its attached rectangular spur rack. This notched design prevents the patio/pool platform from any form of axial rotation. A gasket attached to the enclosing tube follows along the contour of the lift cylinder with its spur rack gear, but does not need to be leak proof. The locking mechanism may be fastened securely to the pool's floor and use a smaller length of spur rack gear material to clamp upon the main spur rack gear to hold the patio/pool platform securely at any desired height. A separate gear wheel may then connect with the spur rack gear to provide the electronic controller for the patio/pool, electronic information for controlling and adjusting the lift height.

A separate system of hydraulic cylinders used for stabilizing the platform of the patio/pool may attach to the underside of the platform rim and to the floor of the pool. They will also use the pool's water as their hydraulic fluid. They can be extended by means of the central hydraulic pump that is used to raise the patio/pool's platform, but one in place for the desired level of the platform, the pressure line serving them will have a valve that disconnects it from the main system. In this way, the stabilizing cylinders will maintain their pressure until changed for platform movement.

DETAILED DESCRIPTION OF THE INVENTION

Figure 1:
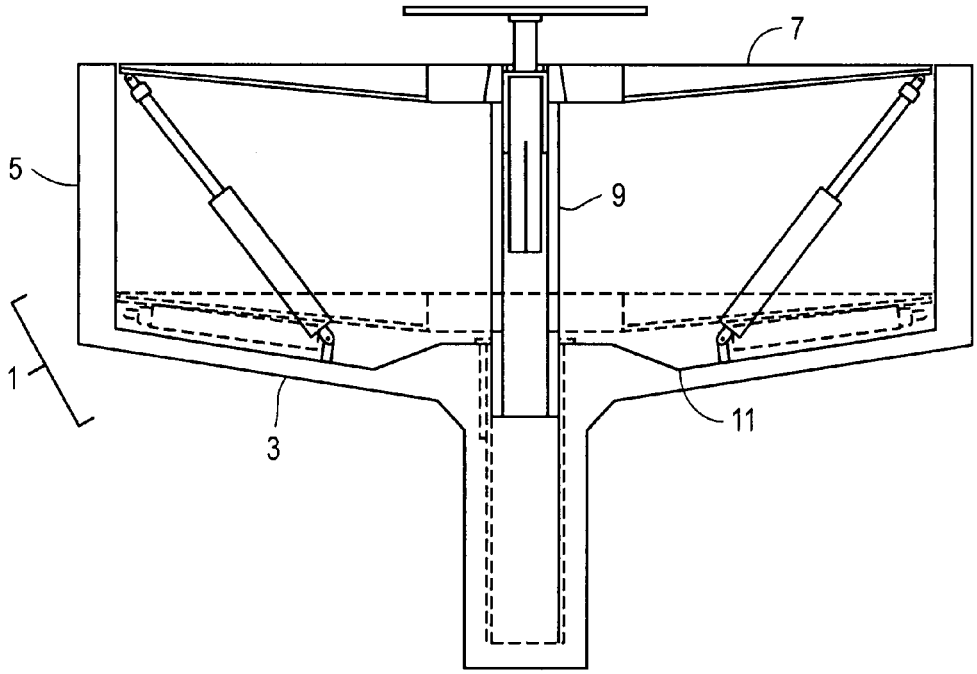
FIG. 1 depicts a pool that is one embodiment of the invention.

One embodiment of the invention is shown in FIG. 1. A pool of the invention may comprise, for example, a structure 1 for containing water (usually comprising a bottom 3 and one or more sidewalls 5), a cover 7 having a top side and a bottom side, and a mechanism 9 for raising and lowering the cover. When the cover is lowered beneath the water level, it provides a false bottom for the pool of water that is formed. These and other elements will now be discussed in greater detail with reference to the figures. It should be noted that the top and bottom of the cover are used as points of reference only, and that it should not be meant to imply (or to exclude) a certain number of layers in the construction of the cover.

A. Bottom and Sidewall(s)

Pools of the invention have at least one bottom and at least one sidewall. Because the pool is intended to hold water for a long period of time, the bottom and sidewalls of the pool should be substantially watertight. Ideally, the bottom and sidewalls are completely watertight. The bottom and sidewalls of a pool of the invention should be able to withstand the pressure of the stored water and/or provide adequate counter pressure against the pressure that is exerted by the stored water inside the pool.

Figure 1A:
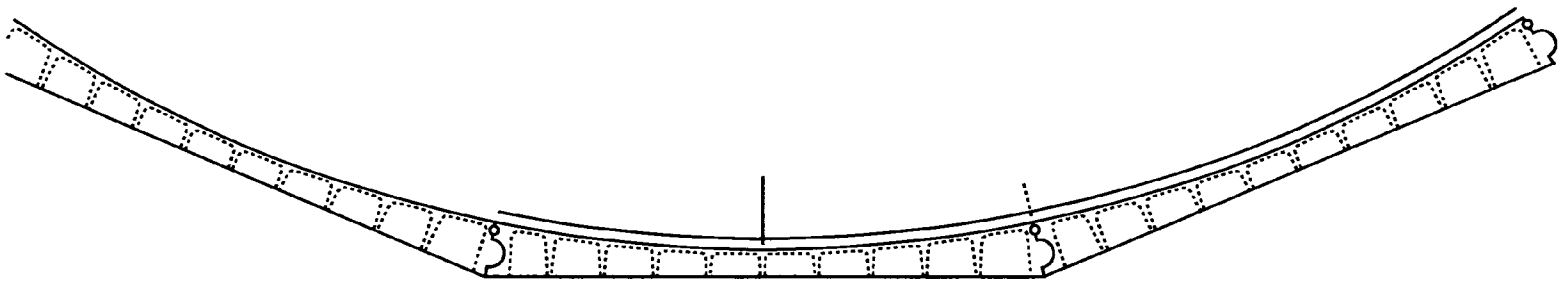
FIG. 1A depicts a cast polymer side for use in forming a pool sidewall of the invention.

A variety of materials may be used to construct the bottom and sidewalls of the invention. These materials include, for example, concrete, cement, foam or plastic. In a preferred embodiment of the invention, shown in FIG. 1A, the sidewalls of a pool include or are composed entirely of a cast polymer. This cast polymer may have one or more hollows or indentations that allow insertion of insulation into the polymer. The bottom and sidewalls do not need to be made of the same material. The bottom and/or sidewalls may be covered by a liner. The liner may be a plastic liner. In some embodiments, the bottom is soil covered by a liner.

In one embodiment, the sidewalls are constructed of materials that insulate and/or that retain heat. These materials may be, for example, hard foam. Hard foam is, for example, polyester foam or polyethylene foam. Hard foam blocks may be molded in the shape for constructing the bottom and sidewalls. Hard foam blocks may also be cut into the shape. For example, hard foam blocks may be cut with computer numerically controlled (CNC) machines. Ideally, the blocks will be formed so that when placed into position in the hole where the pool is to be constructed, the desired shape of the bottom and sidewalls is formed. In one embodiment, a foam block is hot-wire cut from a 6'×6'×8' foam block.

The shape of each block will, of course, depend on the overall desired shape of the pool. For example, for a circular pool, one could calculate the desired interior diameter, desired outer diameter, and desired number of blocks. Properly cut blocks will allow fine assembly at seams of the blocks.

In a further embodiment, grooves may be cut and/or formed through and along each side of the sidewall components (blocks). When the blocks are oriented to form the bottom or sidewalls of the pool, the grooves provide a series of connecting channels. These channels may be filled or partially filled to provide a framework for the sidewalls that increases stability of the sidewalls. The channels may be filled, for example, by concrete, urethane, polystyrene, fiberglass-reinforced compounds, or epoxy, or mixtures of these. Rebar may also be inserted into the channels to increase stability. The material in the channels may act as a bonding agent that hardens and that holds the blocks together in a structural grid. Blocks may also have alternating grooves and protrusions that allow them to interlock. After the blocks have been interlocked, they may further be secured by application of one or more straps or belts around the outer perimeter. These straps or belts may be, for example, steel or stainless steel.

Figure 2:
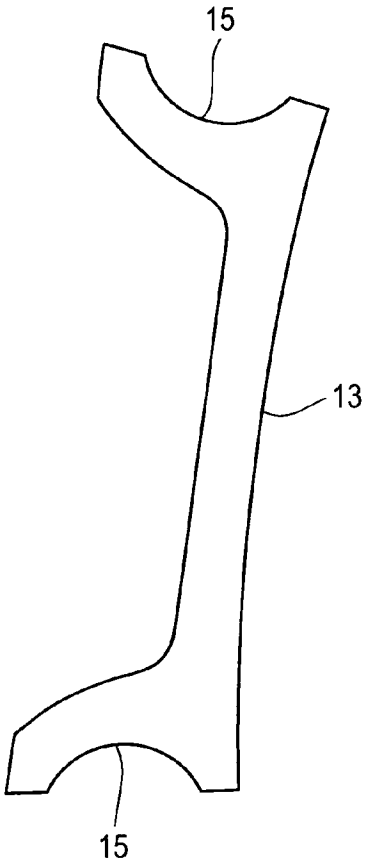
FIG. 2 depicts a top view of a block used to form a sidewall of the invention.
Figure 2B:
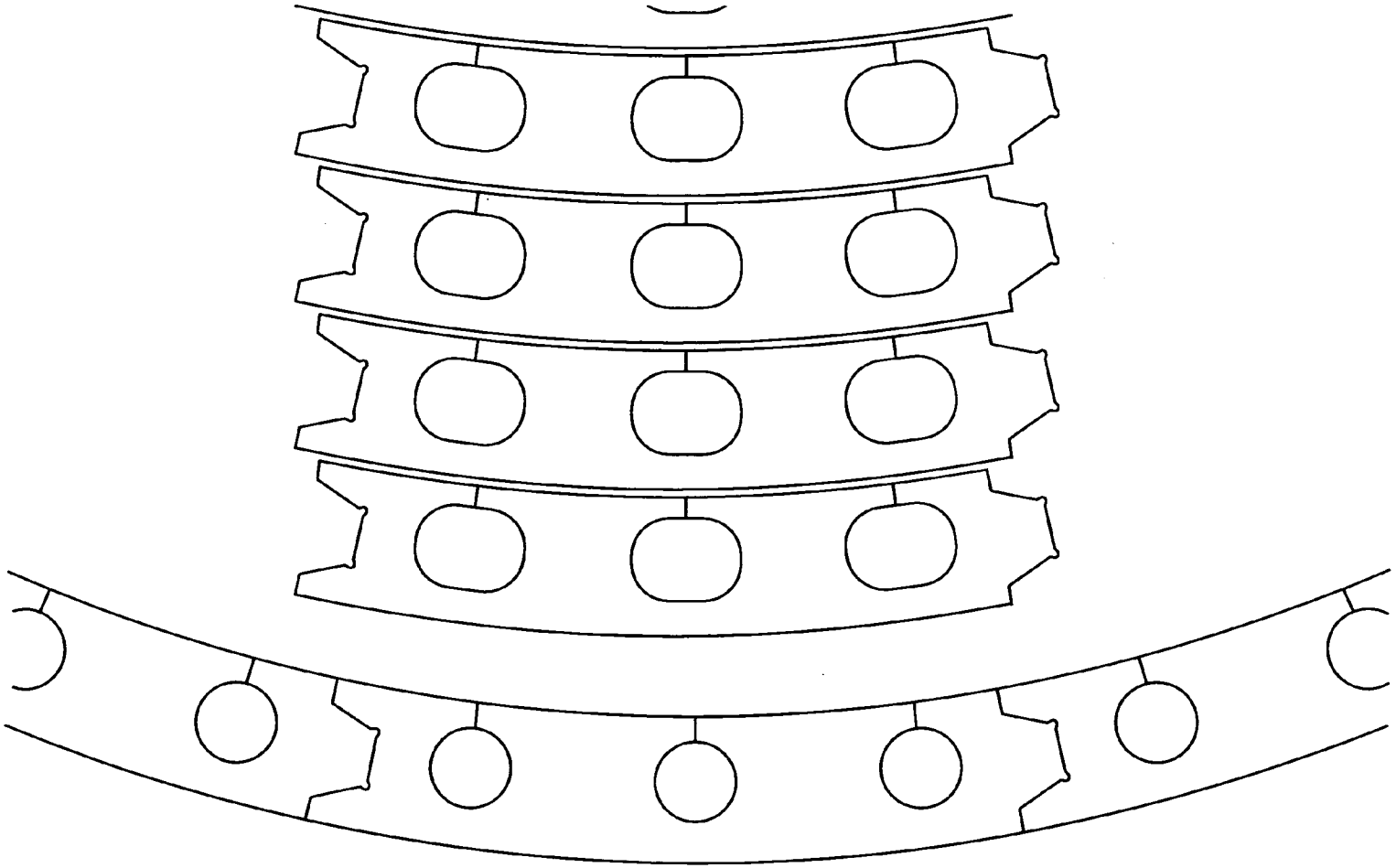
FIG. 2B depicts additional top views of sidewalls for use in the invention.
Figure 2C:
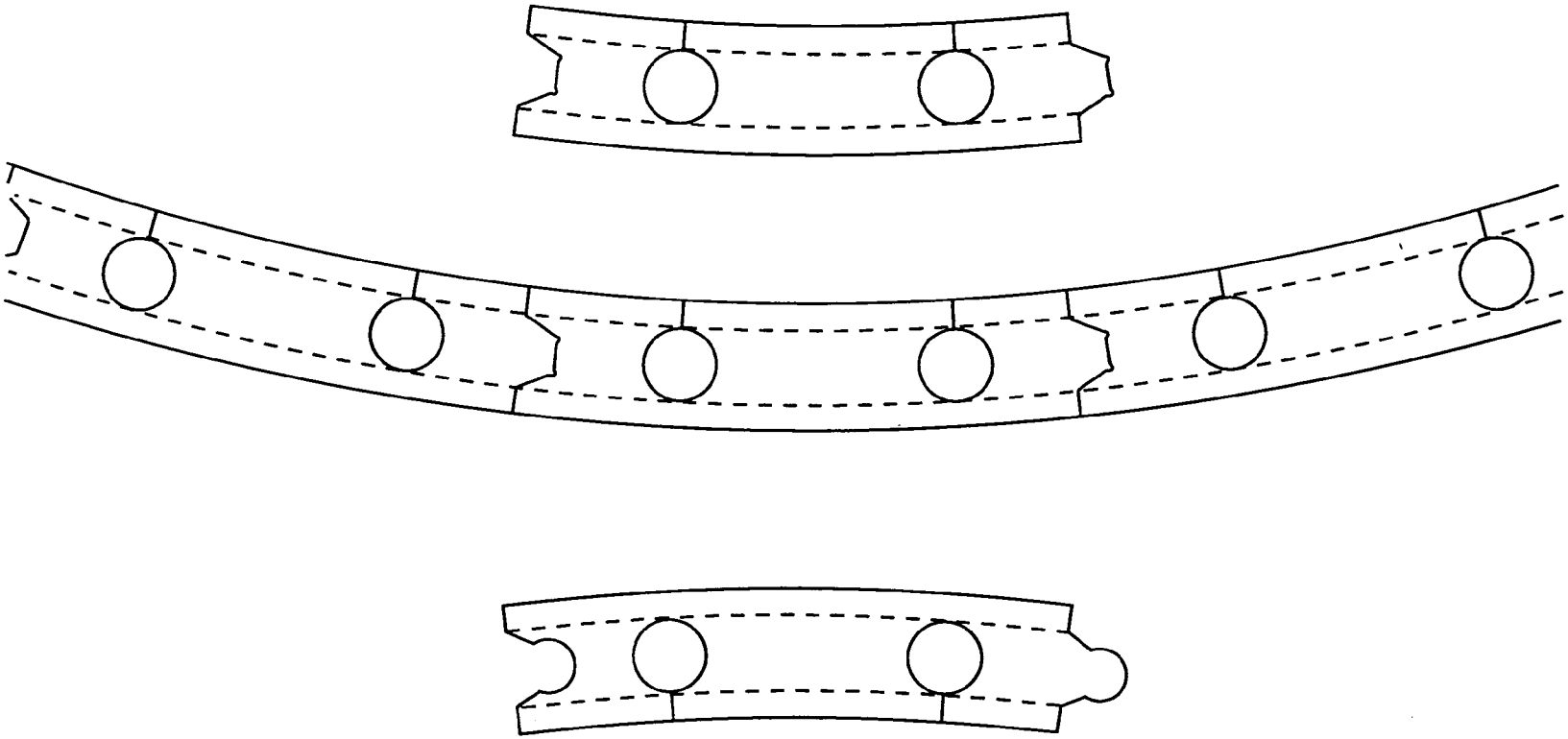
FIG. 2C depicts additional top views of sidewalls for use in the invention. Included in the figure are automatically joining sidewalls, with male and female connectors.
Figure 3:
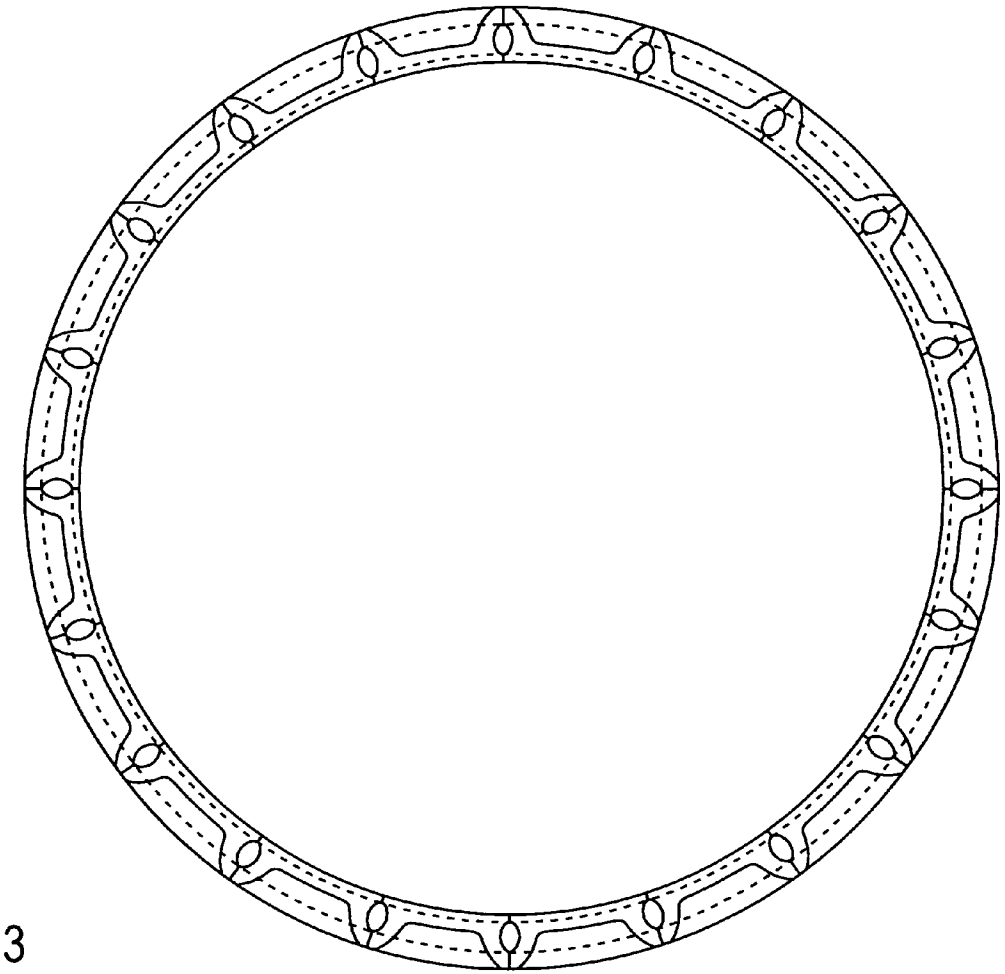
FIG. 3 depicts a top view of a sidewall formed from blocks of the invention.
Figure 4:
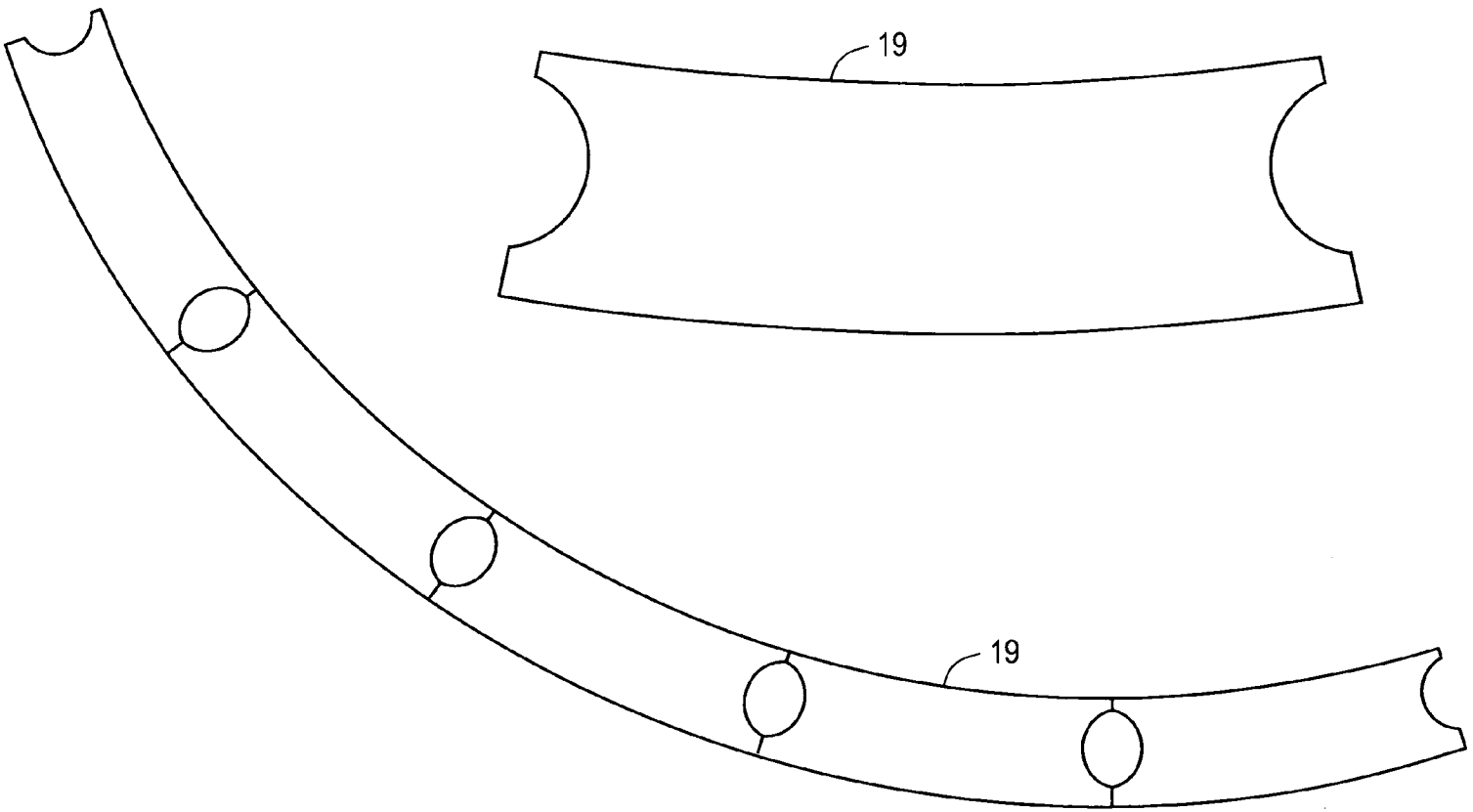
FIG. 4 depicts a top view of a block and a portion of a sidewall formed from similarly-shaped blocks.
Figure 5:
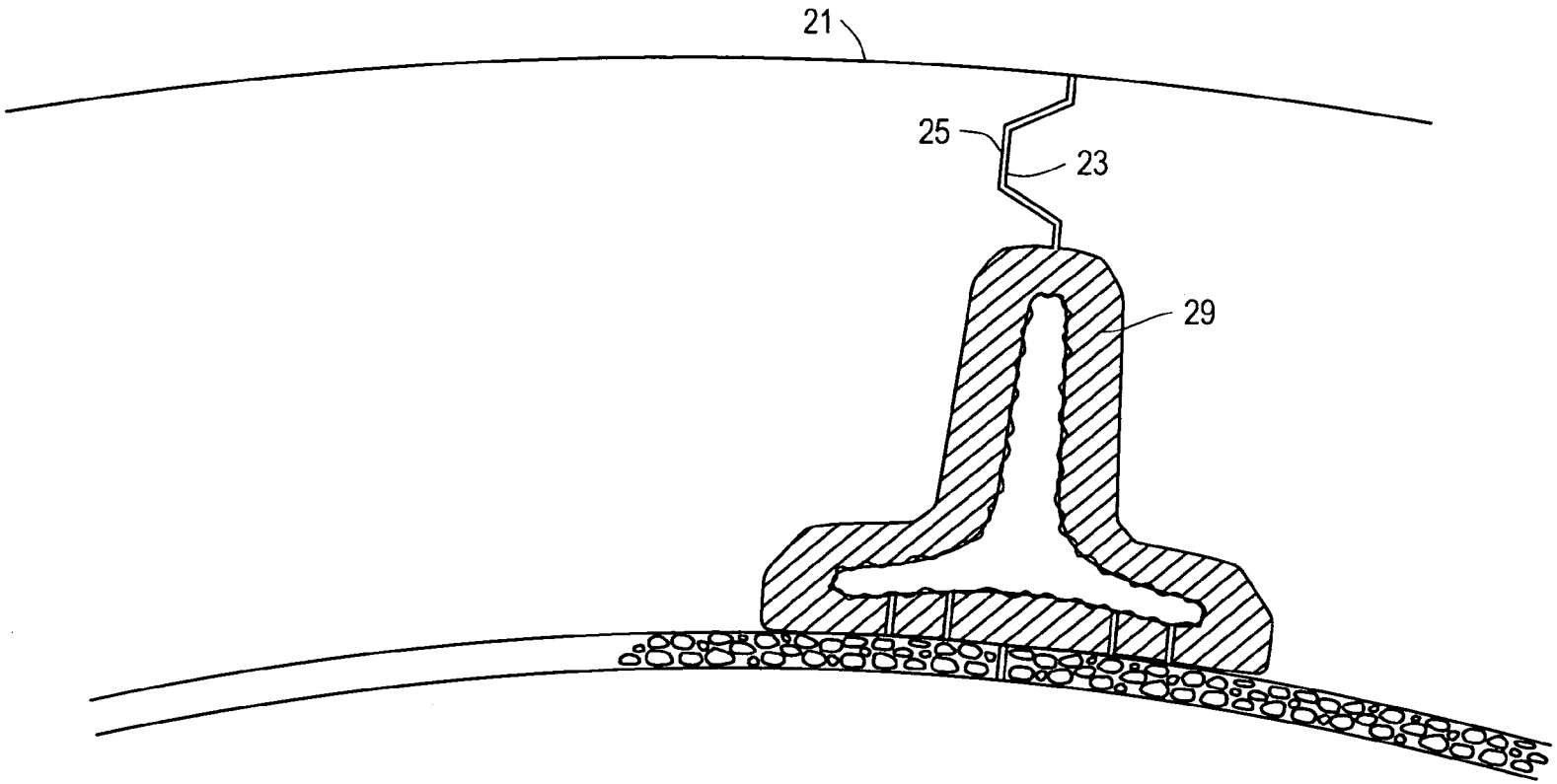
FIG. 5 depicts a top view of the interface of two sidewall blocks.

FIG. 2 shows one example of a top view of a block 13 that includes grooves 15 for creation of stabilizing channels. FIG. 3 depicts a top view of a sidewall 15 formed by foam blocks 13, and including channels 17. FIG. 4 depicts a block 19 that is shaped differently from the block of FIG. 2, along with a portion of a sidewall formed from that block. FIG. 5 depicts the interface of two blocks 21 with interlocking male 23 and female 25 connectors. The blocks of FIG. 5 include a tile overlay 27. The channel 29 has been filled in FIG. 5 to provide stability.

Channels may be cut through the blocks. If these channels intersect with channels cut along the side of the blocks (and therefore with the channels that are created), then a bonding agent that is placed in the channels will further provide a stabilizing framework for the sidewalls.

Foam blocks used to form the bottom and sidewalls may be finished with a watertight or water-resistant coating prior to being placed into position in the hole where the pool is constructed. If desired, they may be finished after being placed into position in the hole where the pool is constructed.

Foam block construction has a number of advantages. Foam blocks are durable and are resistant to cracking or breakage due to ground movement. The density of foam blocks may be, for example, but is not limited to, 1 lb/cubic foot or 2 lb/cubic foot. This allows the blocks to act as insulators. This insulation may reduce the cost of heating the pool. Foam blocks are also light, allowing the pool components to be carried and installed by a small team of people, perhaps as few as one or two.

Foam block construction further allows the pool to be repaired without doing significant damage to the pool's watertight interior. When a problem arises with an apparatus on the pool's interior, the apparatus may be accessed from the side of the sidewall opposite the watertight coating. After the apparatus has been serviced, the foam block may be repaired using foam that is blown into the breach created to service the apparatus.

Foam blocks may be prefabricated so that they include various features useful in a pool and/or so that they are ready to accept such features and apparatuses. For example, they may be prefabricated to include piping, wiring, heating, filtration (including skimming), pumping, swim jets, vortex jets (that is, jets that create a "whirlpool"), massage jets, speakers, hot tub jets, a massage jet harness attachment, lighting, recessed ladder or stairs, ladder recesses, brake detents, tile or combinations of these features.

These features may be designed to be interchangeable. Interchangeability would allow an existing pool of the invention to be upgraded. For example, a pool without lighting or swim jets may be adapted to include them by replacing all of or a portion of a foam block. Use of foam allows access to the back of the walls, so that the portion facing the water can remain watertight. A liner might also be inserted during repair.

Figure 6C:
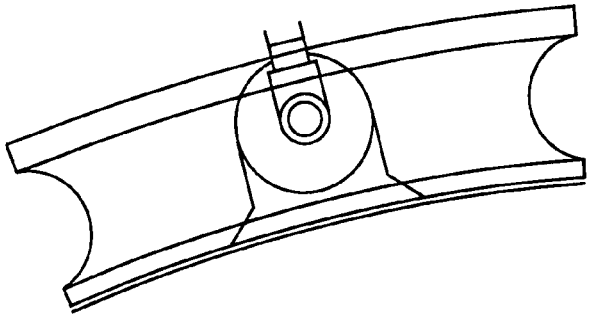
FIG. 6 depicts sidewall blocks including lights (6A), swim jets (6B), and a skimmer (6C).
FIG. 6D depicts top views of rooms that may be made according to embodiments of the invention.
Figure 6B:
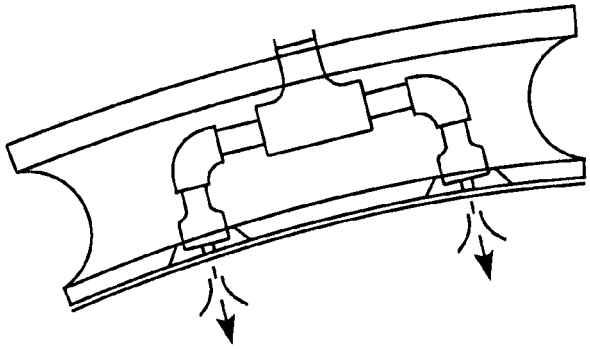
Figure 6A:
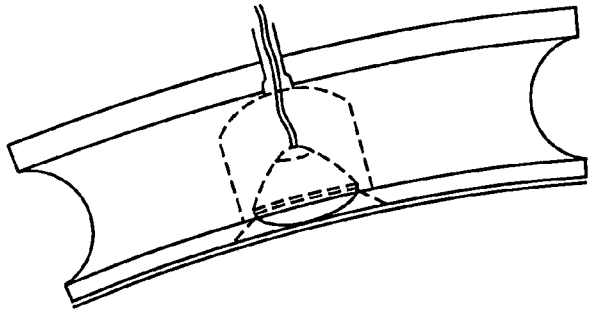

FIGS. 6A, 6B, and 6C show blocks prefabricated to include lights, swim jets, and a skimmer, respectively. In one embodiment, a customer who is purchasing a pool is given a blank form depicting the available sidewalls of his pool. The form may be similar, for example, to FIG. 3. Each available feature (as well as "no feature") is assigned a number and a price, and the customer selects a number for each block in the form. In this way each customer can create an individualized pool experience.

In one embodiment, at least one massage jet and a massage jet harness are included in the sidewall. Preferably 4 or 5 massage jets are disposed in a block in an orientation amenable to massaging, for example, a person's back. To enable the person to maintain position in an area where the jets would be effective, the block may also include a tether for a harness that a person may wear while using the massage jets. Each massage jet may operate, for example, using a motor with about 2 to about 3 horsepower, though this number can be varied at the discretion of the user. The massage jets may have a variable intensity controlled by a panel either integral to or separated from the pool. The massage jets may be controlled remotely.

Although the foam block pool construction has been described in the context of creating a covered pool, the principles of foam block pool construction as recited herein may be applied to construction of conventional pools as well.

Although block construction has been thus far described herein in the context of pool formation, it is also useful in construction of other structures. In one embodiment, the use of interlocking foam blocks that are reinforced with rebar or fiberglass as well as poured concrete into cavities in the foam is provided to create a structure that acts as a partial or complete "outdoor room" environment. The blocks themselves may contain cutouts where appropriate outdoor features can be incorporated, including televisions (including optional tilt functions), DVD/VCR players, stereos, speakers, USB ports, remote control (including, optionally, remote mouse controls), heating and cooling vents, jets, or ducts, natural gas or propane fireplaces, lighting fixtures, and fountains. Sections of this interlocking block structure can be used for seating and/or as display areas for plants and statuary. The foam blocks themselves can be finished with a variety of coatings including but not limited to stucco, plaster, tile, artificial or real rock or other similar veneers.

Figure 6D:
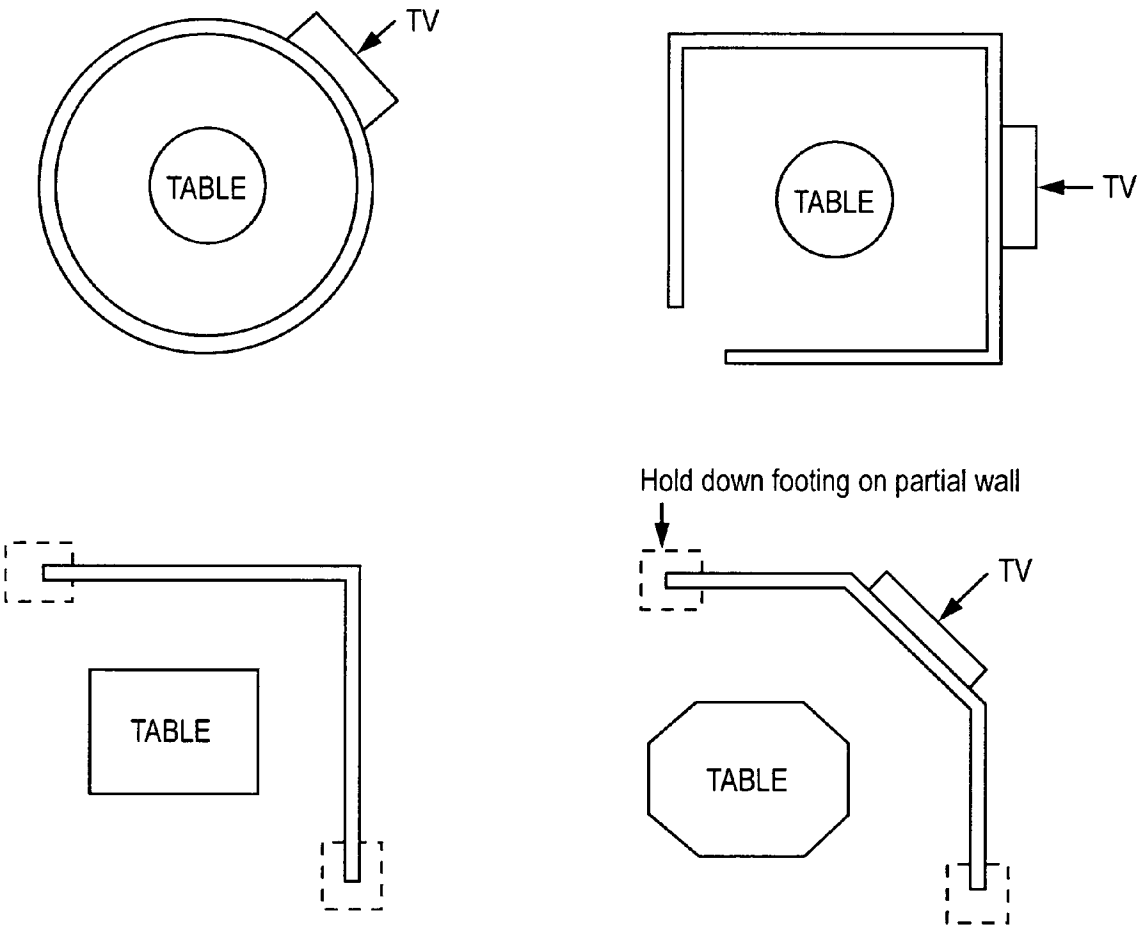

The structure can be secured into the ground with at least two concrete footings that are poured through cavities in the appropriate blocks. Pouring concrete into cavities that when set irrevocably connects two or more such foam blocks provides additional structural stability. The preferred structure includes an arc of a circle of at least a 12 foot diameter and may create a complete circle. Alternatively the structure may also include at least two right angles and may also include a 45 degree angle across the square (as shown in diagram attached), or could be fully enclosed into a rectangular or square room. FIG. 6D shows a number of possible outlines for structures of this embodiment of the invention. The structure may further include a tube substructure about the outside of the wall, allowing hot, compressed air to be pumped into the room. When coupled with a heater, this could provide an inexpensive, efficient way to heat such a room.

A roofing structure is also contemplated in certain manifestations of this invention. This roofing structure may also incorporate a fan with or without water misting features. This structure may be used to partially or completely surround a telescoping table and/or a submersible patio pool/spa of a described herein.

Rooms of this embodiment may provide a number of features. The use of prefabricated interlocking foam blocks provides a structural material that is well insulated, lightweight and inexpensive. This structure is made substantially stronger and more durable by the addition of rebar or fiberglass as well as poured concrete into these prefabricated foam cavities, and further strength and stability is provided by the arc design. When coated, the structure will not rot or deteriorate. The nature of this process allows for a structure to be created on-site more rapidly, for less cost and with greater durability and sound and heat insulation than could be provided using traditional construction methods. The prefabricated cutouts in these foam blocks allow for rapid and reliable insertion of desired appliances.

The combination of this structure with a telescoping table and/or patio pool as described above substantially increases the flexibility of a small living space by creating a room/area that can be used for a variety of activities including home theater, dining, swimming, playroom, or a combination of all four. The superior heat and sound insulation provided by the foam blocks creates a uniquely intimate environment for all of these activities that cannot be achieved using existing construction methods. The rapid ability to change the function of a room or space by employing the telescoping table and/or patio pool in combination with the new construction methods described here does not currently exist in industry and provides a potential benefit to home owners with limited space.

B. Cover

The invention includes a cover. The cover may be rigid or semi-rigid. Of course, those skilled in the art will recognize that all materials have some amount of rigidity, but a minimal flexibility is preferred. In some embodiments, the cover has a top side and a bottom side capable of covering or substantially covering the open top of the pool. The cover is able to move to and from the bottom of the pool along the sidewalls of the pool by raising and lowering.

The bottom of the pool may be flat. Preferably, the bottom of the pool has areas of varying elevation. Varying the elevation allows any sediment or other waste that enters the pool to collect in an area where it might more conveniently be removed by a debris suction device. One example of a bottom of varying elevation is shown in FIG. 1, where depressions 11 provide an area for accumulation of debris.

In one embodiment, the cover does not contact the sidewalls of the pool, resulting in a gap between the cover and the sidewalls. For example, the perimeter of the cover may be between about 0.25 inches and 2 inches, preferably 1 inch, away from the sidewalls of the pool. The gap between the cover and the sidewalls may be, but is not required to be, uniform about the perimeter of the cover. In some embodiments of the invention, the separation of the cover and the sidewalls allows water to flow from the area beneath the cover to the area above the cover as the cover lowers, and to flow from the area above the cover to the area below the cover as the cover raises. In a further embodiment, there is no gap between the cover and the sidewalls (or between the seal and the sidewalls), and water is able to flow through one or more holes in the cover.

In a yet still further embodiment, the cover includes one or more holes that have flaps or valves. These allow additional flow of water so that the cover may raise and lower at a faster rate than it might otherwise raise or lower.

In another embodiment of the invention, the cover has a width that is small compared to that of the pool. In this case, the cover, when raised, may act as a support for an additional lightweight top that is placed over the cover. This top may provide strength and coverage sufficient to prevent debris from entering the pool. Although in this embodiment there might not be sufficient strength to place things on the cover, but it is still sufficient to prevent debris from entering the pool.

The perimeter of the cover may be surrounded by a flexible seal. This seal may be in continuous contact with the coping of the pool (described more fully below) when the cover is in its highest position. After the cover lowers below the level of the coping and before the cover lowers to the water level, there is a gap between the seal and the sidewalls. This gap allows flow of water from below the cover to above the cover as the cover lowers. When the cover raises, the flow is reversed.

In a further embodiment this seal is in continuous contact with the sidewalls as the cover lowers and raises, and while the cover is at rest. In this embodiment, the cover includes holes that allow water to flow from one side of the cover to the other as the cover lowers or raises.

Figure 7:
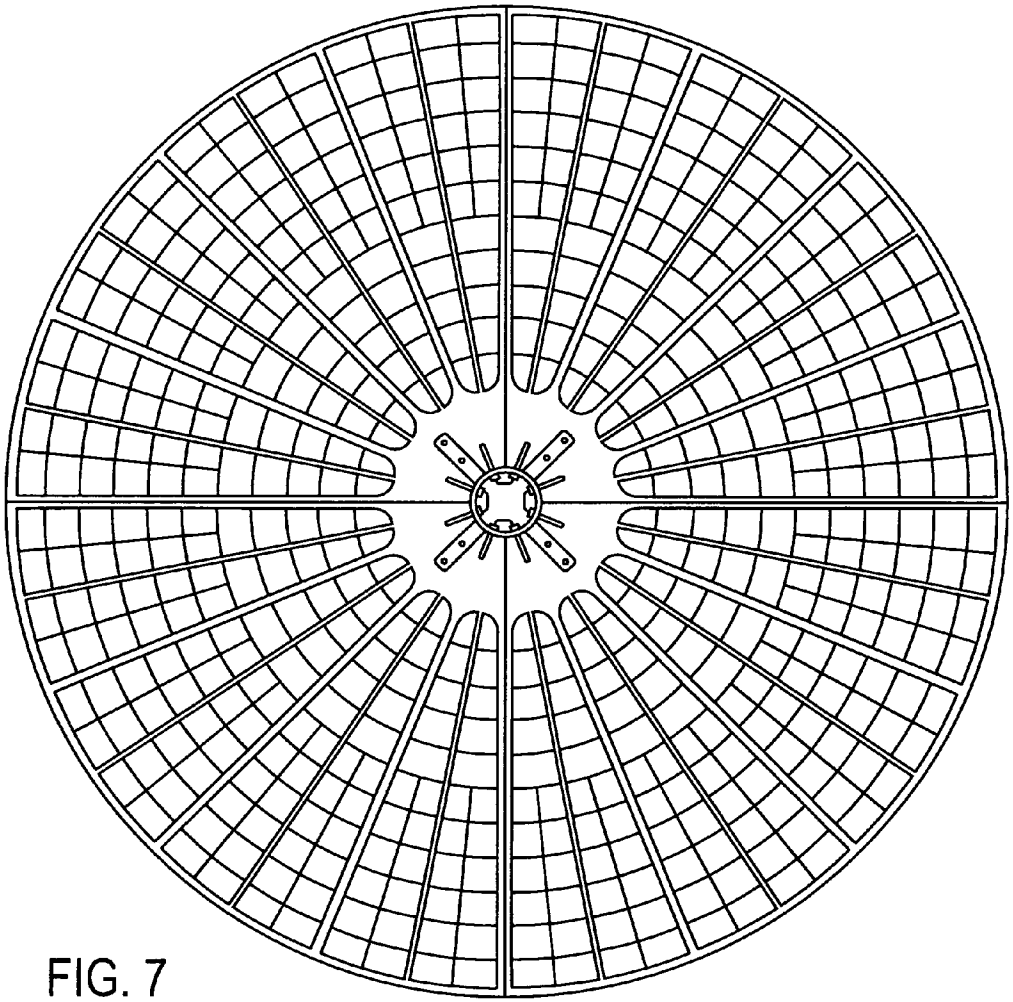
FIG. 7 depicts a bottom view of a cover of the invention.
Figure 8:
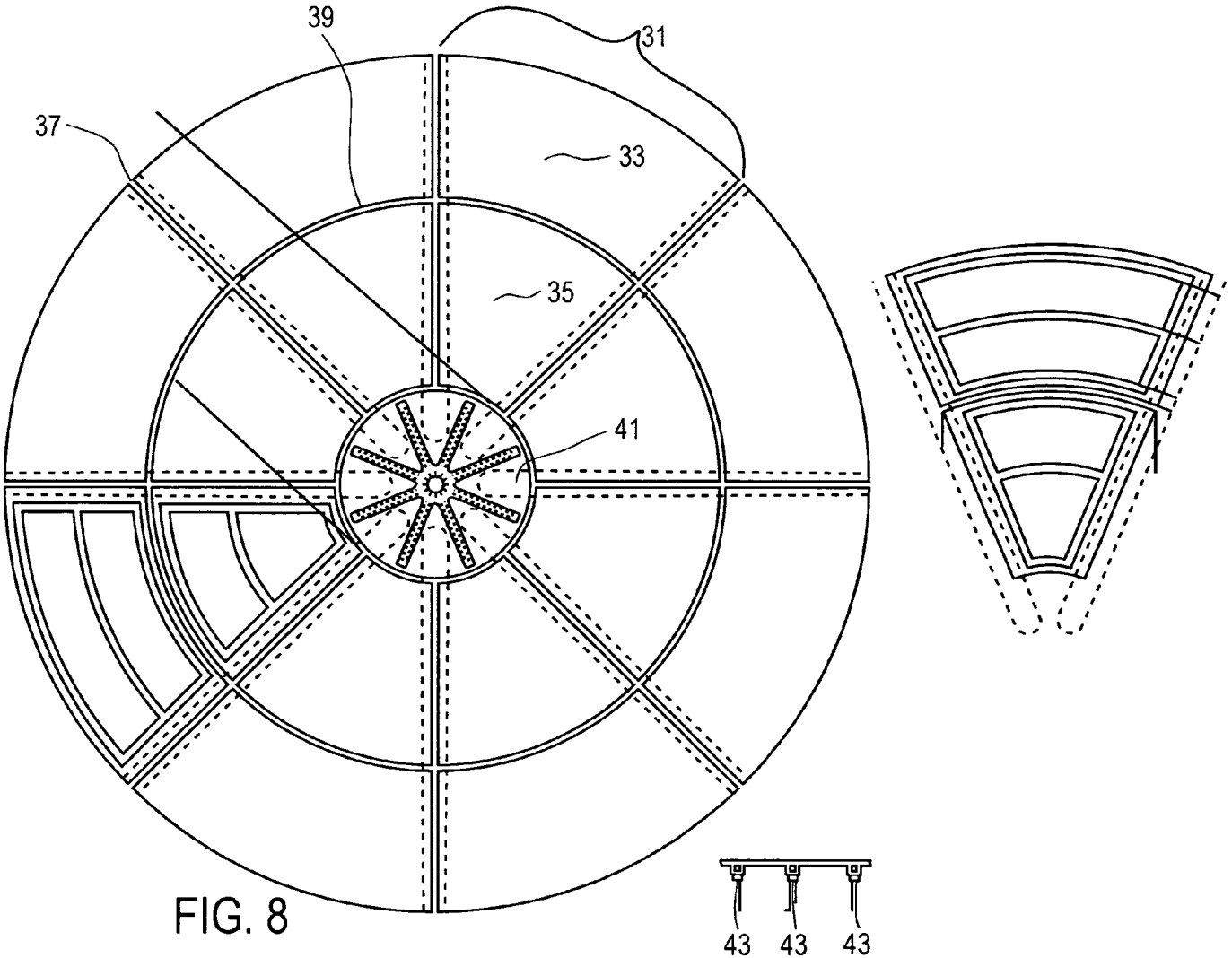
FIG. 8 depicts (A) a top view of a cover of the invention, with a support framework shown in phantom view; (B) a top view of a single panel with two segments; and (B) a side cutaway view of a segment.
Figure 8A:
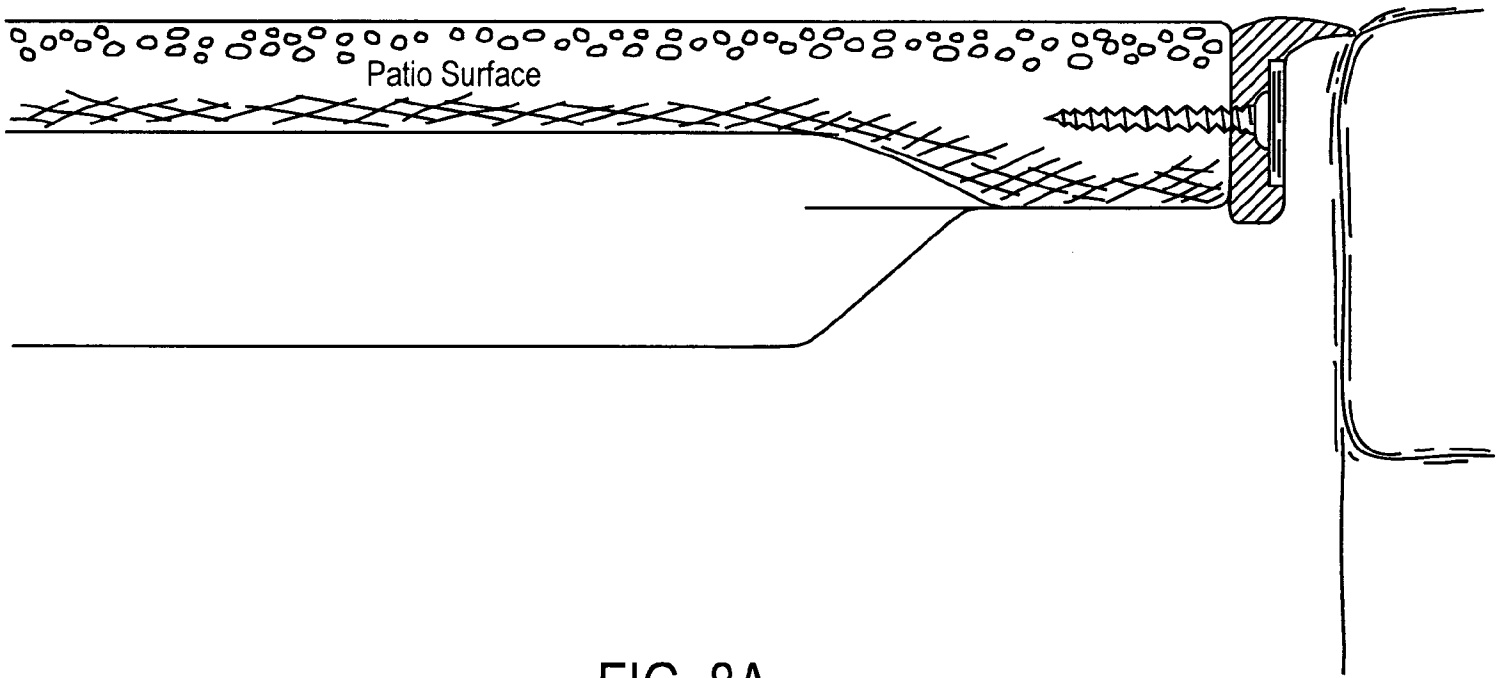
FIG. 8A depicts a patio surface with a seal, an edge thicker than the center, and a web support including fiberglass rods.
Figure 8B:
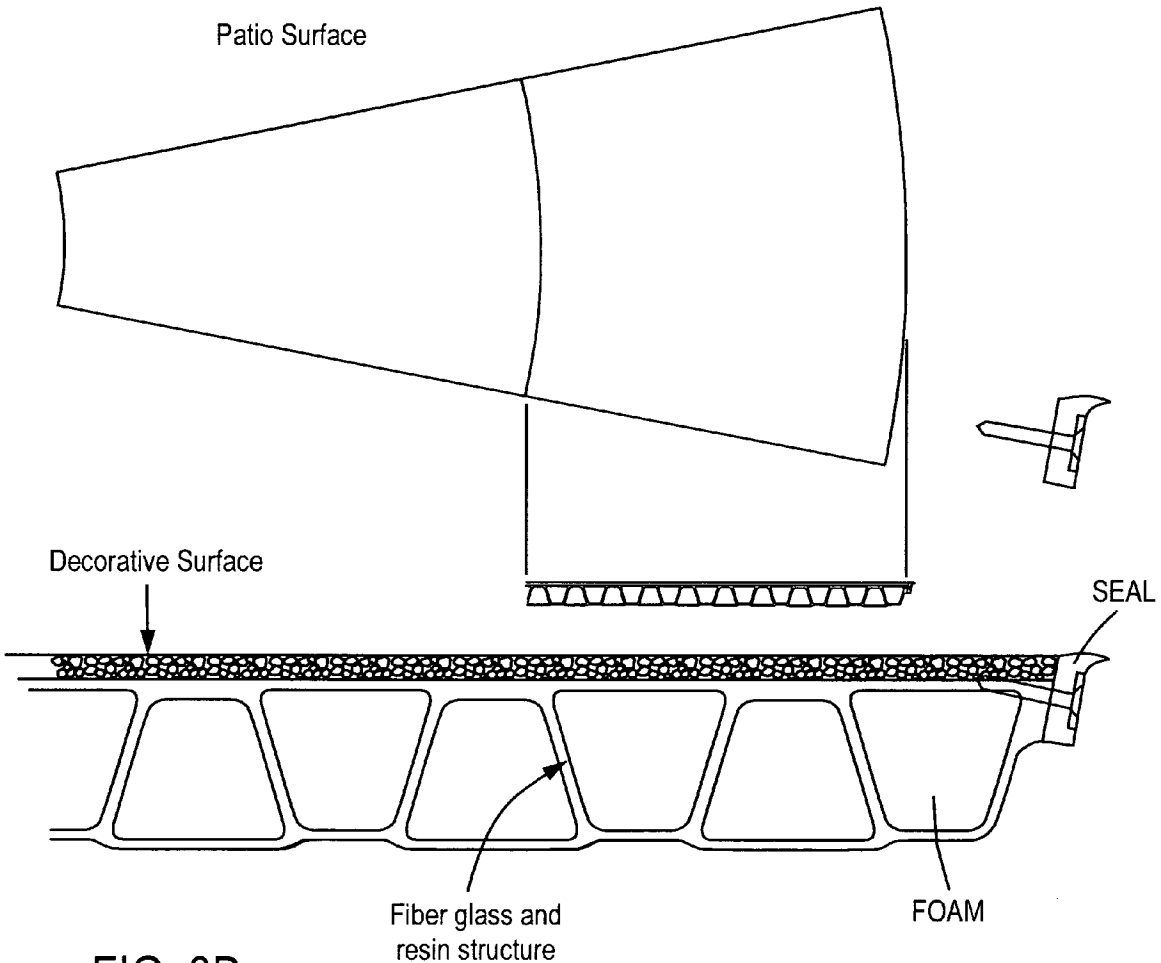
FIG. 8B depicts a further top and side view of a patio surface with a seal that will contact the coping. A fiberglass and resin structure includes optional foam inserts.
Figure 9:
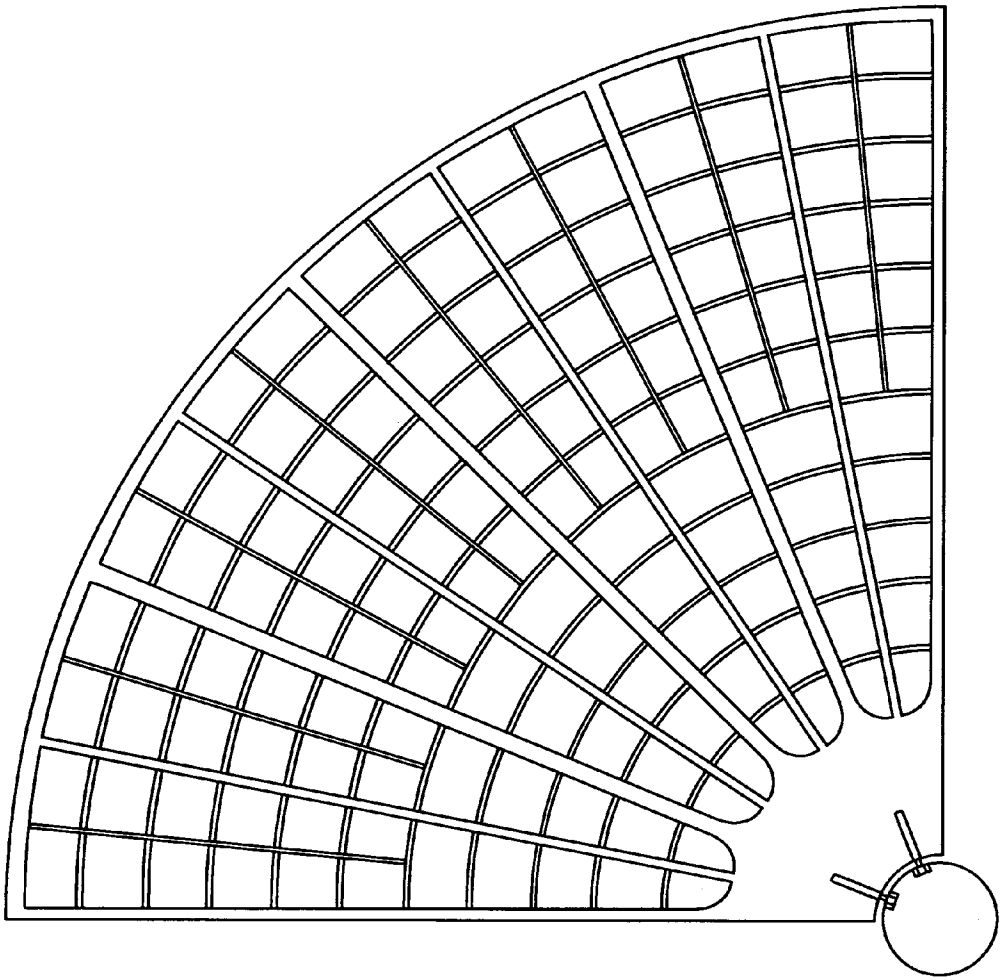
FIG. 9 depicts a panel that may be used to form a cover of the invention.

The cover may be of a single construction. The cover may also be constructed from two or more panels. Each panel may further be divided into segments. A circular panel may be constructed, for example, as shown in FIG. 7 and in FIG. 8. In FIG. 8, panel 31 includes segments 33 and 35. The spaces 37 between panels and 39 between segments may be sealed or may be left open. If left open, the spaces will allow flow of water when the cover lowers or raises. The spaces may be sealed, for example, by pool grout. The center of cover may include a cap 41. The panels and/or segments may also be interlocking. Another panel is depicted in FIG. 9.

The cover may include one or more access ports that allow access to the area between the bottom and the cover. When the cover is constructed from multiple panels and/or multiple segments, it is convenient to have a single panel or a single segment serve as an access port for maintenance or other purposes. This panel may be designed to be loosely affixed or released as the cover lowers into the pool, so that water may flow around the panel.

The cover may include an ornamental design on the surface. This ornamental design may be, for example, mosaic, tile, a modern motif, an antique motif, or a western motif. The cover may be cast so that it includes space for addition of tiles.

The cover may be made from any suitable material. For example, the cover may be constructed from casting material. Casting material may include, for example, concrete, fiberglass, resin, or combinations of those. Filler materials may also be included to reduce the mass of the cover. Filler materials include, for example, clay beads, or glass microspheres. In one embodiment, the cover is made from a mixture of epoxy, sand, pebbles, and glass microspheres. Preferably, the cover (or panels, or segments) is light enough to be lifted, moved, and assembled by no more than two people.

In one embodiment of the invention, both the top and the bottom of the cover are flat. In another embodiment, the bottom of the cover includes ribs 43, as shown in FIG. 8. These ribs increase the strength of the cover while still allowing portions of the cover to be thin and light enough for the cover to be lifted by no more than two people.

Figure 10:
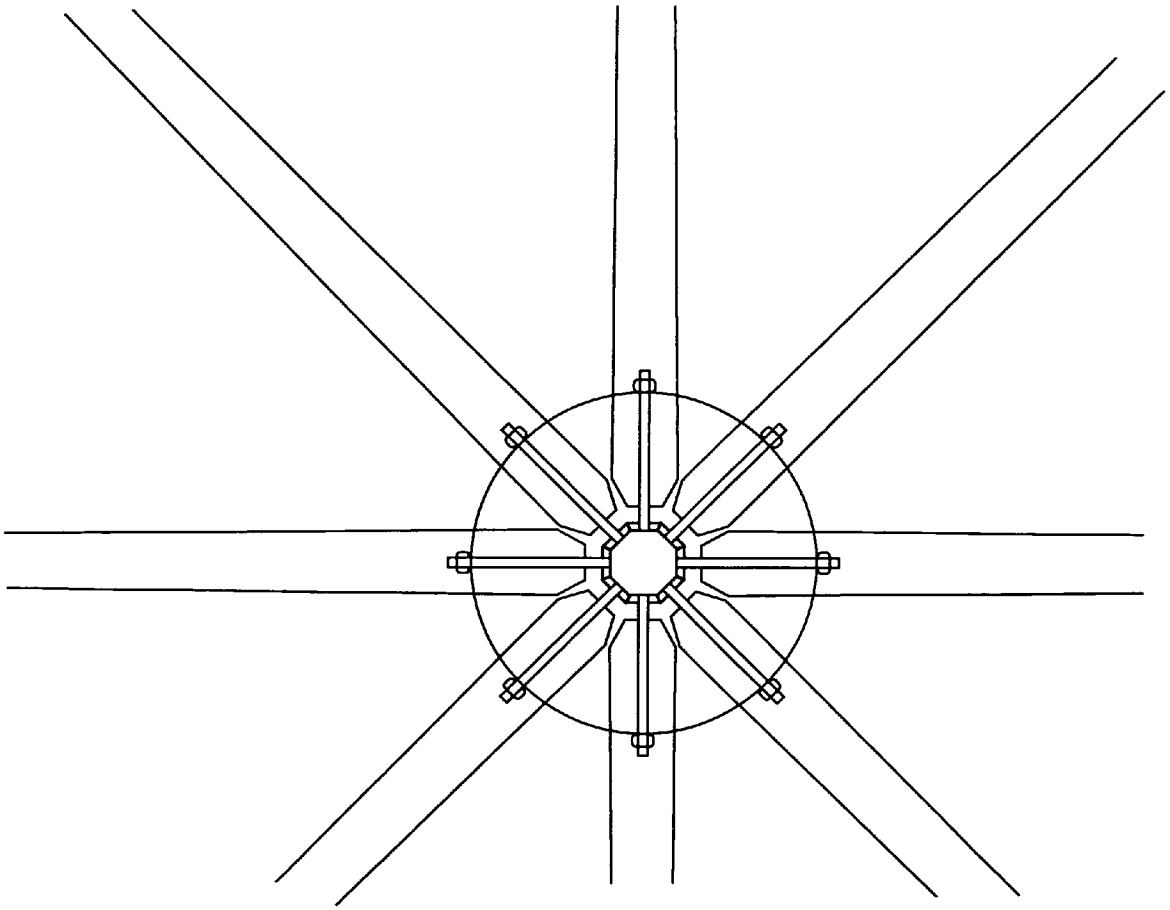
FIG. 10 depicts a hub and spoke frame for supporting a cover.

C. Framework

Where the cover is a single piece, it may rest directly on the mechanism used to lower and raise the cover. When the cover is constructed from multiple pieces, the cover ideally is supported by a framework. In one embodiment of the invention, the framework is a rim and leg framework as shown in FIG. 10. The rim and leg framework includes a plurality of support legs 45 extending from a rim 47 at the center of the cover to substantially the periphery of the cover. This divides the cover into a plurality of sections.

The rim and leg framework may be made of any material substantial enough to support the weight of the cover and of any people and/or equipment that may be placed on the cover when in the raised position. The rim and the legs may be of the same material or different material. This material may be, for example, stainless steel, aluminum, titanium, fiberglass, resin, or plastic. The rim and the legs may be coated with a material to help increase resistance to corrosion. For example, they may be coated with a fiberglass-reinforced polymer. This fiberglass-reinforced polymer may be, for example, epoxy.

Figure 11:
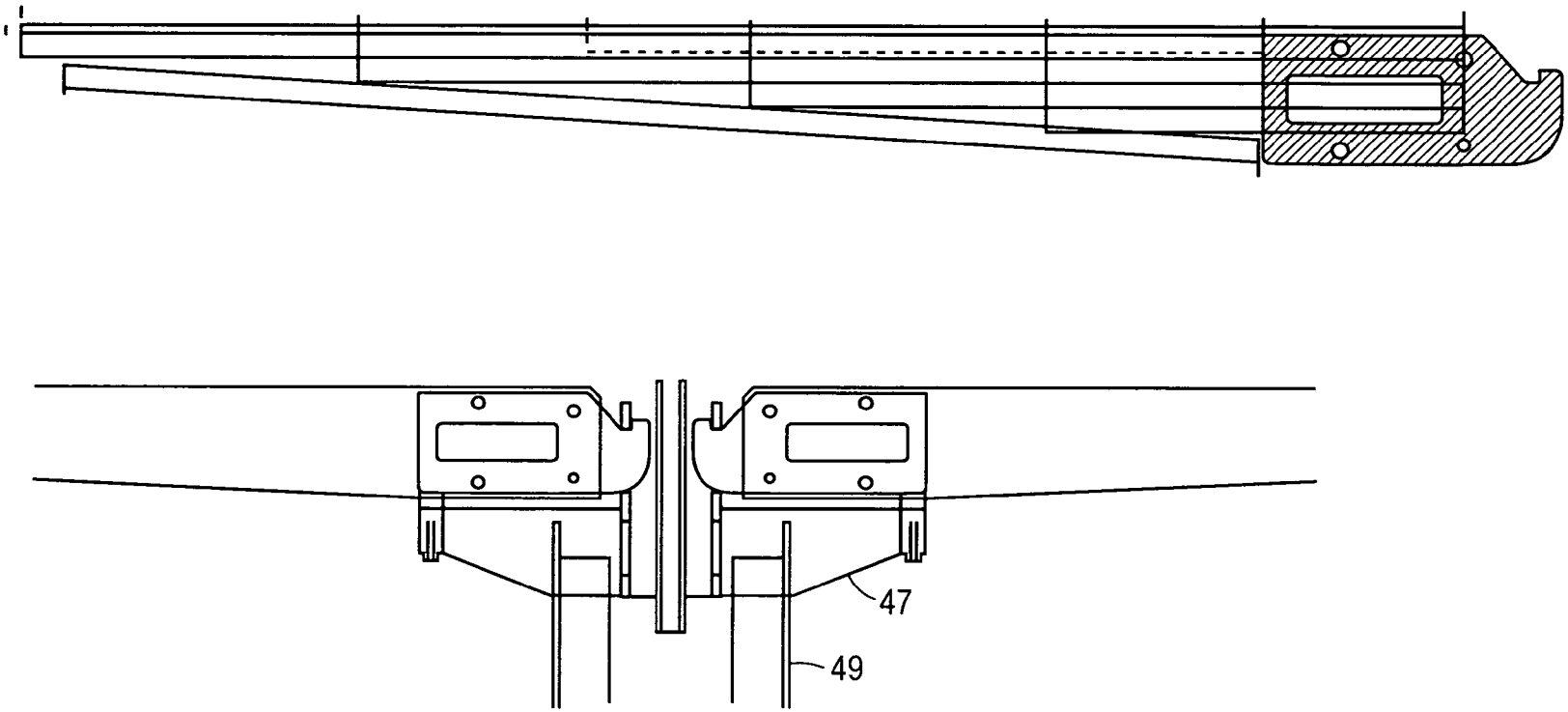
FIG. 11 depicts a partial side view of a hub and spoke frame shown in FIG. 10 (bottom) and a side view of a spoke (top).

The rim and leg framework may be created by fastening individual support legs to the rim. The rim is then attached to a central hub. In an alternative embodiment, support legs are attached directly to the hub. One suitable support leg is shown in FIG. 11. The rim or hub may then be bolted to the lifting mechanism, described below. One such lifting mechanism, a hydraulic cylinder 49, is shown in FIG. 10. Upon insertion into the hub, the support legs may be secured into the hub.

In a preferred embodiment, each pair of legs supports a single panel. Legs may also be situated so that there are one or more legs under each panel.

Figure 11A:
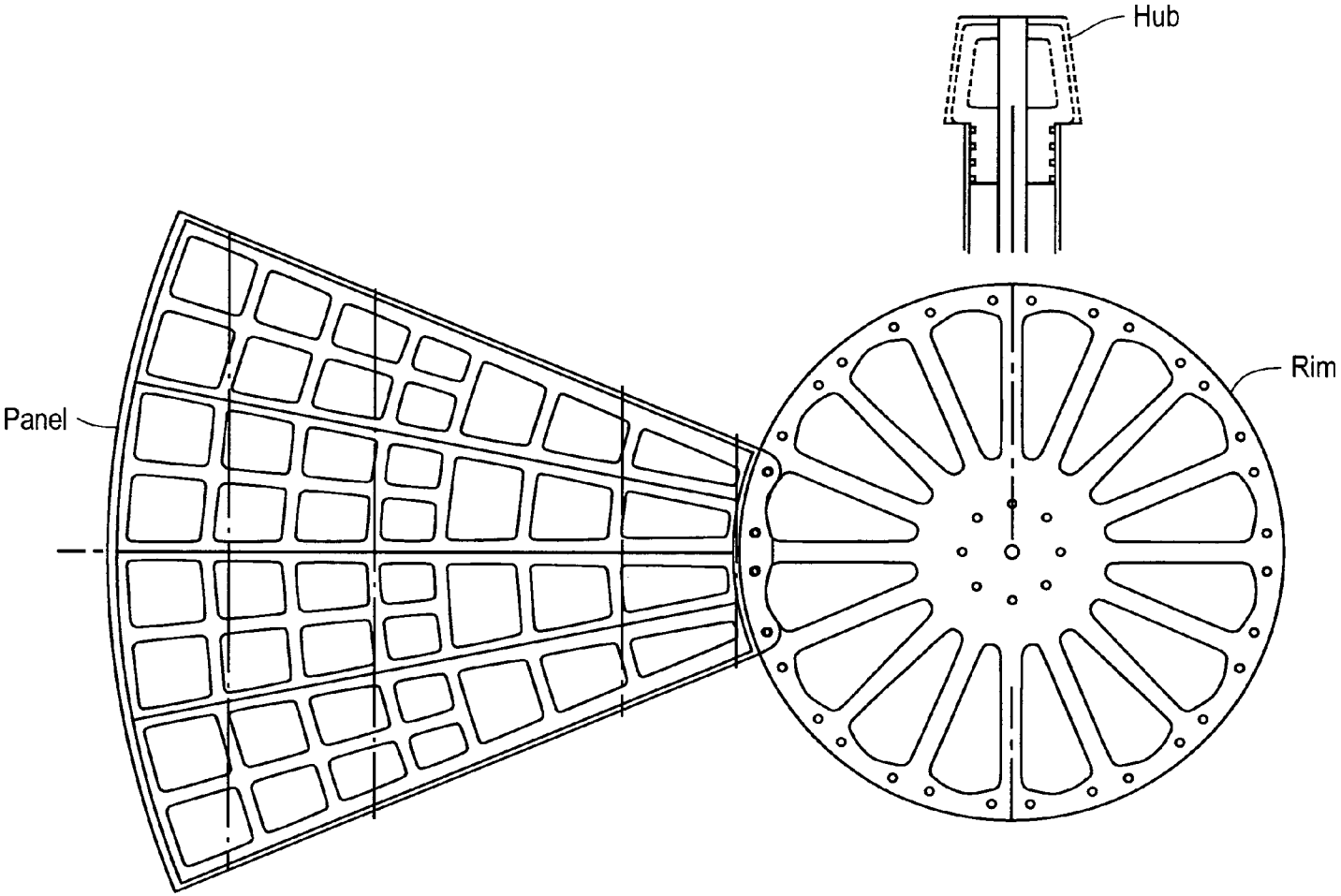
FIG. 11A depicts a top view of a rim and panel for a cover, with a side view of a hub.

In a further embodiment of the invention, each leg is reinforced by multiple sheets of material. One preferred material for this reinforcement is extended steel. Each leg may further be provided with an attaching mechanism, as shown in FIG. 11A. This allows the legs to be further secured, if desired or necessary. Extended steel legs may have multiple layers of extended steel. They may further be reinforced by epoxy, resin, or another substance.

Figure 12:
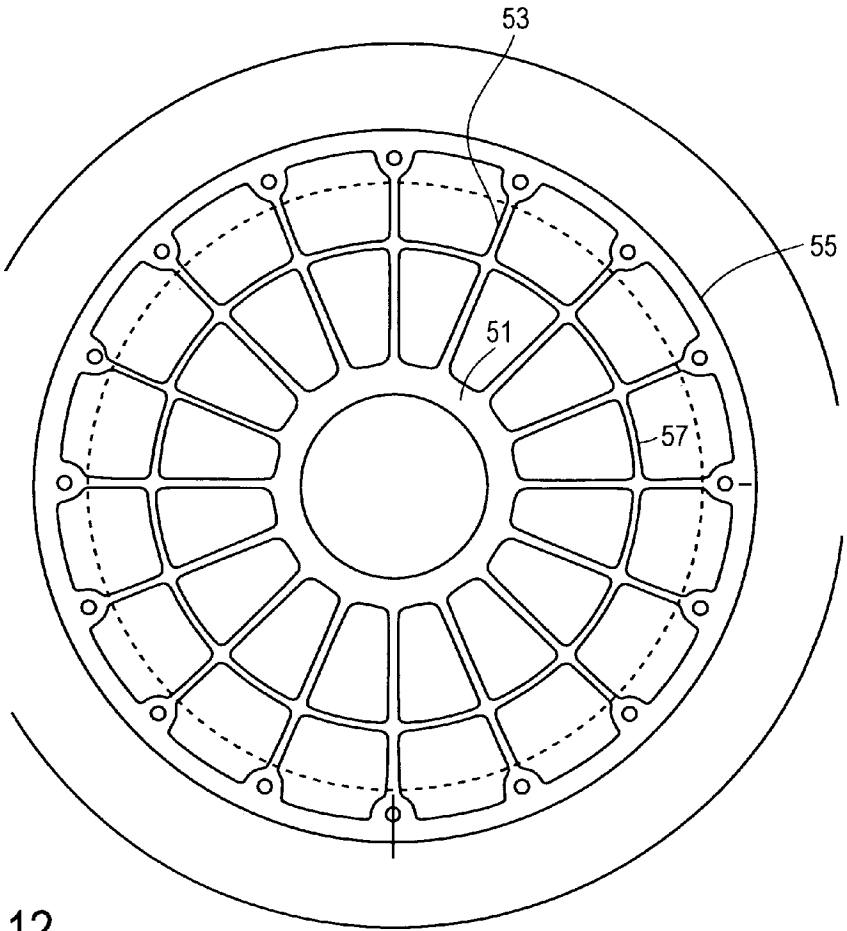
FIG. 12 depicts the top view of a hub, spoke and rim framework.
Figure 12A:
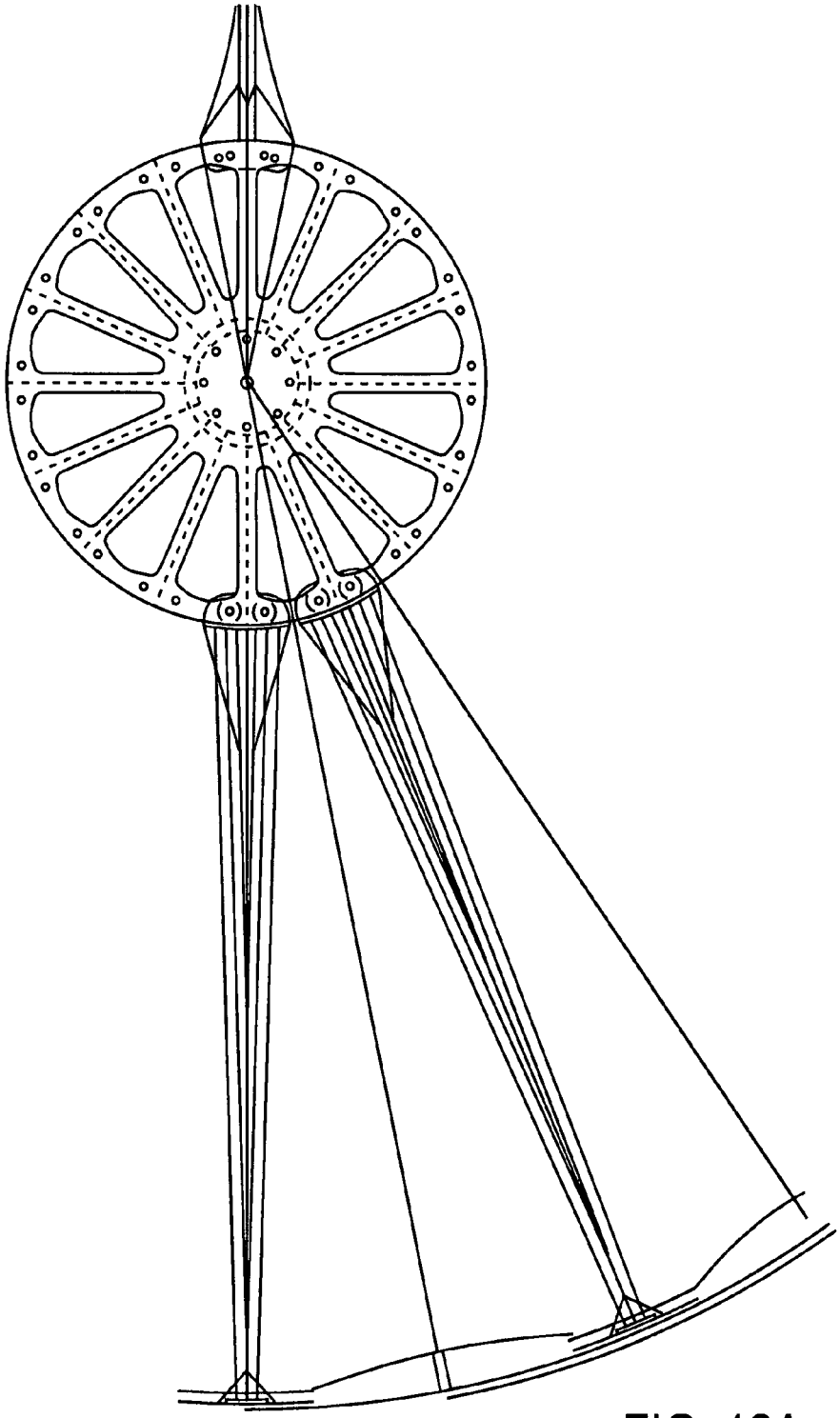
FIG. 12A depicts a top view of a rim and legs configuration of a support cover of the invention.

In a further embodiment of the invention, the framework is a hub, rim, and wedge framework. An example of a hub, rim, and wedge framework is shown in FIG. 12, which shows a hub 51, a plurality of wedges 53, and a rim 55. Another example is shown in FIG. 12A. Although the rim may be circular for maximum strength, it may be other shapes if desired. The hub, rim, and wedge framework may be individual interlocking pieces or it may be created as a single piece.

A wedge may be constructed to include one or more radiating legs, as shown in FIG. 12A. Portions of each wedge may be the same material or different materials. For example, the radiating legs included in the wedge may be steel coated with a corrosion-resistant material. This material may be, for example, a fiberglass-reinforced resin. The arctuate member of each wedge may be stainless steel or aluminum, for example.

Figure 13:
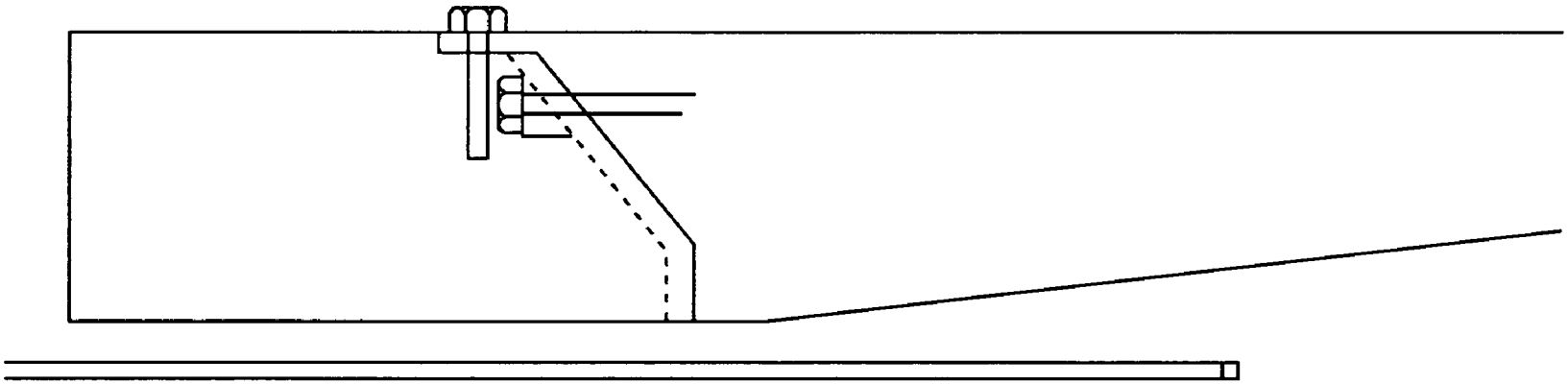
FIG. 13 depicts a side view of a support arm bolted to a beveled framework rim.
Figure 13A:
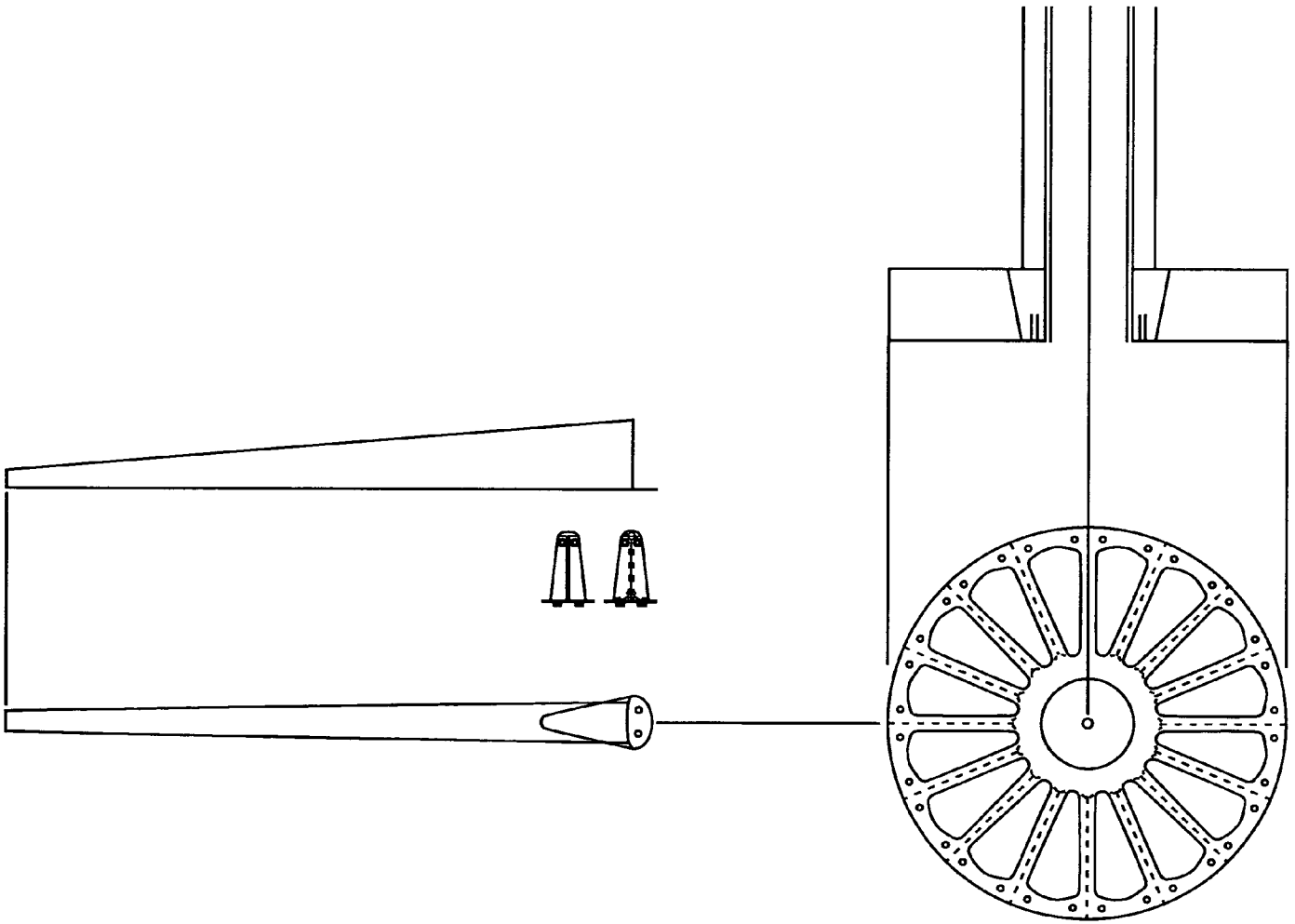
FIG. 13A depicts a top view of a rim, side view of a hub, and top, front, reverse, and side views of support arms.
Figure 13B:
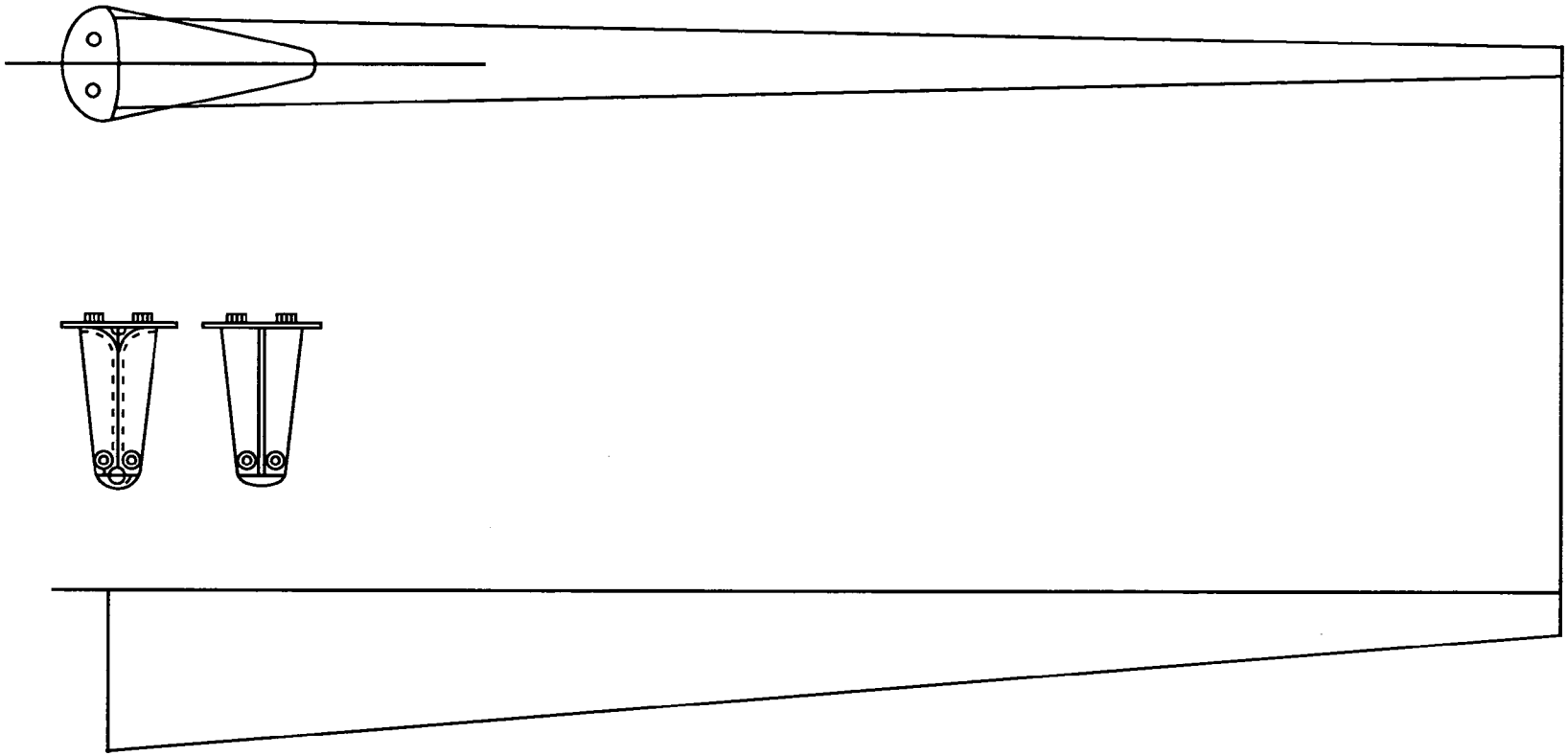
FIG. 13B depicts a top, front, reverse, and side view of a support arm.
Figure 13C:
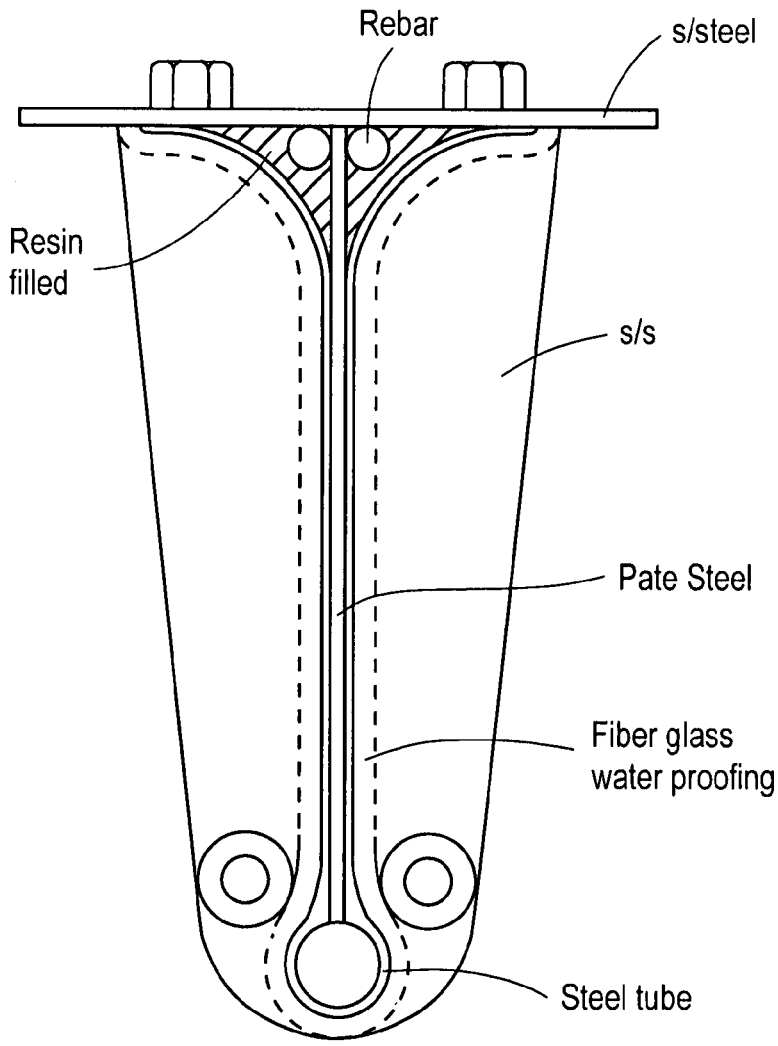
FIG. 13C depicts a front view of a support arm of FIGS. 13A and 13B.
Figure 13D:
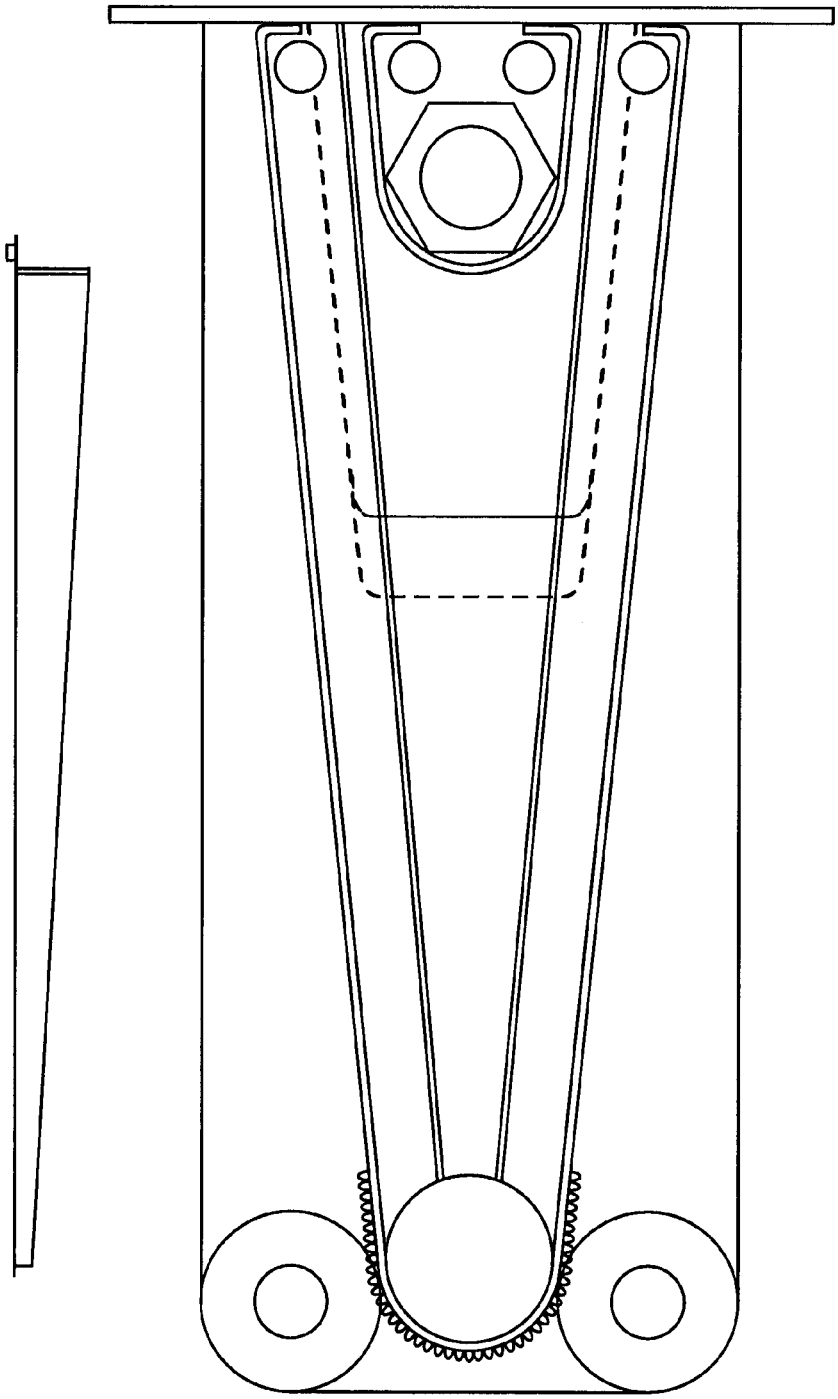
FIG. 13D depicts a front view of another possible support arm.

In a preferred embodiment, the rim is five feet in diameter and made of aluminum. Additional stability may also be provided by adding additional crosspieces 57, as shown in FIG. 12. The rim may also be made, for example, from stainless steel, fiberglass, titanium, or other materials. If additional support is desired, further spokes (support arms) may be placed along the perimeter of the rim, as shown in FIG. 13. These spokes may have beveled tops that correspond with similar beveling on the rim. In a preferred embodiment, each further spoke is secured by two bolts, as shown in FIG. 13. FIG. 13A depicts a top view of a rim, side view of a hub, and top, front, reverse, and side views of support arms, which may be, for example, a combination of fiber composite, steel, and stainless steel. FIG. 13B depicts a top, front, reverse, and side view of a support arm. FIG. 13C depicts a front view of a support arm of FIGS. 13A and 13B. It includes rebar, a stainless steel top, a stainless steel backplate, a steel stabilizing tube, a resin fill, and a fiberglass waterproofing. FIG. 13D depicts a front view of another possible support arm, including a stainless steel endcap.

Figure 14:
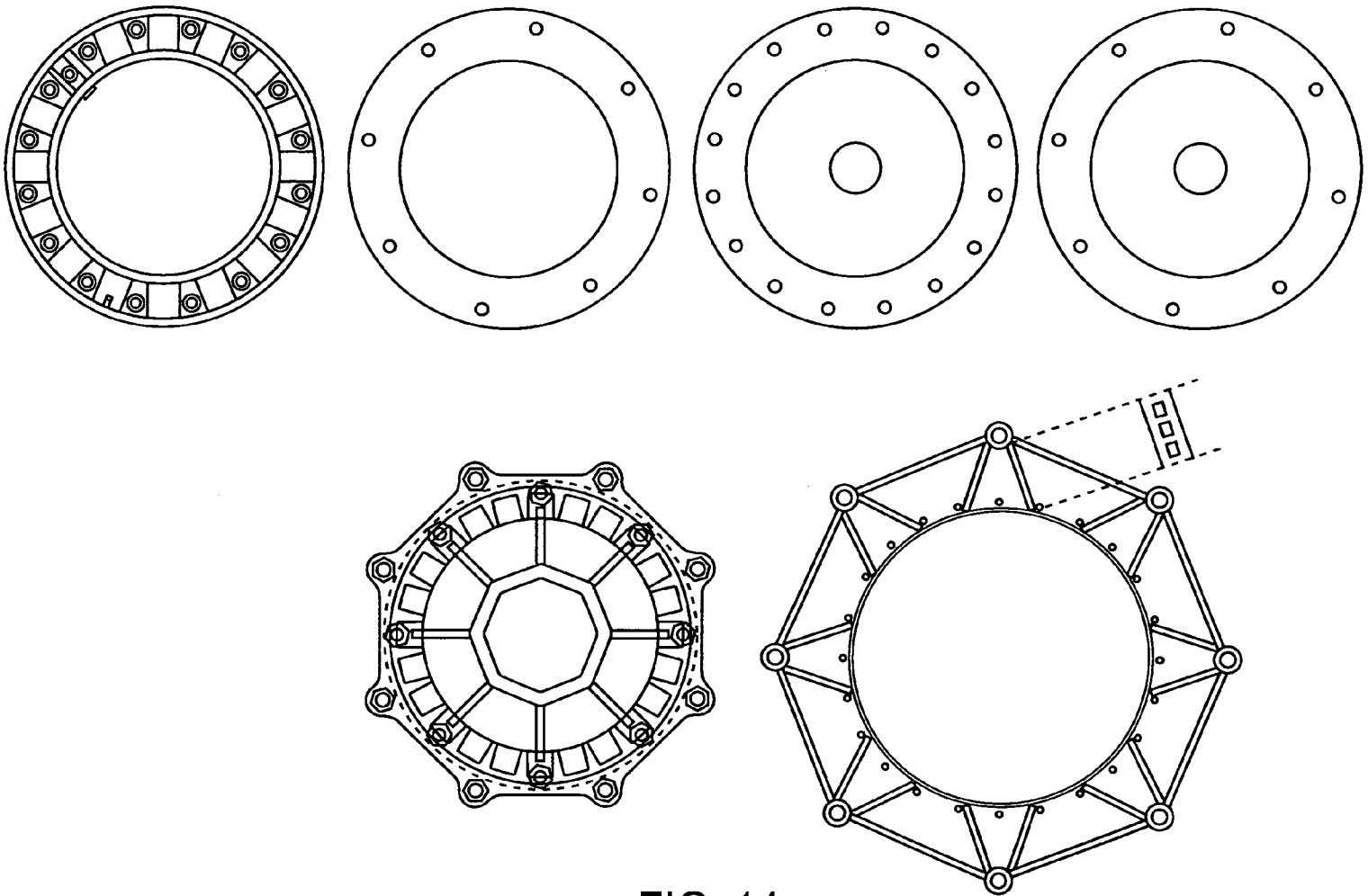
FIG. 14 depicts a number of possible support frameworks for use in the invention.

Additional rim designs are shown in FIG. 14. The central hole of the rim may be tapered to match a corresponding taper of the cylinder.

Use of a framework to support the cover has a number of advantages. For example, use of a geometric framework allows a minimum number of panels to be affixed to the framework, providing a large-sized cover. Because the panels can span edge to edge without direct support from the center of the framework, they can be assembled by dropping them into place and securing them. Panels may be secured, for example, by pins, screws, bolts, protrusions in the casting, or other ways that will be recognized by those skilled in the art with the benefit of this disclosure.

In one embodiment of the invention, the cover may include a separate piece that can be raised independently of the remainder of the cover. This separate piece may be located anywhere on the cover and may be any shape. Ideally it is located in the center of the cover and is circular. The separate piece may even be raised above the maximum level of the cover. The separate piece may be used as a table when the cover is in any position. For example, the cover may be lowered so that there is about one foot of water above the surface of the cover, and the table may be raised about three feet above the level of the cover. This would allow a user of the pool to sit at the table and eat or perform other activities, while still soaking his feet in the pool.

The mechanism used to raise and/or lower the separate piece may be separate from or integral to the mechanism used to raise and/or lower the cover. For example, where the separate piece is a central table, the table may be raised by a separate piston in the central cylinder. Preferably, the table is raised by a separate cylinder that is situated in a separate hole in the cylinder. In this preferred embodiment the table has its own water supply and is able to be raised and lowered entirely independently of the cover. In such a preferred embodiment, the cylinder for raising and lowering the table is about 50 inches long. Lift cylinders for embodiments of the invention are provided in more detail in Section E, below.

The lift technology described herein may be used to make a table that raises and lowers and is not associated with a pool. This may be useful, for example, where a user has a small yard and wishes to have a table available but not always present. A lift cylinder could be embedded in the ground and provided with a water pump and supply. Optionally, a cover could be provided that would simulate the surrounding greenery. In this way the table could be completely out of sight when not in use.

D. Coping

Figure 15B:
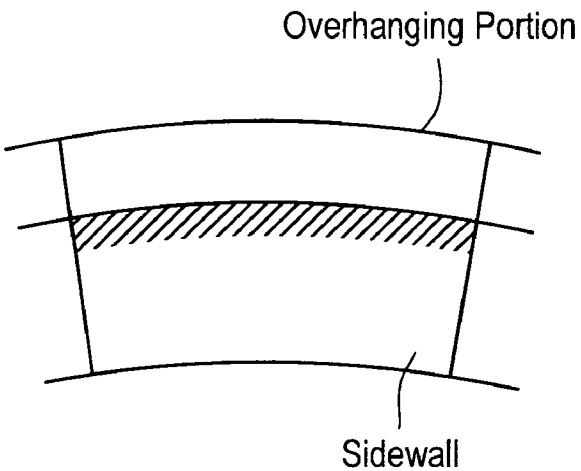
FIG. 15 depicts a top view (A) and a side view (B) of coping used in an embodiment of the invention.
Figure 15A:
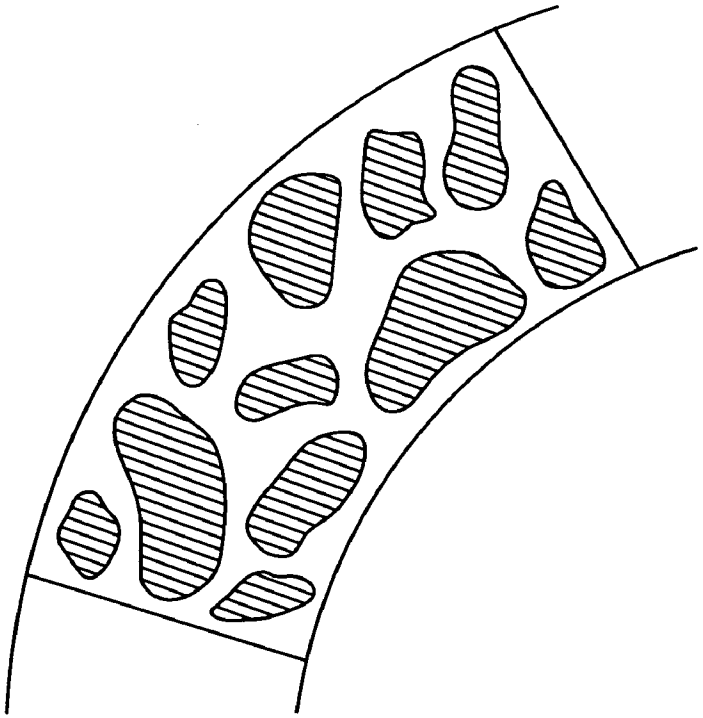

The sidewalls of the pool may include pool coping. The coping provides finished edges. If desired, the coping provides a seal with the cover. This allows the cover to seal the pool when in or near the highest raised position. FIG. 15 shows a top and side view of coping in one embodiment of the invention. Gasket-type devices, including inflatable gaskets, materials, and methods, may be used to tighten the seal between the coping and the cover. This may prevent debris from entering the pool.

A variety of copings may be used in the invention. In one embodiment, a custom coping is installed by an artisan who is skilled in stoneworking. In a preferred embodiment, a coping is cast from a mold. The cast coping may be one or more pieces. These pieces may be assembled on-site, allowing significant portability of the coping. Coping may be made, for example, from cement, concrete, stone, or other material.

Coping may include one or more holes for attachment of a ladder. This ladder may be placed in the pool following lowering of the cover to a depth where a ladder is necessary or desirable. A sidewall may further contain one or more detents for securing a ladder. The ladder may be provided with a failsafe to prevent the ladder from interfering with the raising or lowering of the pool. For example, the ladder may be designed to break away if contacted by the cover, or it may sound an alarm if the cover is raised within a certain proximity.

E. Mechanism(s) for Elevating and Lowering the Cover

The cover of the pool may be raised and lowered by a user to allow water to flow from one side of the cover to the other. In a preferred embodiment, when the cover has been raised to its maximum level, the cover is above the surface of the water and flush with the surrounding area. The cover may then be used, for example, as a patio. When the cover is lowered to its lowest level, the maximum pool depth is available.

The pool may also be designed so that it is capable of stopping at one or more levels between the maximum level and the minimum level. When stopped at these levels, the pool may provide water of various apparent depths based on the position of the cover relative to the surface of the water. For example, when the cover has been lowered from its maximum level such that only a small amount of water is on the upper side of the cover, the pool may be used as a decorative reflecting pool, a wading pool, or a child's play pool. At levels closer to the minimum level, the pool may be used as a hot tub, a whirlpool, or a therapy pool. A pool's control mechanism may be configured to allow the pool to stop at any point designed by the user. It may also be configured to allow the pool to stop at any of a number of specified depths.

The mechanism for raising and lowering the cover may be any mechanism sufficient to lift the cover when it is at its minimum elevation (and therefore under the greatest amount of water). Although the cover may be lowered slowly by gravity depending on the density of the cover, it is preferable that the mechanism provide force to lower the cover. The mechanism may be any manual, automated, and/or motorized mechanism. This may include, for example, pulleys, gears, scissor lifts, air pillows, hydraulics, or combinations of these. Although the description generally discusses a single mechanism, it will be understood that more than one mechanism may be used in tandem, or that a failsafe mechanism may be included to raise the cover in case of failure of the primary mechanism or in case the cover needs to be raised very rapidly. The mechanism for raising and lowering the cover may be completely contained beneath the cover of the pool.

The mechanism may raise and lower the cover by exerting a force from the top, side, and/or bottom of the cover. It may also raise or lower the cover by exerting a force from one or more locations on or about the periphery of the cover.

In one embodiment, the lifting mechanism is at least one hydraulic cylinder. A hydraulic cylinder is connected to the bottom of the pool cover or the bottom of the framework. The hydraulic cylinder is a one-stage cylinder or a multiple-stage cylinder. The multiple-stage cylinder may be a telescopic cylinder. A telescopic hydraulic cylinder includes sections of tubing with successively smaller diameters. These sections nest inside, which results in a smaller housing being required for the hydraulic cylinder. When a telescoping hydraulic cylinder is activated to raise the cover, the largest stage, with the smaller stages inside it, will move first, and this continues for each stage until the telescopic hydraulic cylinder is fully extended. When retracting, the smallest-diameter stage retracts before the next stage starts moving.

Figure 16:
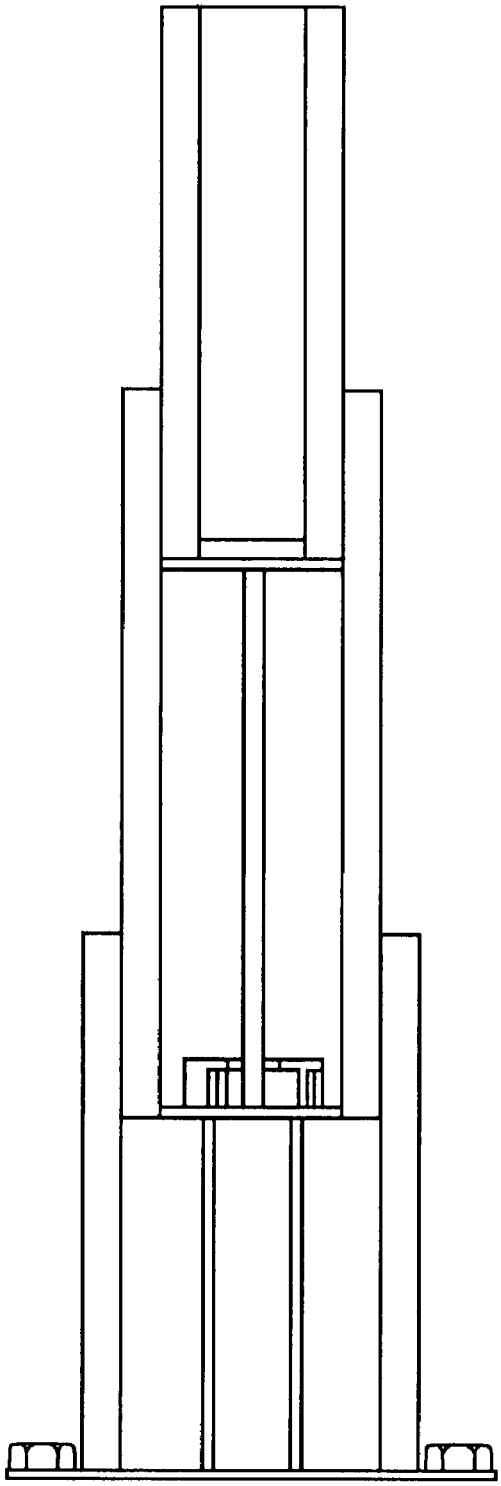
FIG. 16 depicts one example of a multiple-stage hydraulic cylinder for use as a lifting mechanism in the invention.

One example of a multiple-stage hydraulic cylinder for use in the invention is shown in FIG. 16. Further examples are shown in FIG. 17A and FIG. 17B. A lifting mechanism using this multiple-stage hydraulic cylinder could be placed in a hole as shallow as 24 inches in the bottom of the pool.

Figure 17:
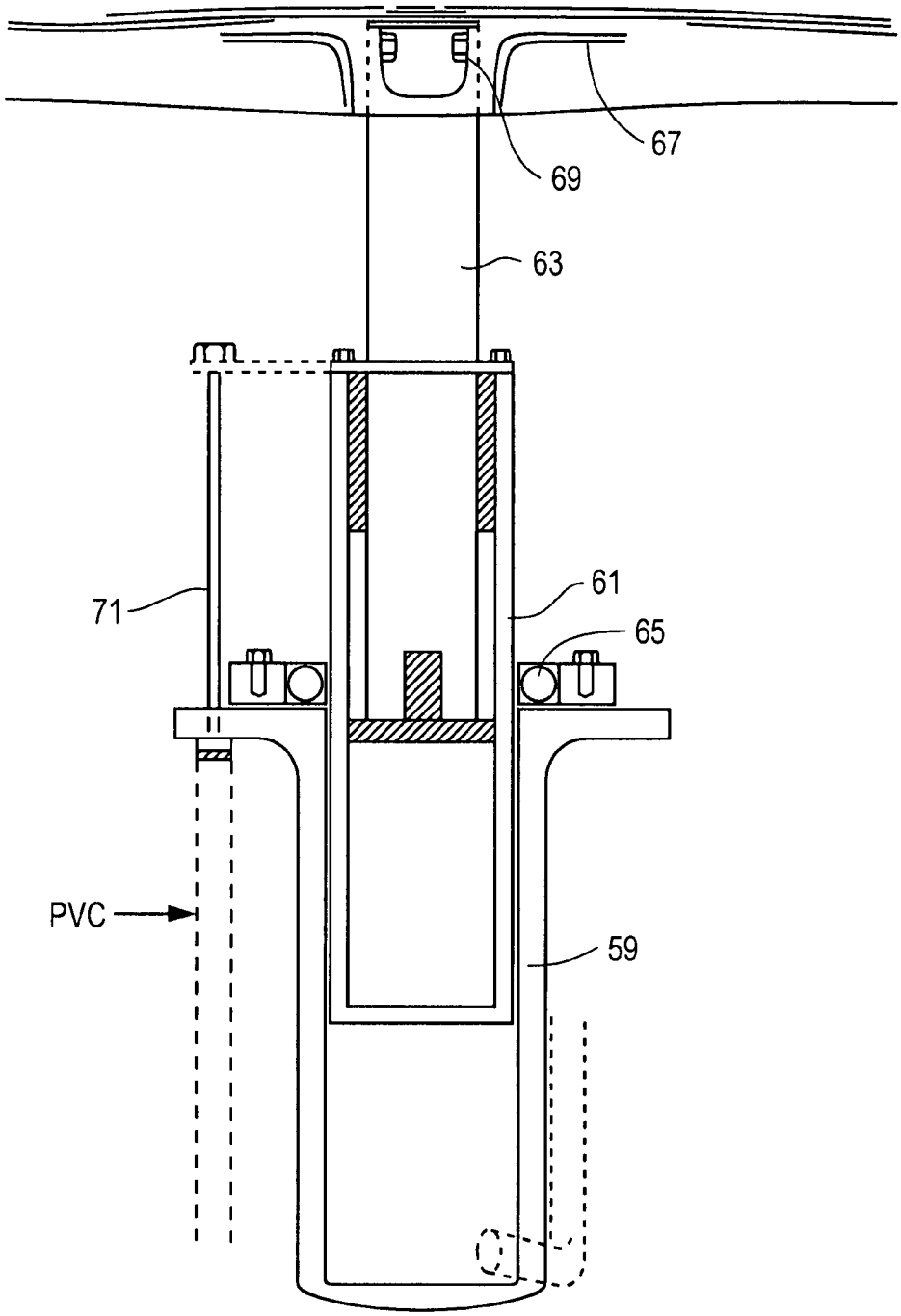
FIG. 17 depicts another example of a multiple-stage hydraulic cylinder for use as a lifting mechanism in the invention.
Figure 17A:
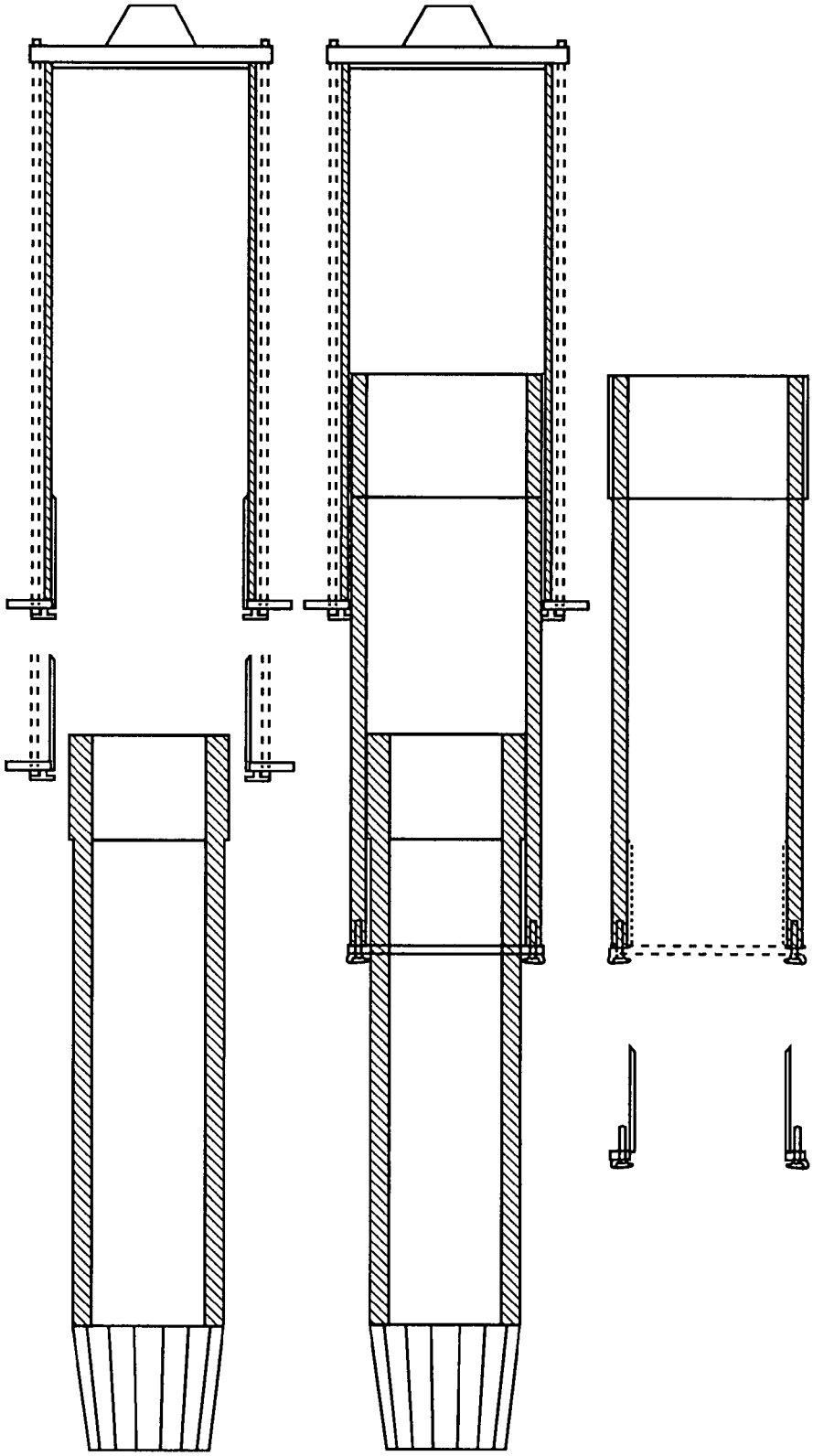
FIG. 17A depicts a further example of a multiple-stage cylinder.
Figure 17B:
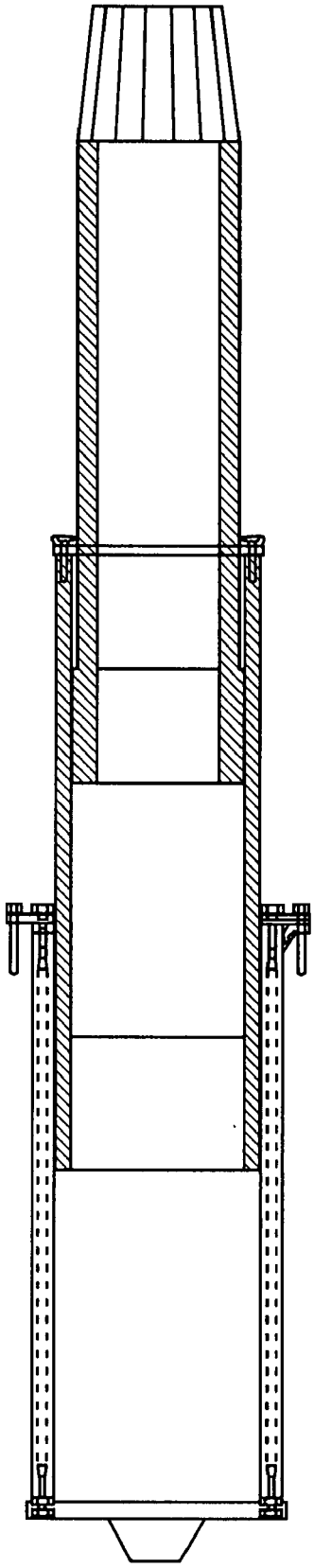
FIG. 17B depicts a further example of a multiple-stage cylinder.
Figure 17C:
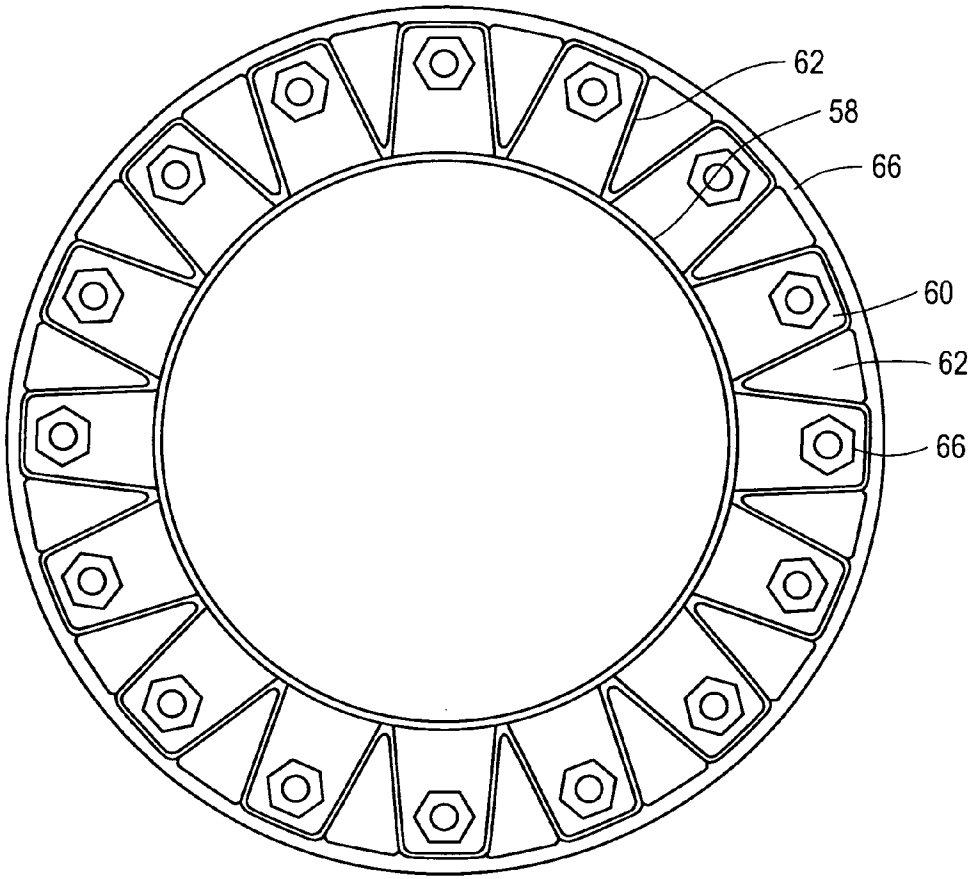
FIG. 17C depicts a top view of a cylinder of the invention.

FIG. 17C shows an additional cylinder for use in the invention. In FIG. 17C, a central cylinder 58 is surrounded by a plurality of foam prisms 60 having a trapezoidal cross section. These prisms 60 are wet-coated with a layer of fiberglass 62, and foam prisms 64 having a triangular cross-section are inserted into the spaces between the prisms 60. A further layer 66 of fiberglass is applied. FIG. 17C also shows an end cap 66, including hexagonal bolt attachments, superimposed on the cylinder.

Another example of a hydraulic cylinder for use in the invention is shown in FIG. 17. The hydraulic cylinder assembly in FIG. 17 includes a receiving cylinder 59 that surrounds a first hydraulic cylinder 61 and a second hydraulic cylinder 63. The interface of the receiving cylinder 59 and the first hydraulic cylinder 61 is sealed by an O-ring 65. Connection of the second hydraulic cylinder to the framework 67 occurs at 69. The hydraulic cylinder further includes an optional threading rod 71 that may be used to adjust the default height of the hydraulic cylinder. The threading rod may be a stainless steel threading rod FIG. 17 also shows the flow inlet 73 from the pump (not shown).

A hydraulic cylinder for use in the invention may be constructed, for example, from plastic, aluminum, fiberglass, stainless steel, or other materials. In one embodiment, the hydraulic cylinder is a plastic cylinder with a stainless steel sheath. In a further embodiment, the hydraulic cylinder and the receiving cylinder (described below) have curved grooves. These grooves allow the pool cover to rotate as it raises and lowers. This may provide a pleasing visual effect.

The bottom of the hydraulic cylinder is contained in a receiving cylinder. The receiving cylinder is recessed into the bottom of the pool. The receiving cylinder may be constructed of the same material or different material than the hydraulic cylinder. The receiving cylinder may be, for example, stainless steel, plastic, polymer, fiberglass, aluminum, or other suitable material. Preferably the receiving cylinder is a plastic cylinder with a stainless steel sheath. Preferably the inner diameter of the receiving cylinder is no more than $^{10}/_{10,000}$ to about $^{50}/_{10,000}$ greater than the outer diameter of the hydraulic cylinder. Ideally the difference will be as small as possible.

Any suitable fluid may be used to exert hydraulic pressure in the hydraulic cylinder. For example, the hydraulic cylinder may contain hydraulic fluid, olive oil, or water. Water is preferred as the fluid used to exert the hydraulic pressure. When the hydraulic cylinder comprises water, leakage of the hydraulic cylinder is of little concern, because the leaking water in the cylinder will merely mix with the water of the pool. Controlled leakage may be beneficial, because it can allow the water in the hydraulic cylinder to be exchanged on a regular basis. The hydraulic cylinder may also be equipped with a backflow valve to allow the fluid to be replaced.

Figure 18:
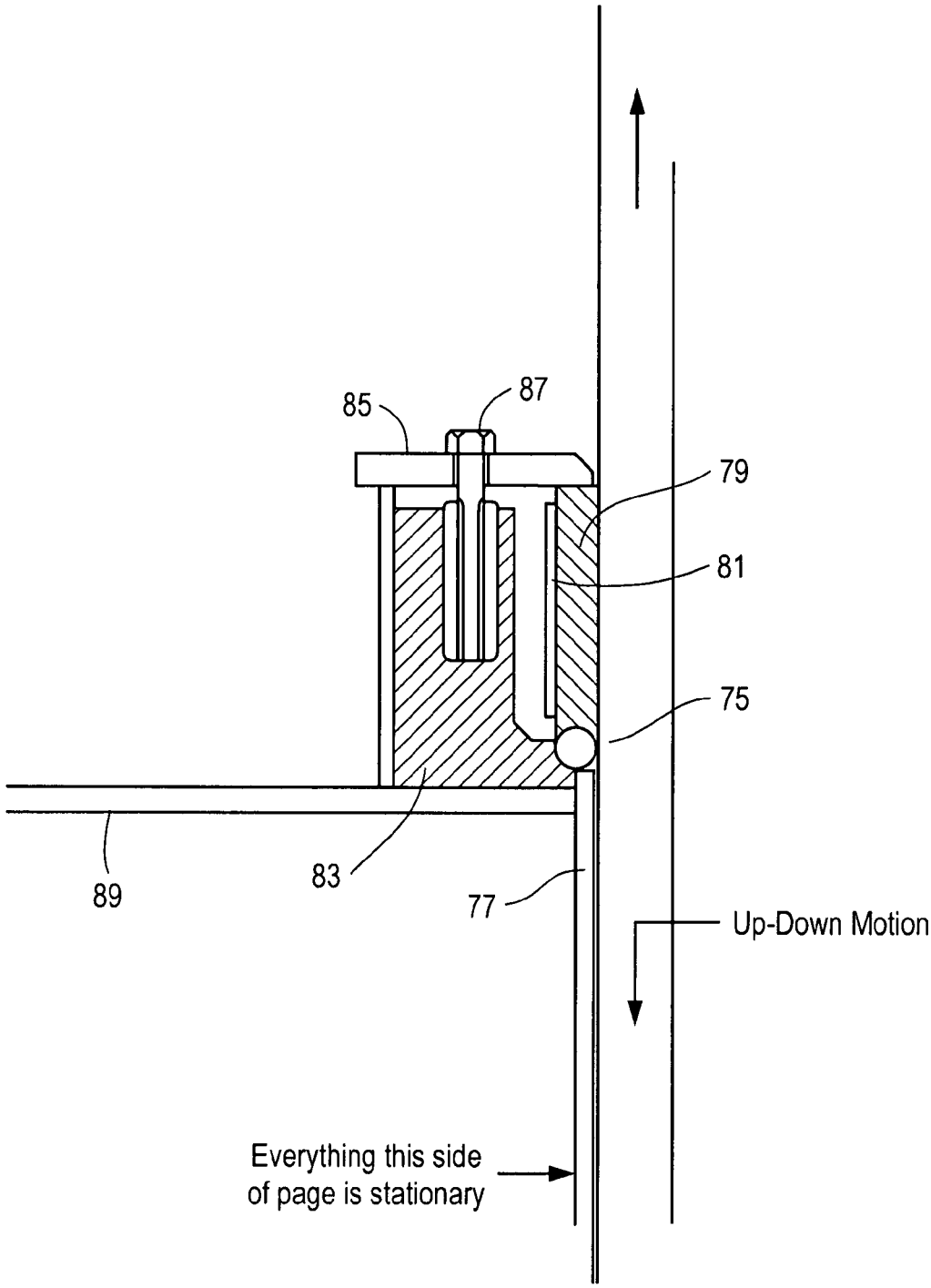
FIG. 18 depicts a side cutaway view of a sealed interface for a receiving cylinder and hydraulic cylinder of the invention.

Those skilled in the art will recognize that the hydraulic cylinder and the receiving cylinder should meet at a sealed interface to prevent leakage of the fluid used to provide the hydraulic power. A cutaway view of one sealed interface is shown in FIG. 18. In this sealed interface, an O-ring 75 is situated between the receiving cylinder 77 and an ultra-high molecular weight polyethylene (UHMW) strap 79, with a further tensioning strap 81. In one embodiment, the receiving cylinder and the further tensioning strap are stainless steel. The interface is filled with epoxy, silicon, or another sealant 83 and secured with a pressure plate 85 that is secured to the epoxy. In one embodiment, the pressure plate and the bolts 87 that secure the pressure plate are stainless steel. The pool bottom 89 is also shown.

Figure 19:
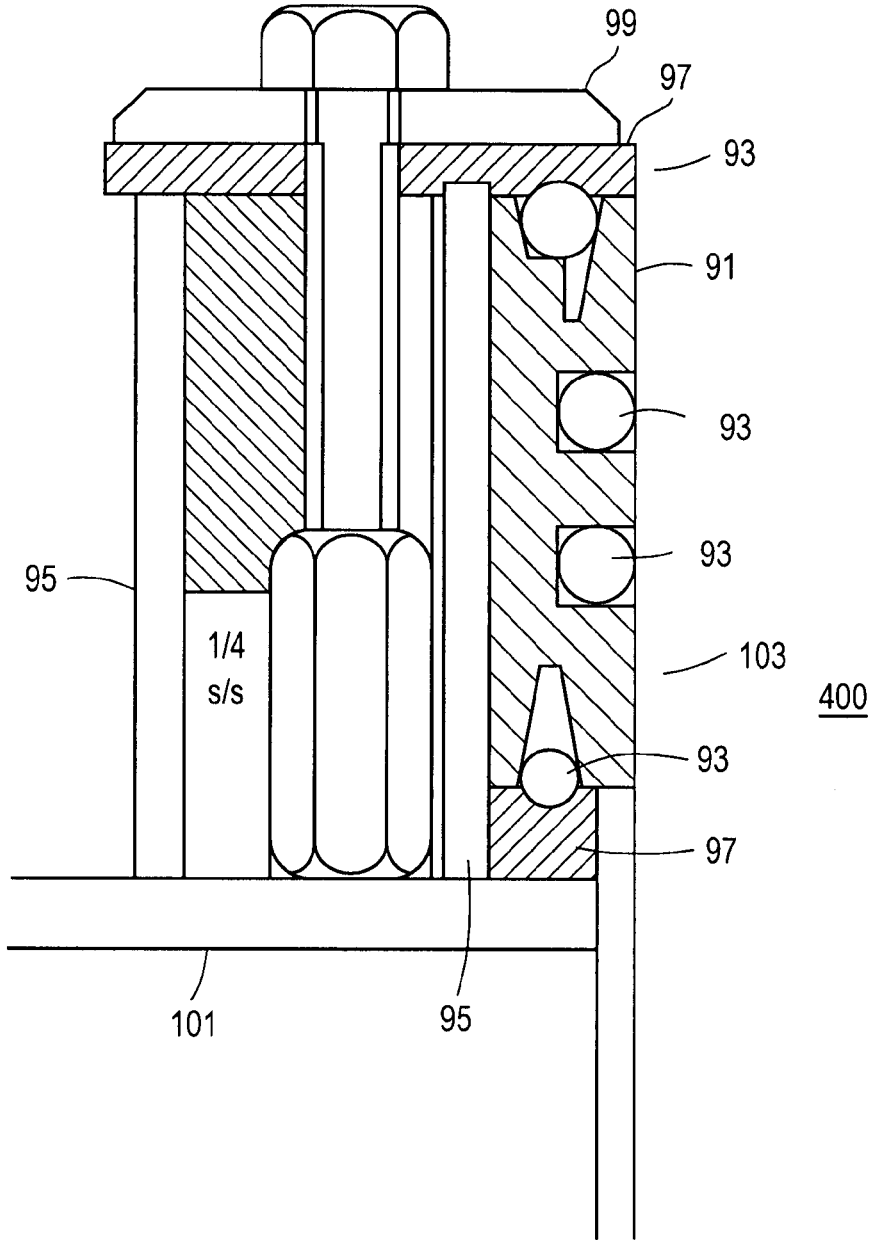
FIG. 19 depicts a side cutaway view of another sealed interface for a receiving cylinder and hydraulic cylinder of the invention.

An alternative sealed interface is shown in FIG. 19. The sealed interface of FIG. 19 includes a gasket 91, which may be a Teflon® gasket. The gasket encloses multiple O-rings 93. The gasket and the O-rings are stabilized by an enclosure 95. The enclosure may be a stainless steel enclosure. An optional layer of sealant 97 covers both the enclosure and the gasket, and a pressure plate 99 is bolted to the enclosure. The pool bottom 101 and receiving cylinder 103 are also shown. Preferably the seal may be accessed without removing the cover of the pool.

In a further embodiment, multiple hydraulic cylinders are used. Each hydraulic cylinder may have the characteristics of the single lifting cylinder described above. The characteristics of the multiple cylinders may be the same or different. This embodiment is preferred for situations in which more than one portion of the cover is raised or lowered independently of another portion or portions of the cover. For example, a rectangular pool and cover could be designed with a hydraulic cylinder at either end of an axis of the rectangle. If the cover is a single piece, lowering one cylinder to a greater extent than the other cylinder could create a pool with a sloped bottom. If the cover were multiple pieces able to move independently, lowering one cylinder to a great extent than the other could create a pool with two different depths. If desired, perhaps for safety reasons, pools with cover pieces able to move independently of each other could have the cover pieces connect by a membrane that would prevent items and people from traveling and/or being trapped under the portion of the cover that has a greater elevation.

Use of a hydraulic lifting mechanism has a number of advantages. Force exerted by a hydraulic cylinder is expressed in the simple relationship:

$$\text{Cylinder Output Force (pounds)} = \text{Pressure (psi)} \times \text{Cylinder Area (in}^2\text{)}$$

Even a modestly-sized cylinder is able to provide a substantial multiplier to the pressure that is provided. For example, a cylinder with a diameter of 12 inches multiplies pressure over 113 times. A cylinder of that diameter would be able to support a weight of over 11,000 pounds using a pressure of only 100 psi.

Figure 20:
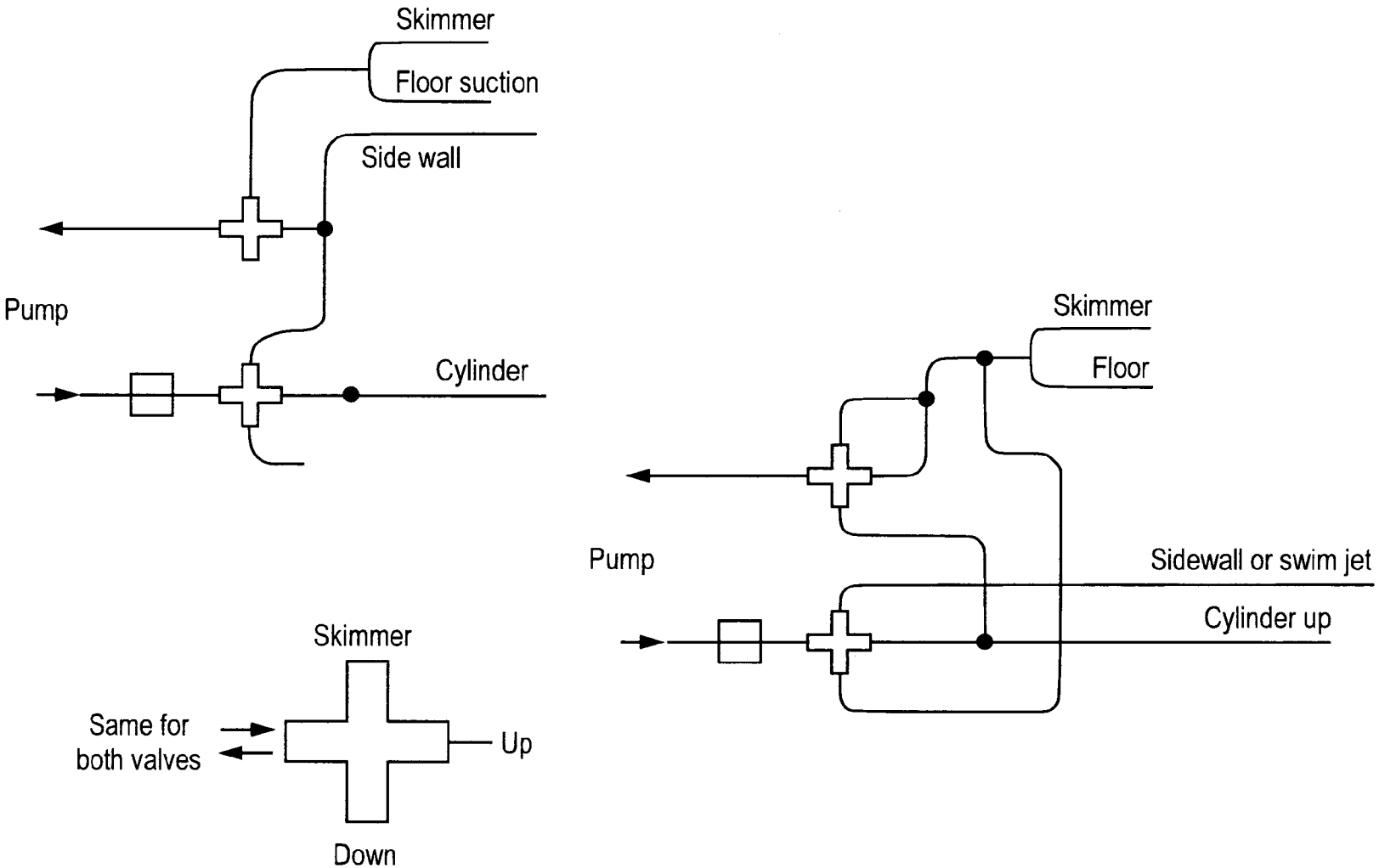
FIG. 20 depicts a flow diagram for a pump used in an embodiment of the invention.

Because of the substantial multiplier provided by an adequately-sized cylinder, a cover may be raised, lowered, and held in position by a comparatively small water pressure. In embodiments of the invention, this pressure is provided by a conventional pool filter pump; however, if needed or desired, the pressure from a conventional garden hose should be sufficient to raise or lower the cover over time. This pump may be, for example, a Hayward® brand pump. The pump may be configured to provide pressure to raise the cover and suction to lower the cover. The same pump (or a different pump) may be configured to operate the pool skimmer as well as any other pressurized pool accoutrements, such as swim jets or massage jets. One diagram of a pump configuration is shown in FIG. 20.

Figure 20A:
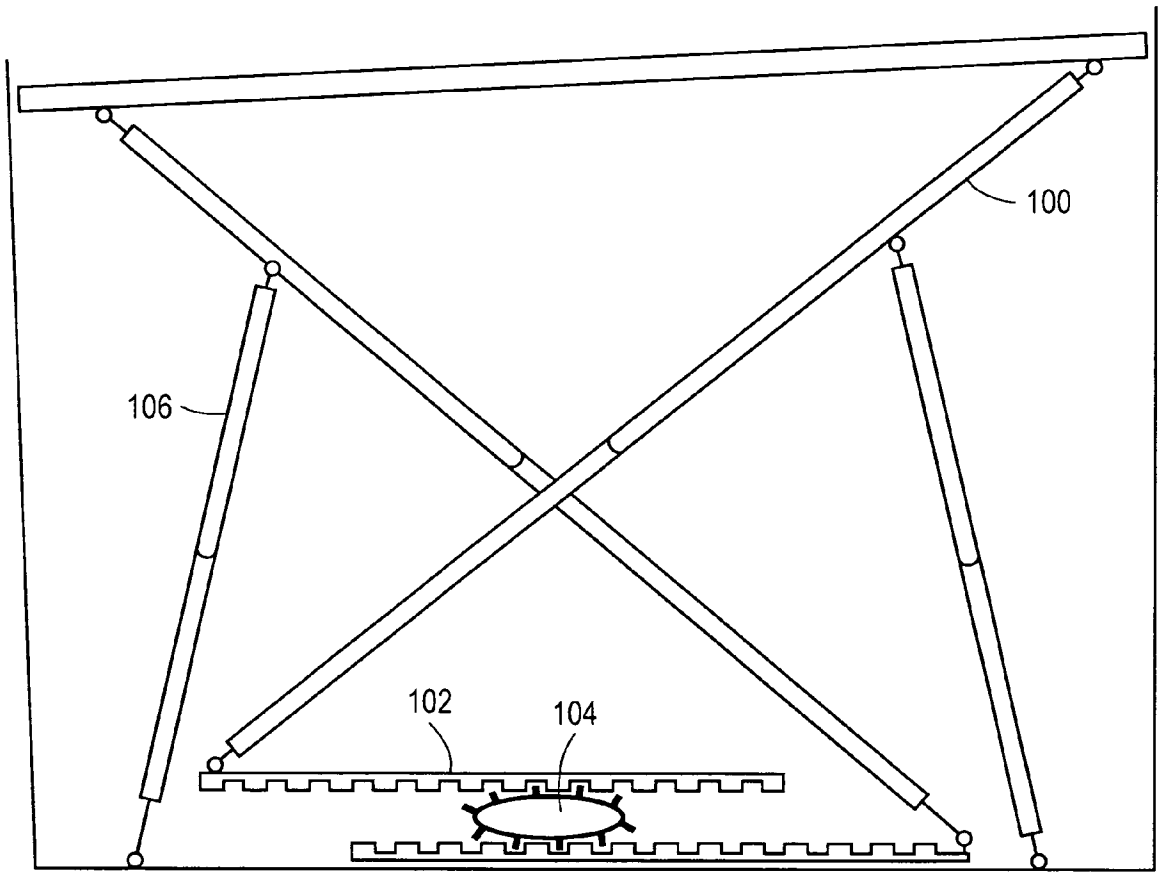
FIG. 20A depicts a scissor lifting mechanism for use in the embodiments of the invention.

In a further embodiment, a scissor lift is the lifting mechanism. In a preferred embodiment, the scissor lift is a hydraulic scissor lift. One example of a hydraulic scissor lift is shown in FIG. 20A. In that example, multiple legs 100 disposed in tracks 102 have movement coordinated by gear 104. The legs 100 are raised by hydraulic cylinders 106, which may then be used to lock the cover in position.

In a further embodiment, an inflatable bladder is the lifting mechanism. This bladder could be filled with liquid or gas from a remote source when the cover is to be raised, and air could either be forcibly evacuated or allowed to exhaust naturally when the cover is to be lowered. Although this embodiment could be used for any size pool, it is best suited for a small pool.

Figure 24:
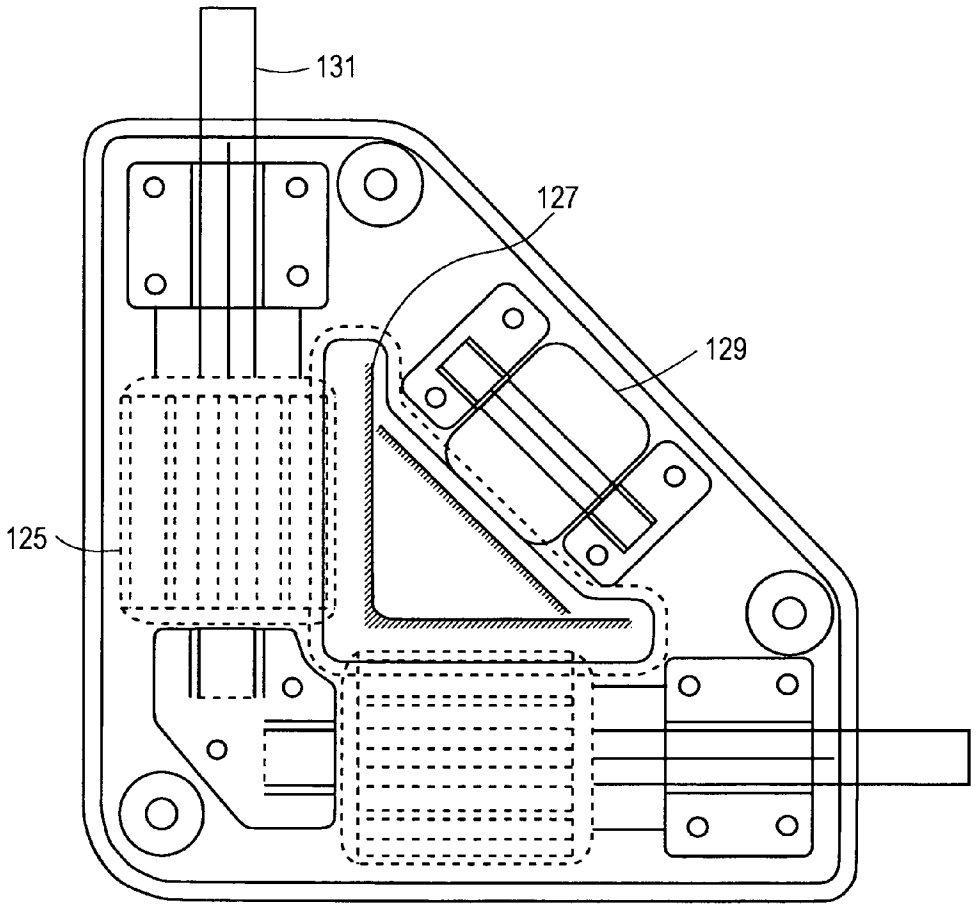
FIG. 24 depicts a cutaway top view of a rack and gear assembly for stabilizing a cover of a pool of the invention.
Figure 24A:
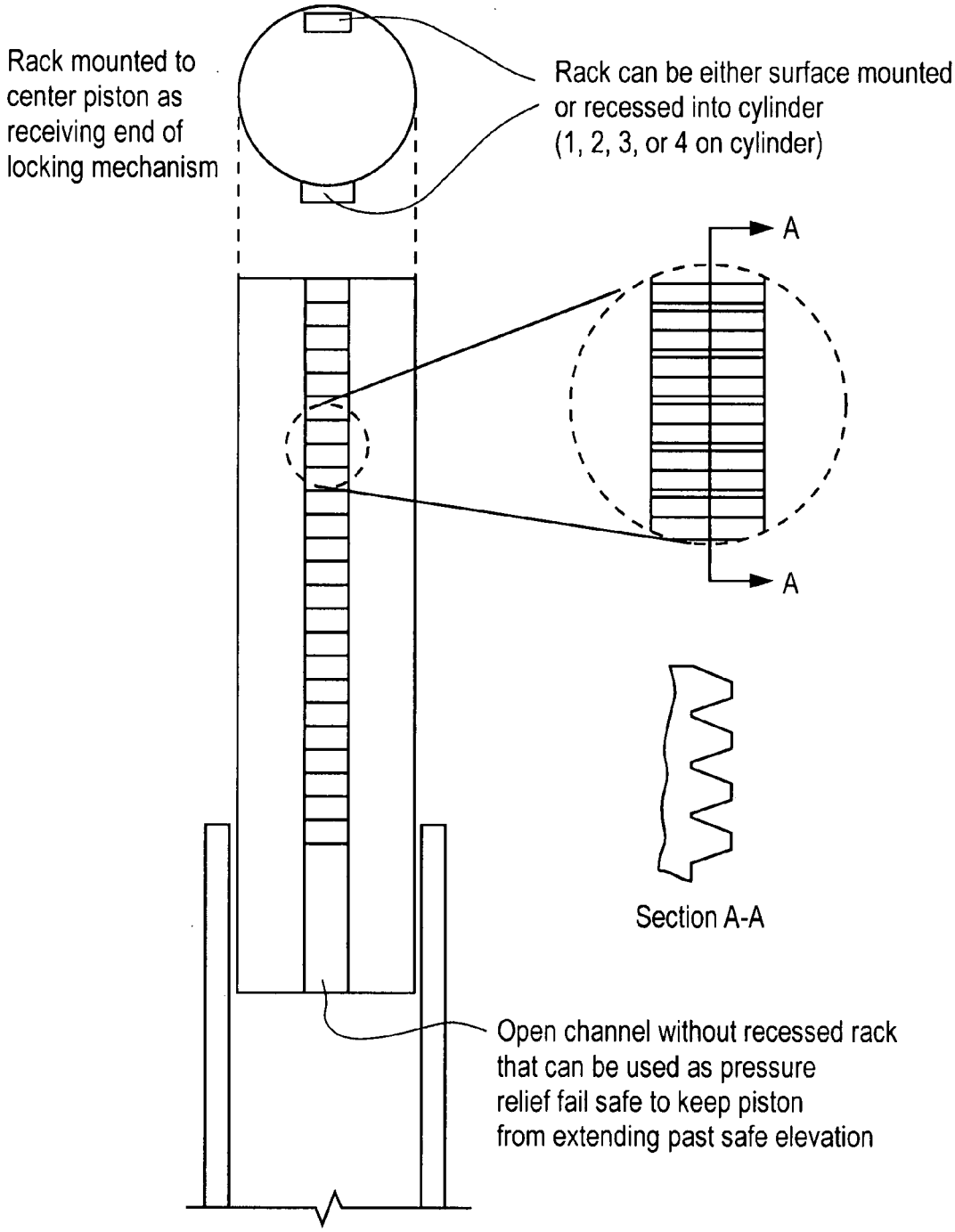
FIG. 24A depicts a side cutaway view of a rack mounted to a center piston as the receiving end of a locking mechanism.
Figure 24B:
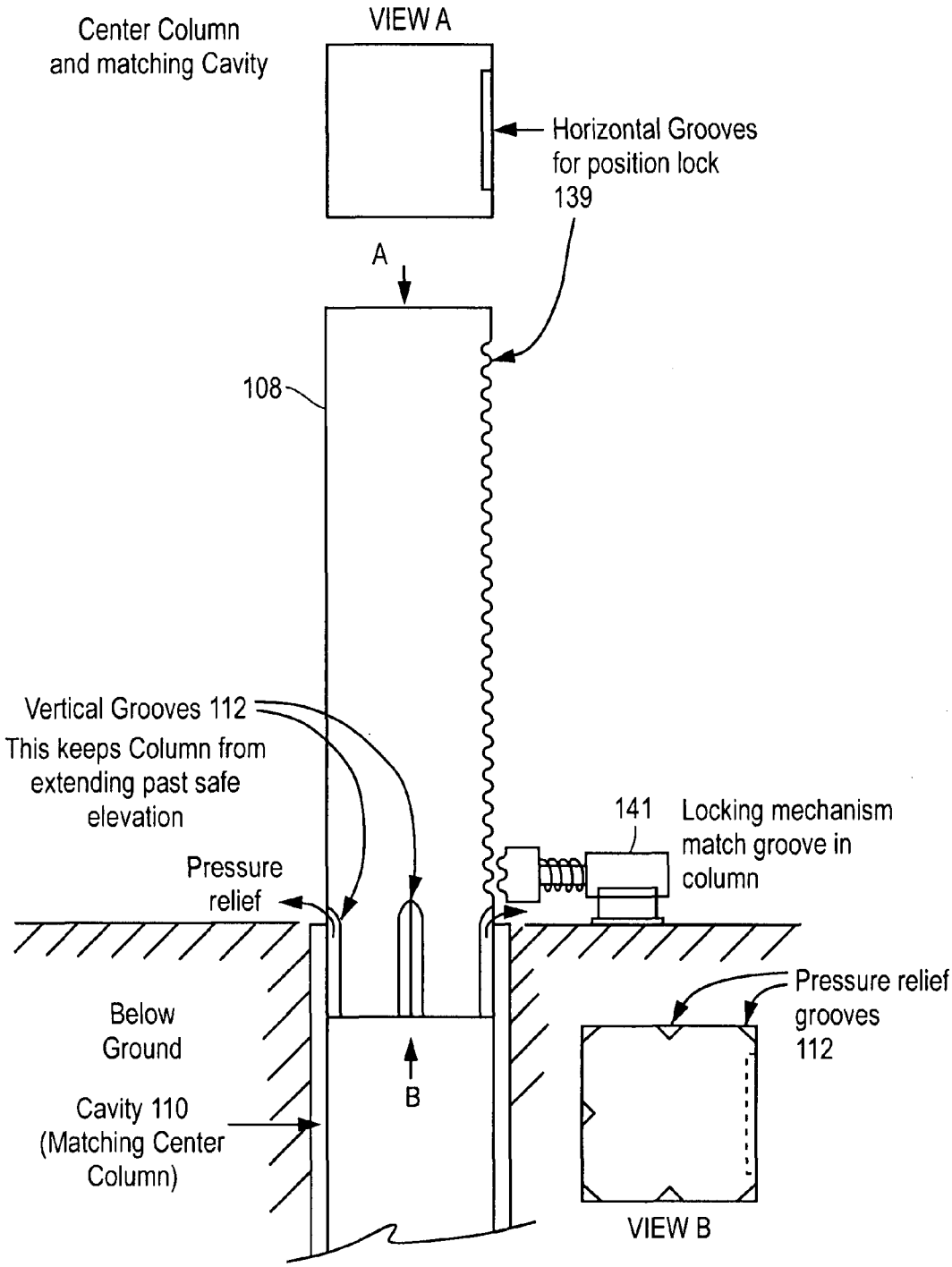
FIG. 24B shows a further embodiment of lifting, locking and failsafe mechanisms.
Figure 24C:
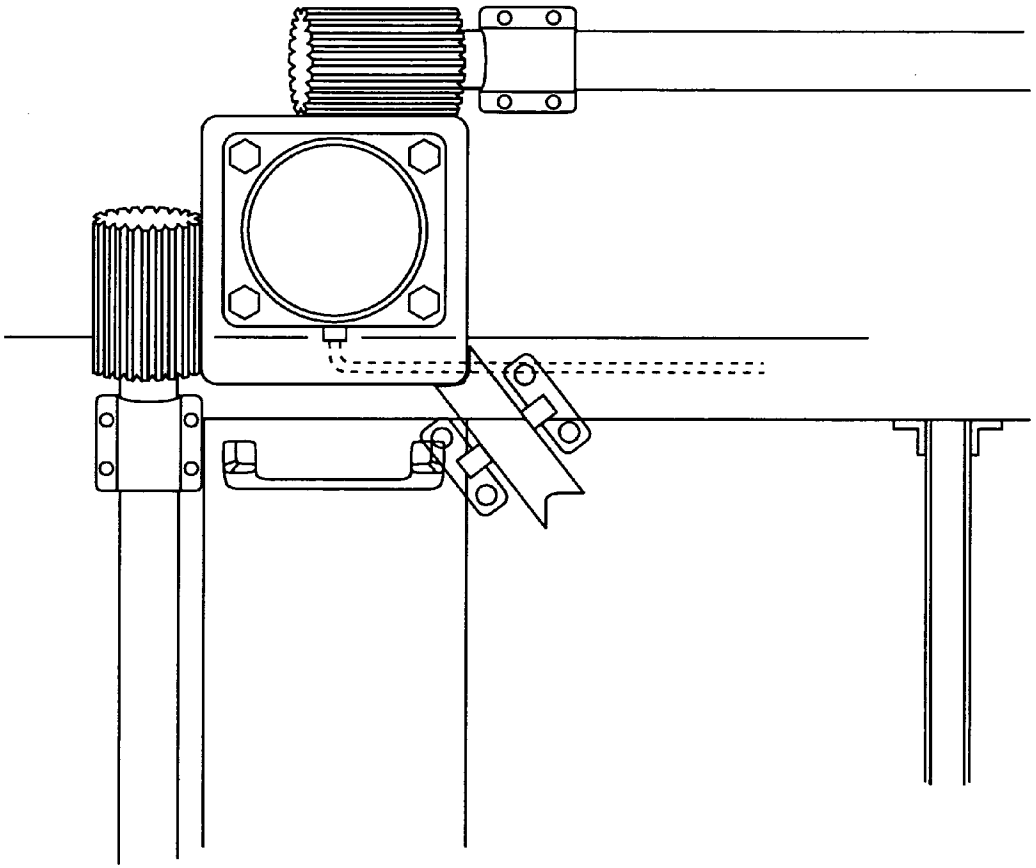
FIG. 24C shows a further embodiment of lifting, locking and failsafe mechanisms.

In a most preferred embodiment, shown in FIGS. 24B and 24C, a different method of applying fluid force is used as the lifting mechanism. In this embodiment, a column 108 is disposed in a receiving cavity 110, where the cavity has a cross-sectional shape corresponding to the shape of the column. This shape may be, for example, a square, triangle, circle, ellipse, rhombus, trapezoid, parallelogram, or any other shape. In a preferred embodiment the shape is a square, which prevents rotation of the cover. Ideally the column is free to travel about the cavity along its length. At or near the bottom of the cavity are disposed one or more water inlets (not shown). By "corresponding" to the shape, it is meant that the shape can be exactly the same, or that the shape of the receiving cavity can vary from the shape of the column by the amount necessary to also take in a stabilizing rack or other mechanism.

As water enters the water inlets, it pushes the column, which in turn pushes the cover. This lifts the cover to a desired height, and a valve may be used to maintain the upward force. As described in Section F, below, further mechanisms (including rack 139 and locking mechanism 141) may be used to stabilize the column and thereby stabilize the cover at the desired height. When the column (and the cover) are to be lowered, the valve and the stabilizing mechanisms are disengaged, the fluid flow is reversed, and the column and the cover retract.

In a preferred embodiment, the column is tapered, or a portion of the column is removed at the end nearest the bottom of the cavity to provide pressure-relief grooves 112. When the column has elevated to the extent that the taper and/or removed portion is exposed, water is able to flow freely about the column, preventing the column from rising further than desired.

F. Mechanism(s) for Stabilizing the Cover

Although no stabilization is required so long as force from the lifting mechanism is maintained, one or more braking devices may be included. These devices may be particularly useful to minimize or prevent slight local variations of the cover height at or near the cover's perimeter. In one embodiment of the invention, a hydraulic brake system is attached to the cover, with multiple brake devices disposed about the perimeter. Preferably, the hydraulic function of the brake system is independent of the hydraulic function of the lifting mechanism. Various possible brake systems for use in embodiments of the invention are shown in FIGS. 21, 22, and 23.

Figure 21:
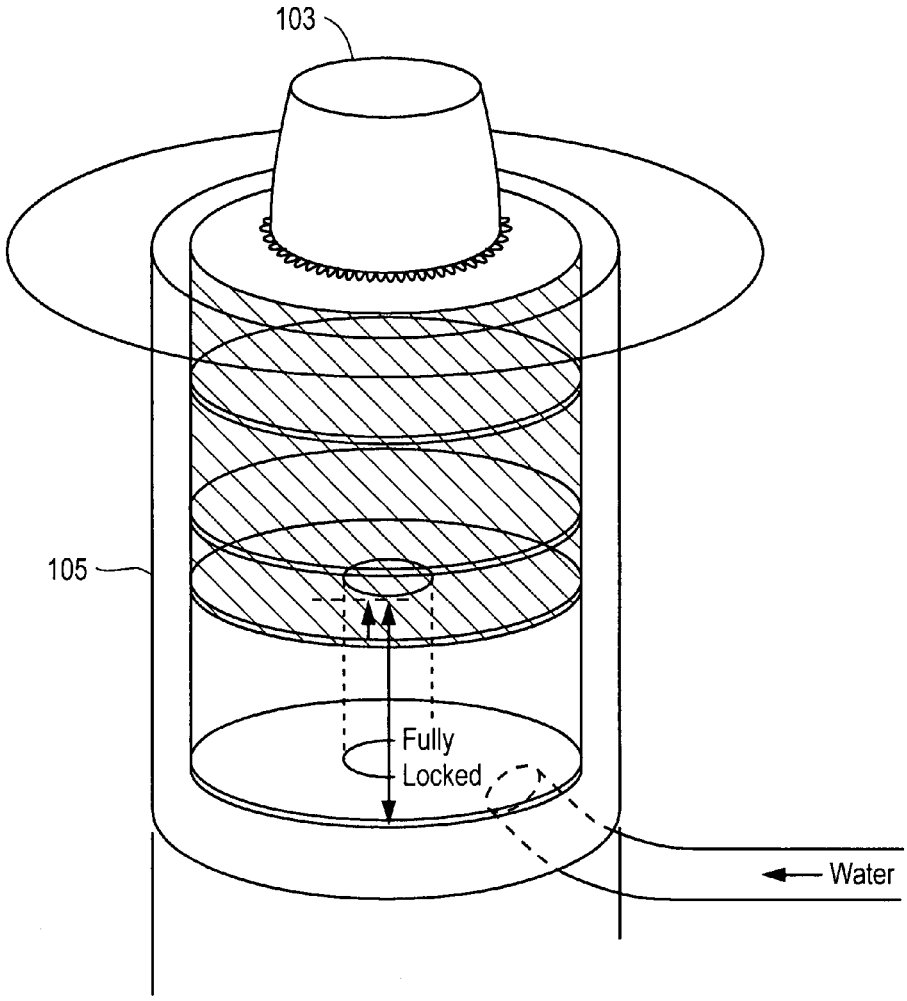
FIG. 21 depicts a pin brake that may be used in an embodiment of the invention.
Figure 21C:
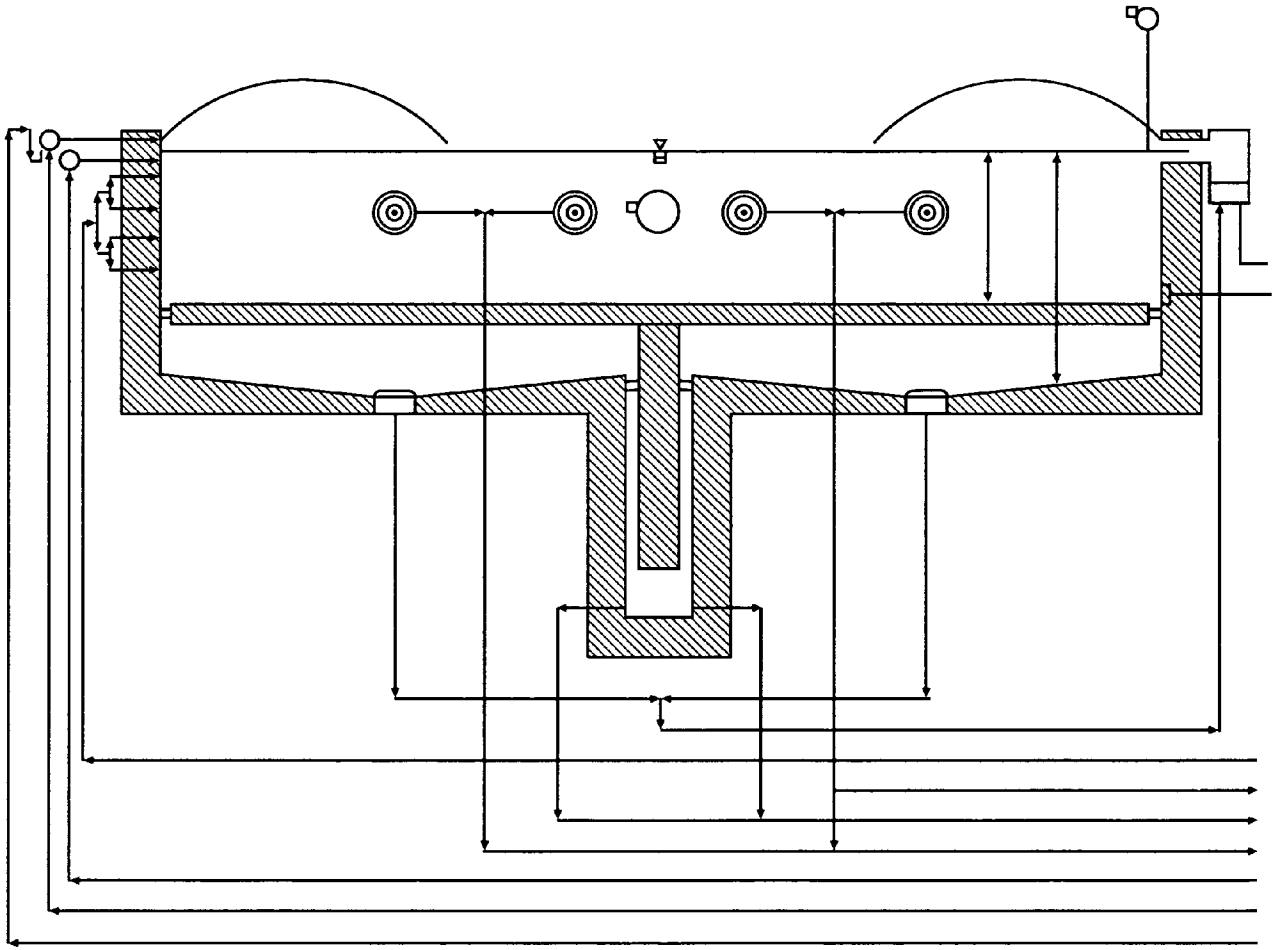
FIGS. 21C and 21D, which join from left to right, depict an operations diagram for a pool of the invention, including filters, pumps, lighting, and exhaust.
Figure 21D:
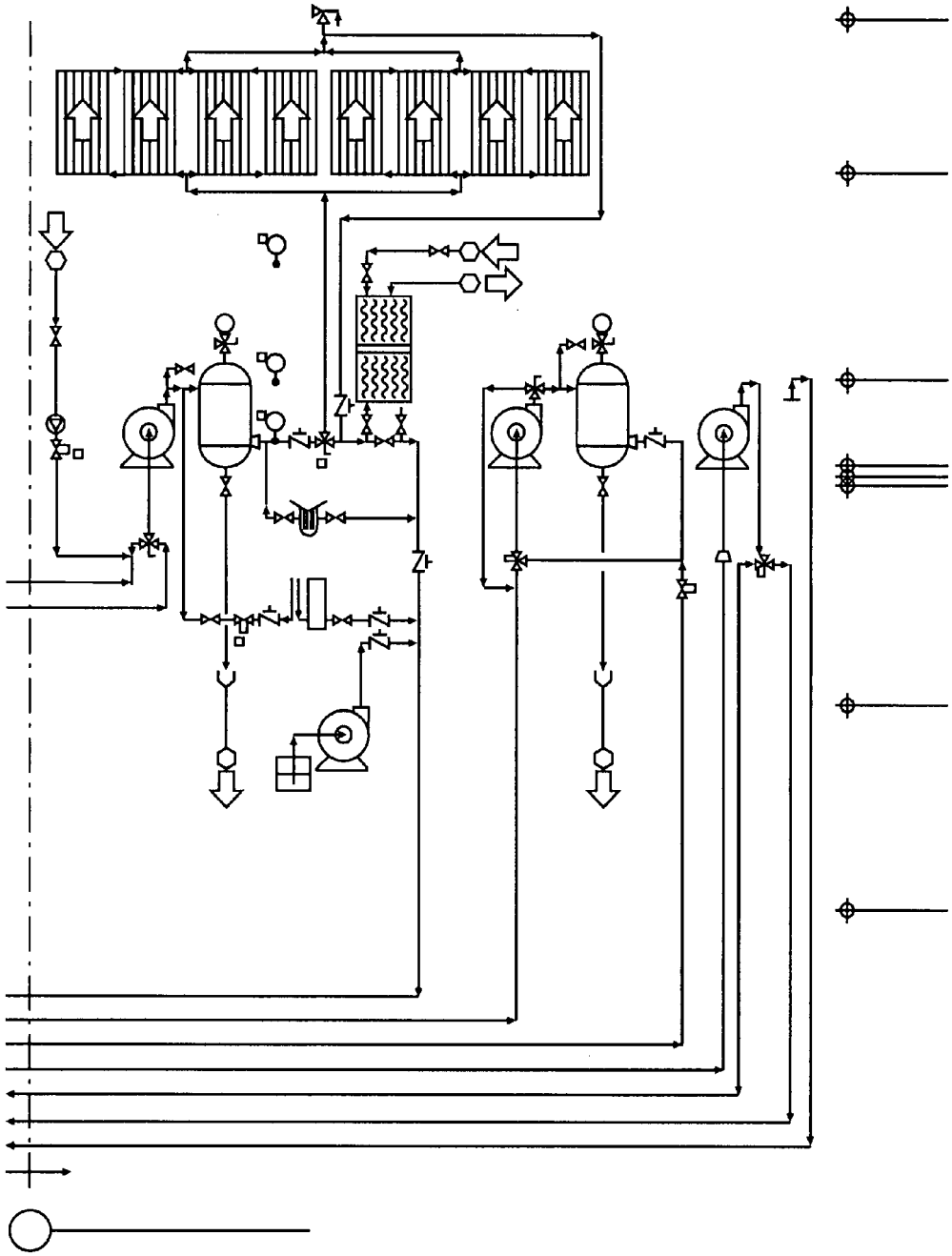

FIG. 21 shows a hydraulic pin that may be used as a braking system for the invention. In FIG. 21 a pin 103 is configured to affix into a matching recess in the sidewall of the pool. The pin may be extended and retracted hydraulically or by mechanical means. In one embodiment, the pin is a stainless steel pin, and the piston 105 is epoxy. The sidewall of the pool may contain multiple recesses at varying heights to accept the pin.

Figure 22:
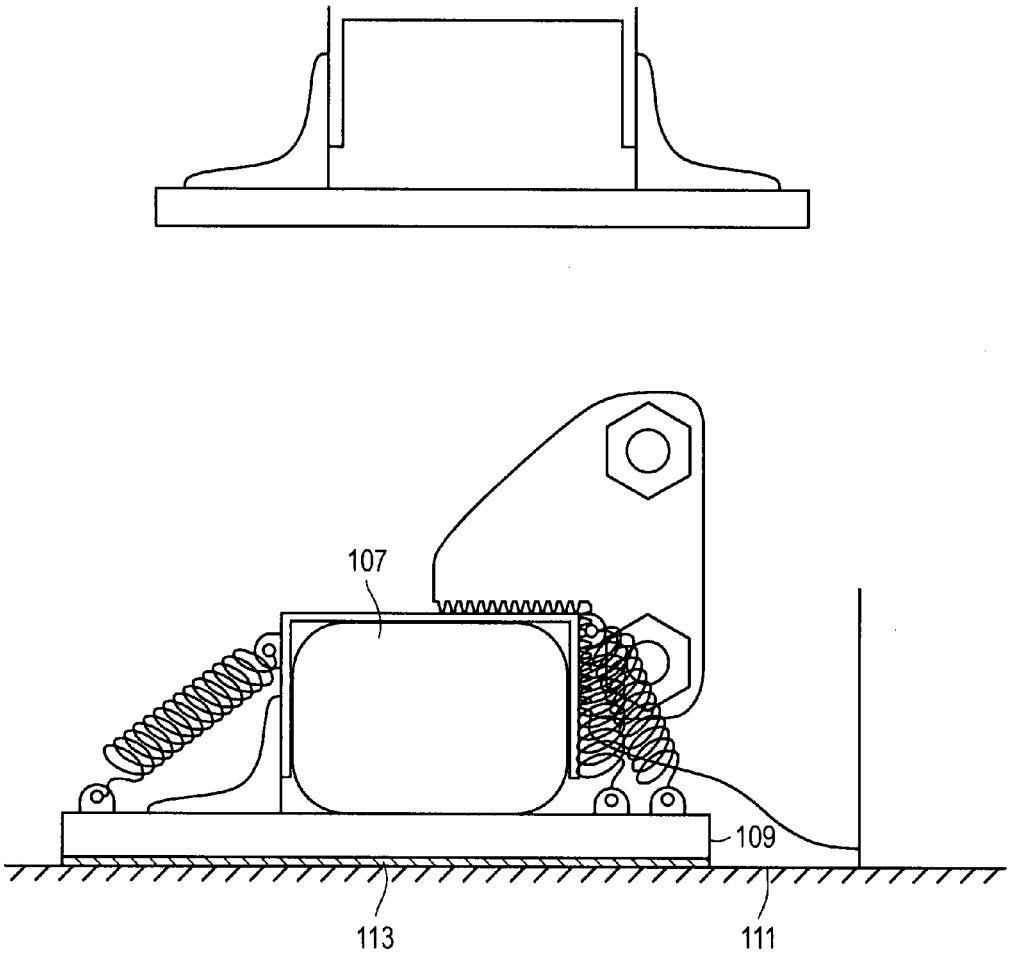
FIG. 22 depicts a bladder brake that may be used in an embodiment of the invention.
Figure 23:
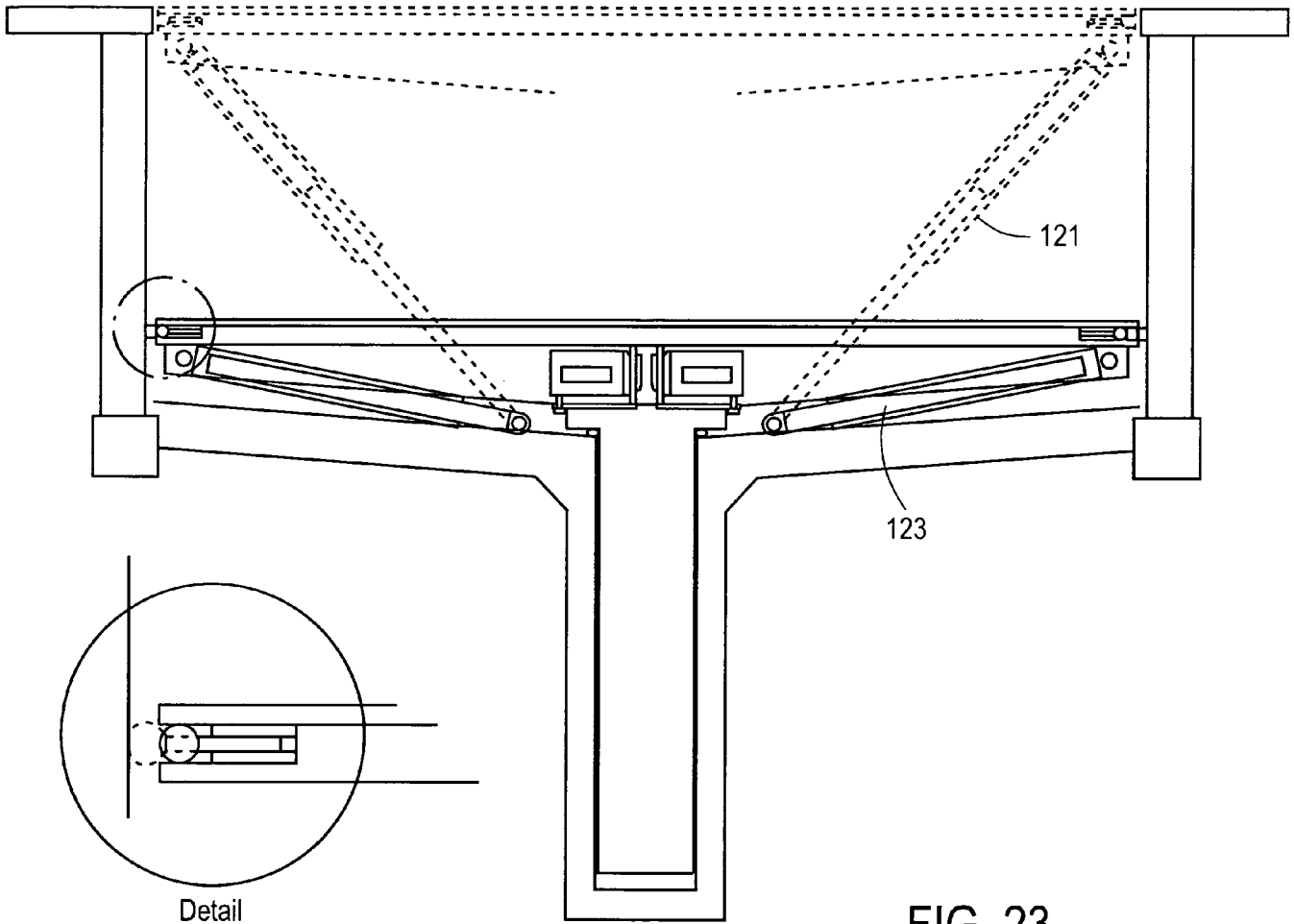
FIG. 23 depicts a side view of a pool of the invention with a single cylinder hydraulic lifting mechanism as well as additional hydraulic supports.
Figure 23A:
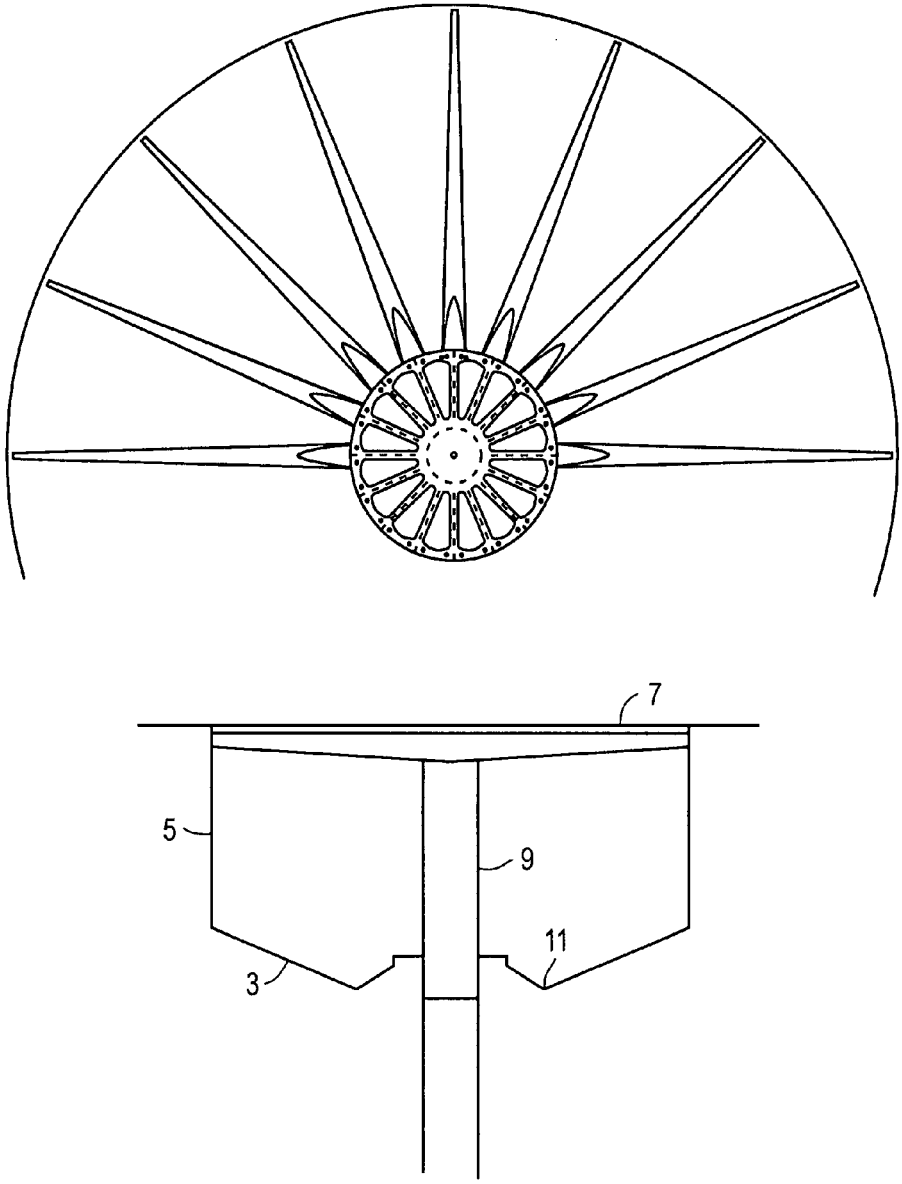
FIG. 23A depicts another side view of a pool of the invention with a single cylindric lifting mechanism. A partial side view of the underside of a platform is also shown.
Figure 23B:
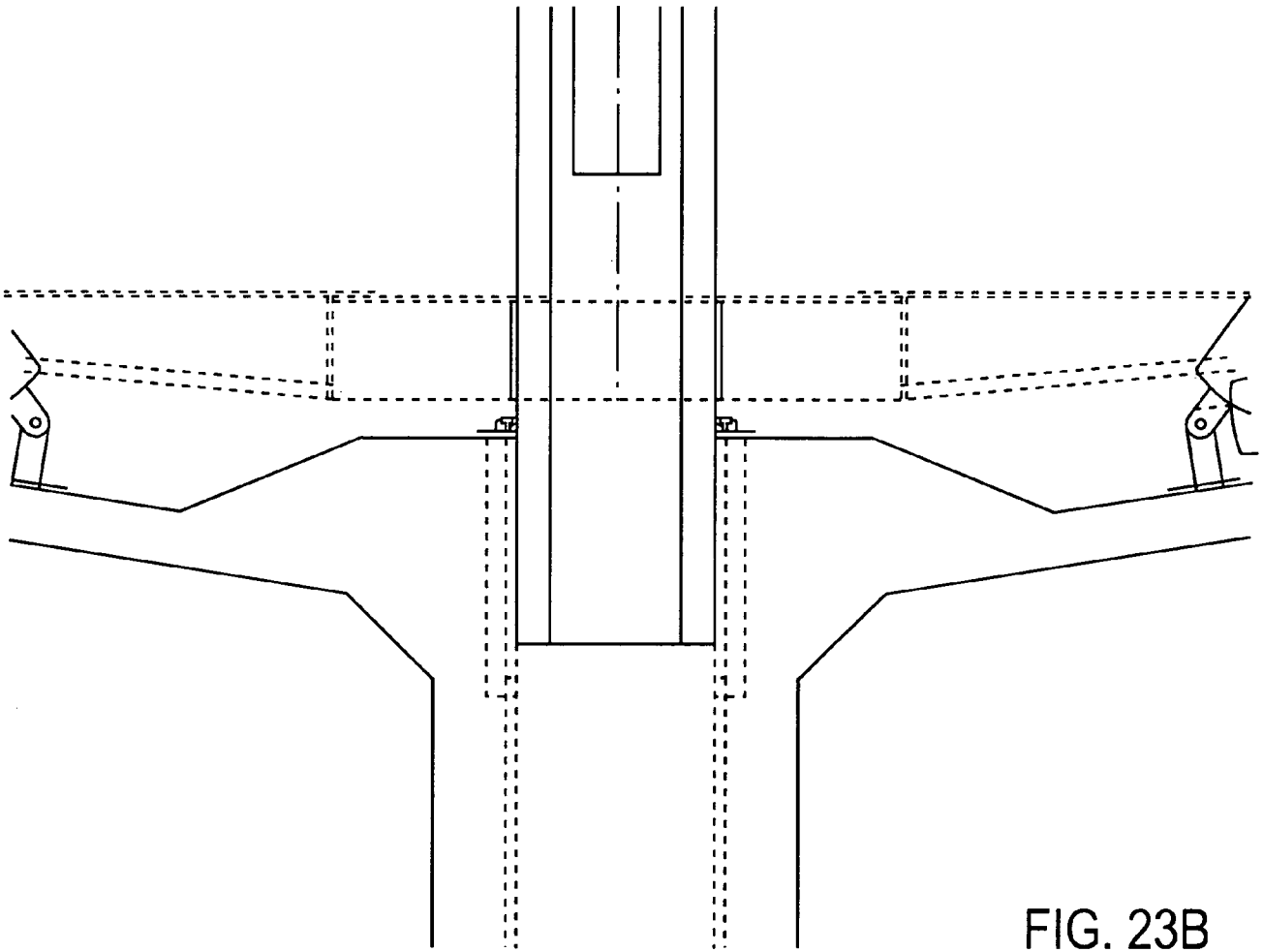
FIG. 23B shows a detail of the central portion of a pool of FIG. 23A.
Figure 23C:
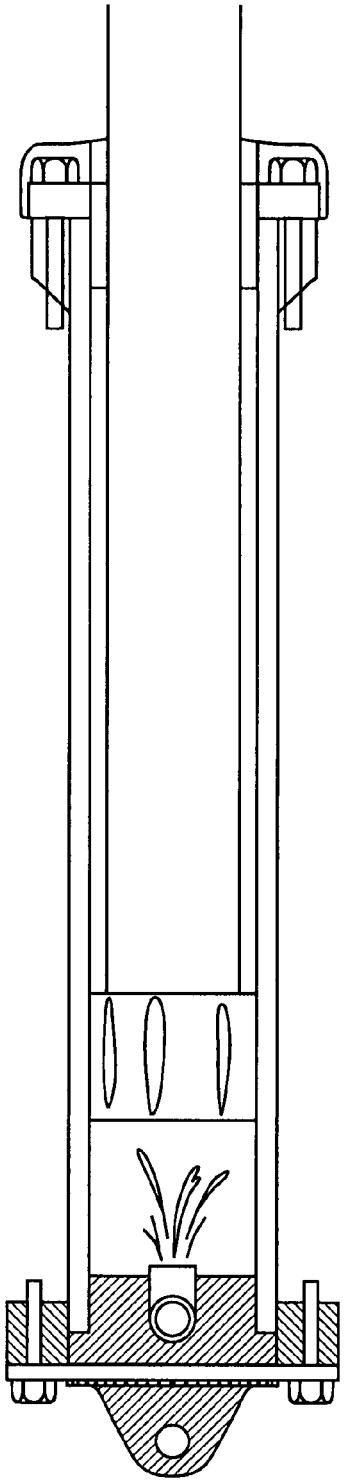
FIGS. 23C, 23D, and 23E show additional views of support cylinders as shown in FIG. 23.
Figure 23D:
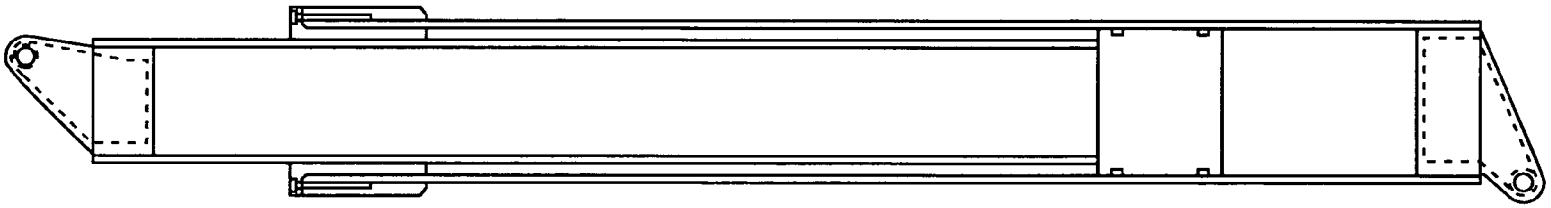
Figure 23E:
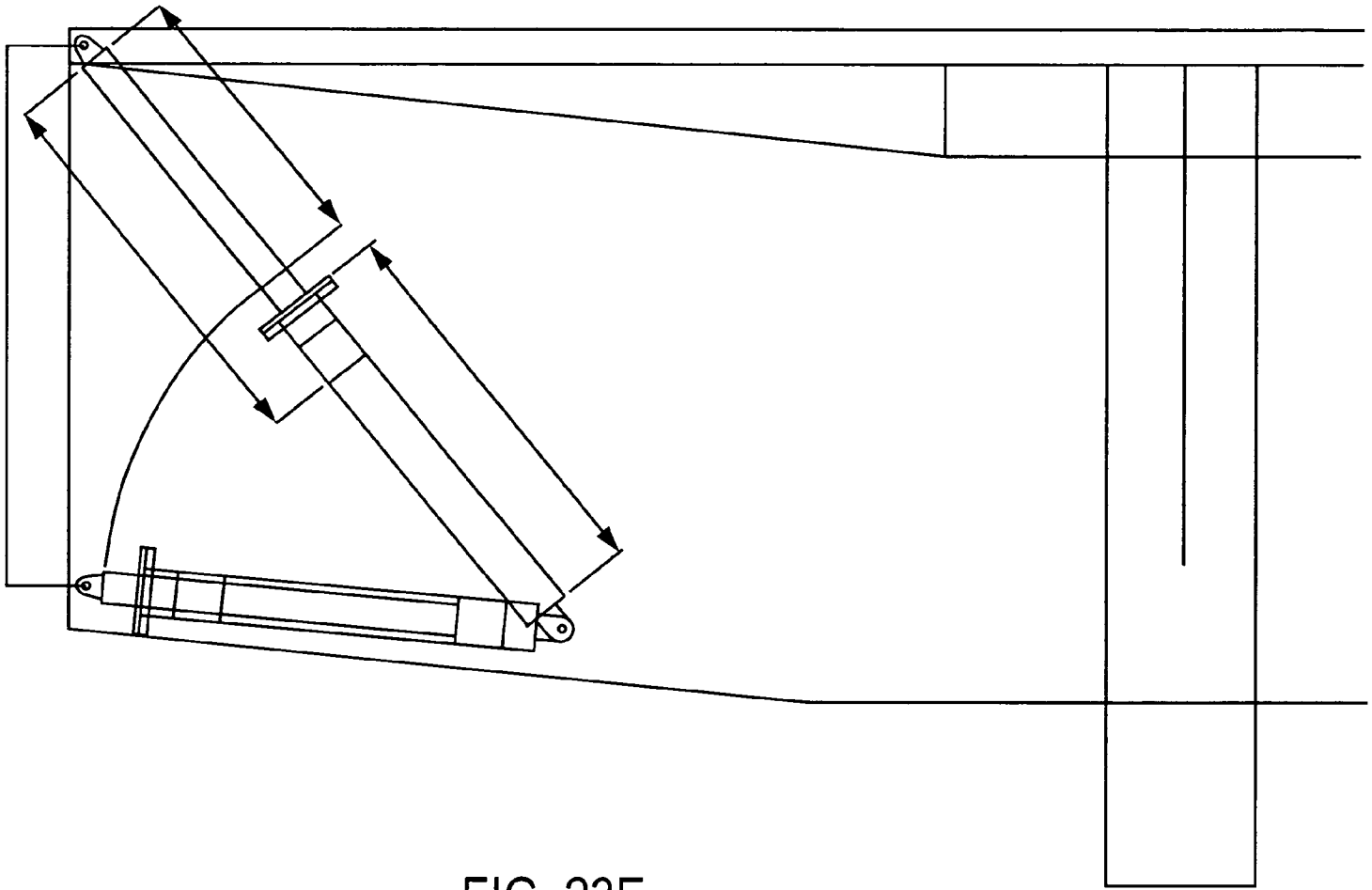

FIG. 22 shows an inflatable brake that may be used in the invention. In the brake of FIG. 22, a bladder 107, preferably of heavy rubber, is filled with water or air. This secures a brake pad to 109 the sidewall 111 by pressure. The brake pad may be, for example, fiberglass. The brake pad may have a coating 113, for example a rubber coating, preferably a rubber coating, at the interface where the brake pad meets the sidewall.

Figure 22A:
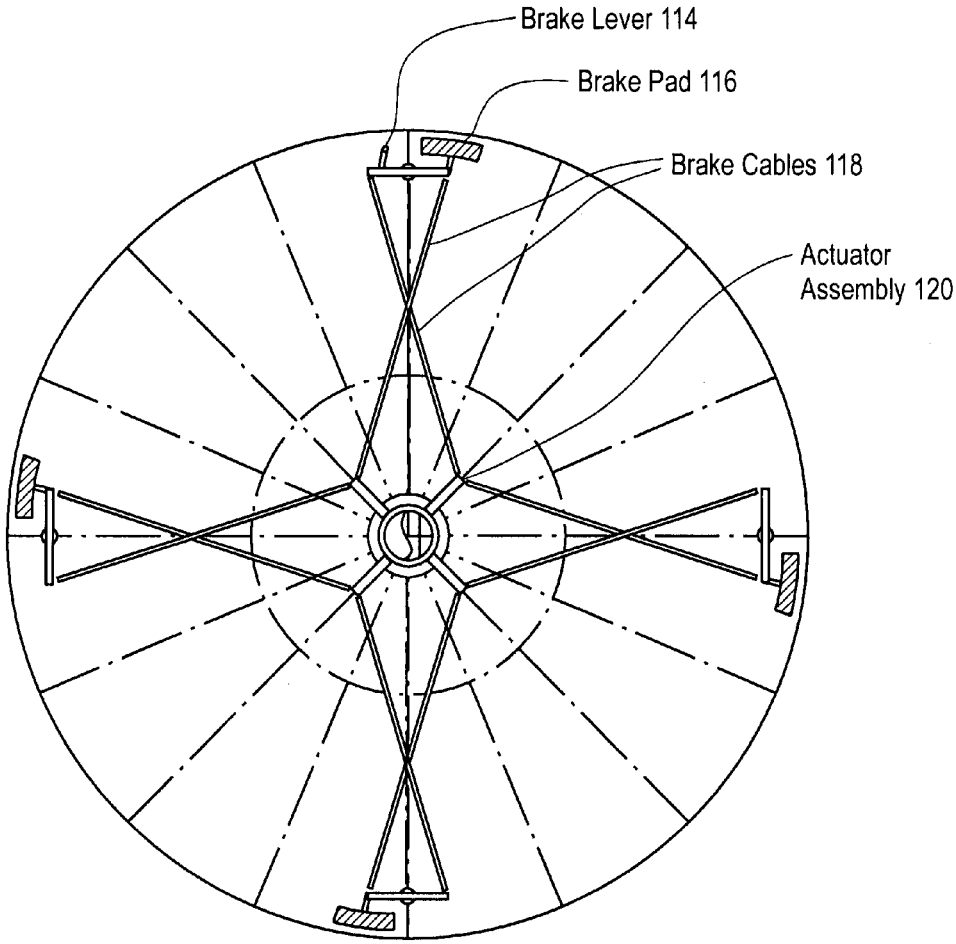
FIG. 22A depicts an actuated braking mechanism.

A further braking mechanism is shown in FIG. 22A, which depicts a brake lever 114, a brake pad 116, brake cables 118, and an actuator assembly 120, all situated beneath and attached to the pool cover. Upon actuation the brake pivots and engages. Although depicted concentrically, the actuator may also be located eccentrically. The actuator may be moved by a water piston.

Figure 22B:
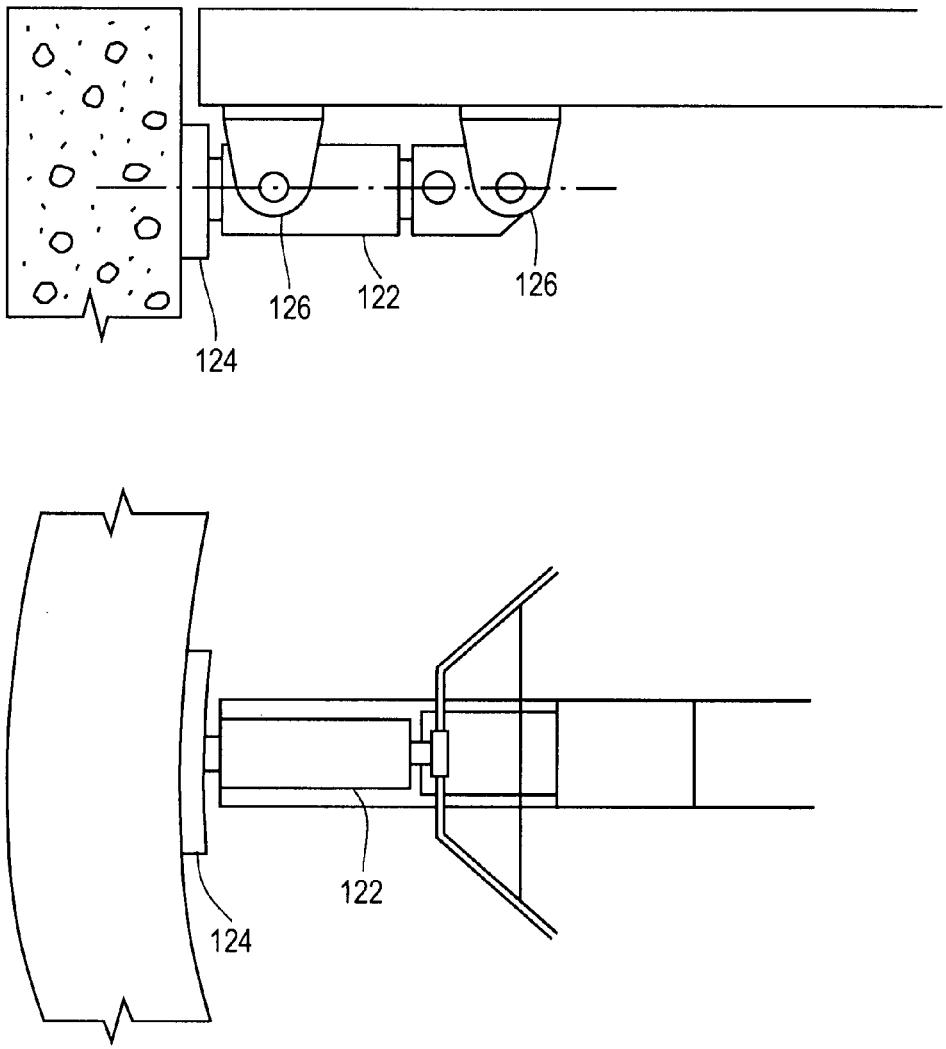
FIG. 22B depicts an exemplary brake mechanism comprising an actuator, a brake pad, and counterweight hangars.

Further braking mechanisms are shown in FIG. 22B. In general, brakes may be located anywhere at the periphery of the cover, preferably uniformly about the cover, and most preferably separated by ninety or one hundred and twenty degrees. Braking mechanisms may include an actuator 122, a brake pad 124, and counterweight hangars 126. Brakes may press against the coping, the pool sides, or against provided pressure plates.

In a further embodiment of the invention, a hydraulic brake may be used. In the these embodiments, a brake pad, which may be coated, may be pressed to the sidewall using hydraulic pressure. Even a cylinder of relatively modest diameter, for example, about 3 inches, may provide high braking force with a minimal amount of pressure. In another embodiment, the brake may be a magnetic brake, which may be actuated and released through an electric current. One might also contemplate one or more of these brake devices working in tandem, or with one as a primary braking device and another as a backup mechanism.

In a further embodiment of the invention, the braking devices as described above may be supplemented or replaced by additional hydraulic supports. Additional hydraulic supports are shown, for example, in FIG. 23. Preferably these additional hydraulic supports use water to provide hydraulic pressure. The additional hydraulic supports may have the same or different pumping mechanism as the lifting mechanism. The additional hydraulic supports may be attached to the cover and to the bottom of the pool with hinges or in any other manner that allows them to be deployed when the cover is raised. FIG. 23 shows a side view of additional hydraulic supports in a deployed 121 and undeployed 123 state. FIG. 1 shows additional hydraulic supports in a deployed state. FIG. 1 also shows an optional elevating table. Although any number of additional supports may be used, preferably a plurality of additional supports may be disposed about the circumference of the bottom of the pool. These additional hydraulic supports use the efficient hydraulic power to stabilize the cover.

In a further embodiment of the invention, a pool is stabilized by at least four rack and gear assemblies as shown in FIG. 24. FIG. 24 includes two gears 125. The gears may be constructed from any material that is desired, including but not limited to stainless steel, aluminum, and cast polyurethane. It was found that polyurethane is preferred. Although applicant does not wish to be bound by theory, it is believed that the use of a polyurethane gear allows more complete contact of the gear with the rack 127. The rack 127 is cast into a leg that is placed in a corner of the pool. A wheel 129 maintains pressure between the rack and the gears. Each gear is attached to a rod 131. The rod may be, for example, a stainless steel rod. An apparatus such as that shown in FIG. 24 is attached to each end of the rod, forming a rectangular frame. Each rod is preferably secured by a plate 133. The cover of the pool rests on and/or is secured to the rack and gear assemblies. When the cover is raised, the gears on each rack and gear assembly turn in unison. This allows a cover of substantial size to be raised without height variation on the sides. Locking one gear will prevent movement of all of the gears, further stabilizing the cover.

A cylinder locking, stabilizing, and failsafe mechanism is shown in FIG. 24A, which depicts a side cutaway view of a rack mounted to a center piston as the receiving end of a locking mechanism. The rack may be either surface mounted or molded into a cylinder. The bottom portion may have an open channel without the recessed rack, which may be used as a pressure relief failsafe to keep the piston from extending past a desired elevation. A further embodiment of a locking and failsafe mechanism is shown in FIG. 24B. This includes a locking mechanism with a failsafe position that may be hydraulically or spring actuated.

There may also be pressure-release openings that prevent the piston from extending above a safe elevation; these pressure-release openings eliminate the water used to provide lift pressure after the cover has achieved a predetermined height, thereby preventing the center cylinder from lifting too far out of the water. In a further embodiment, the openings are disposed along the long axis of the lift column of the pool, with a cross-sectional area at least as great as the cross-sectional area of the flow inlet. In a still further embodiment, the opening for the column is also configured to hold the rack, and the rack does not extend the entire length of the column. In this way, after the column has elevated to a desired height, the absence of the rack allows water to flow through the rack opening, preventing further lift of the column.

It was surprisingly discovered that use of stabilizing mechanisms as shown in FIGS. 24A and 24B had the beneficial effect of eliminating the need for a seal at the base of the lift cylinder. So long as sufficient hydraulic pressure is maintained to provide the initial lift of the cover, any detrimental effect of a leak related to depression of the cover over time is avoided by engaging the locking rack mechanism. No detrimental effect arises from water leakage, because water used in the lift cylinder can safely flow into the pool. This is a decided advantage over any prior mechanism, because the costly and inconvenient replacement of a seal is eliminated.

The no-seal configuration of FIGS. 24A and 24B is further advantageous because it allows the cover to be stabilized with the use of only a single hole, since no additional hole for other stabilizing cylinders is necessary. Furthermore, rotations of the gear used to secure the cylinder may be measured and used to accurately determine the height of the cover. Finally, this configuration prevents rotation of the cover.

In a further embodiment, a cover may be secured by magnetic locks, either alone or as an additional securing mechanism with another lock.

Figure 24D:
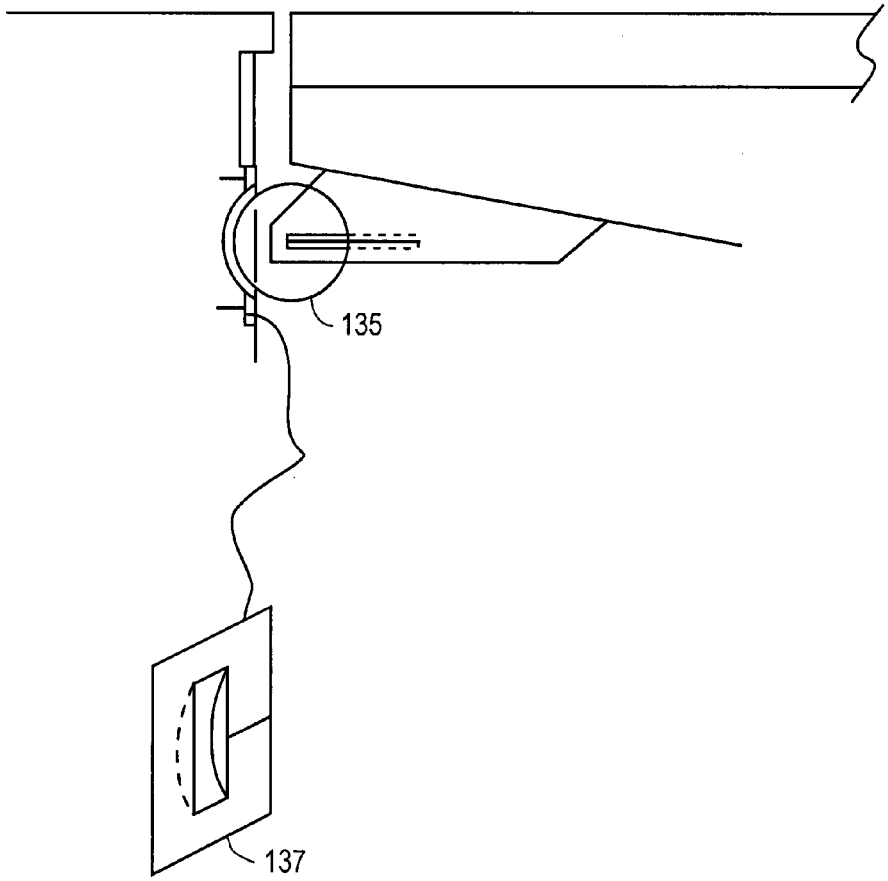
FIGS. 24D, 24E, 24F, and 24G shows an additional stabilizer.

FIG. 24D shows an additional stabilizer. It includes a stabilizing wheel 135 with a spring-loaded compressor that presses the wheel into a detent 137 formed at a desirable pool depth.

Figure 24E:
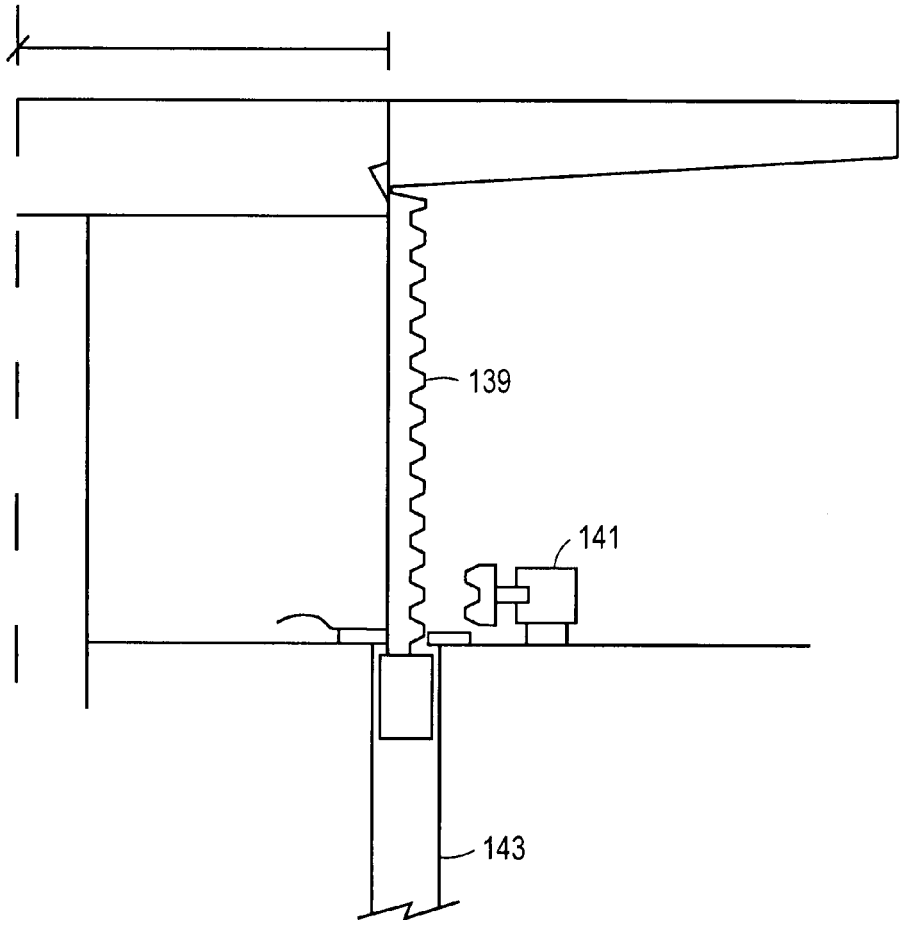
Figure 24F:
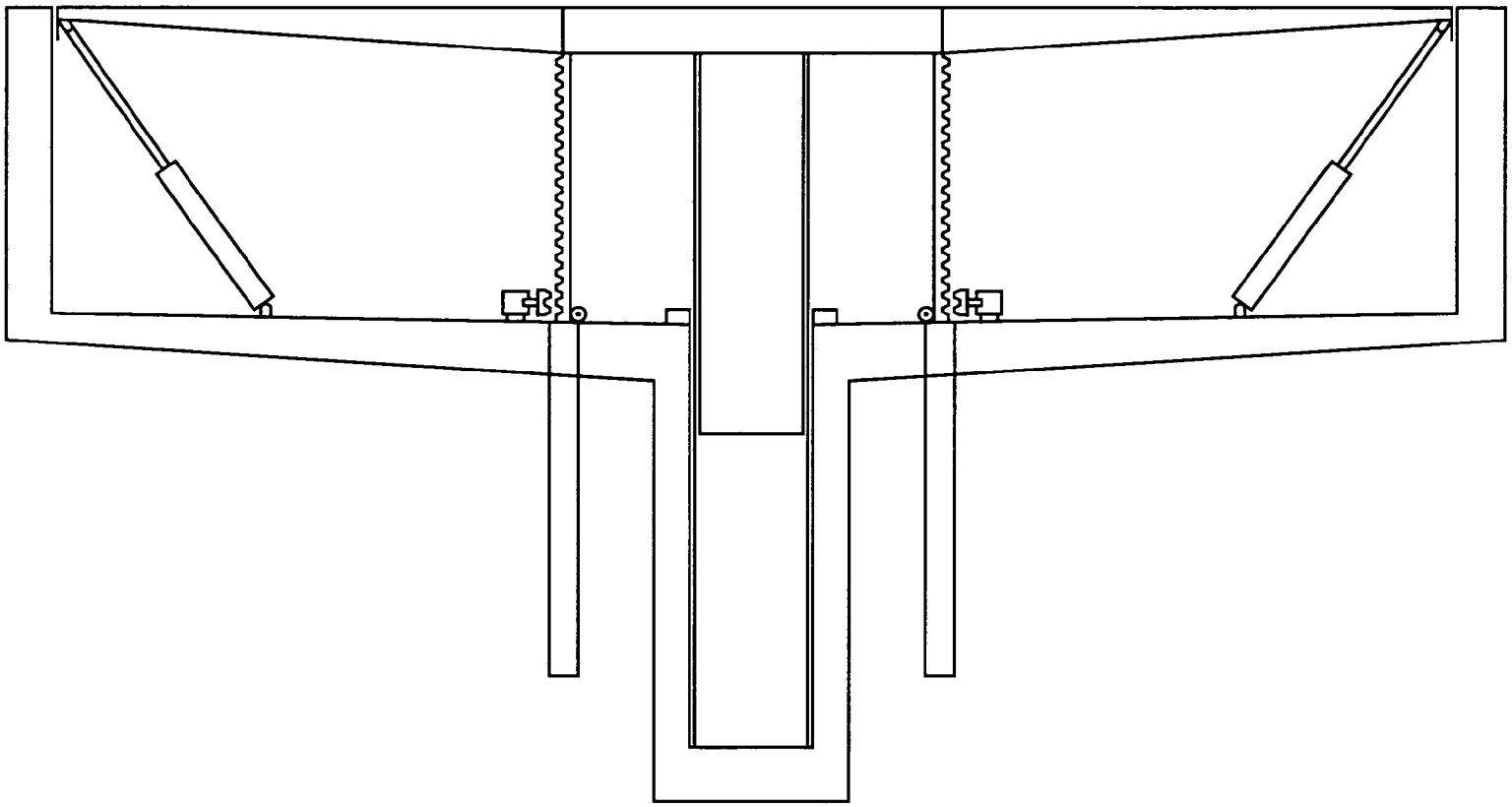
Figure 24G:
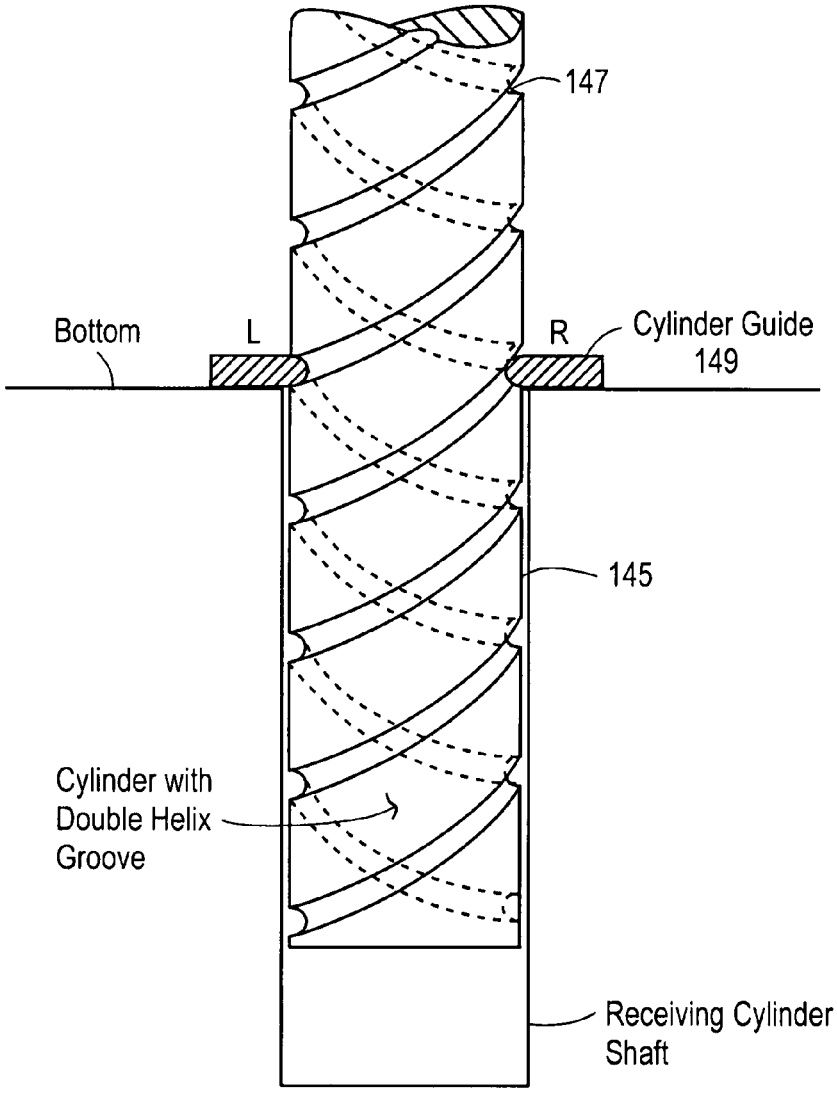

FIG. 24E shows an additional locking and support mechanism. Rack 139 is engaged by locking mechanism 141 at the bottom of the pool. The rack (of which there may be a plurality in the pool) may be connected to the cover and may recess into a receiving cylinder 143 as the cover lowers. A view of the locking and support mechanism of 24E is shown in the context of a pool in FIG. 24F FIG. 24G shows an additional support mechanism. A cylinder 145 is provided with at least one groove 147, preferably a double helix groove, directs the cylinder through at least one cylinder guide 149.

It should be understood that these support mechanisms described herein are generally secondary and supplemental to the support provided by the lifting cylinder, though they may be the primary or only support as desired or necessary.

G. Safety Devices

Although they are not required in all embodiments of the invention, one or more safety devices may be included in pools of the invention. Some of the safety features that may be incorporated include providing the periphery of the cover with a pressure sensitive gasket. This gasket will slow or stop the cover when it is in the midst of raising or lowering if the cover is being raised or lowered. A security device may be included that requires a key, a code, or a combination of a key and a code prior to raising or lowering the cover. A sensor may be provided to detect movement of the water. If there is water movement and/or displacement, then the cover can be prevented from raising and lowering. This sensor may be, for example, an infrared sensor.

Other safety features may include an emergency bypass valve that allows a hydraulic lifting mechanism to be raised using an alternate source of water pressure (such as a hose) to raise the cover in case of pump failure. Controls for the cover may be configured to automatically raise the cover to the highest position at a certain time, or after a predefined period of non-use; for example, after non-use periods of one minute, five minutes, 10 minutes, 20 minutes, 60 minutes, or intervals thereof. An alarm may be configured to sound when the cover is about to raise and while the cover is raising.

Another safety feature may be a stand placed between the bottom of the pool and the cover. This stand may be affixed to the cover after it has descended to a certain level, so that a person maintaining the pool under the cover is assured that the cover will remain in place.

The safety features of the pool may be designed so that they may be overridden by the user if desired. This may be the case if, for example, a person in a wheelchair is to use the pool as a therapy pool. The wheelchair-bound person moves onto the cover when it is at its highest elevation, the prohibition against moving the cover while pressure is on the cover is overridden, and the person on the wheelchair is lowered into the water.

H. Additional Features

Figure 25:
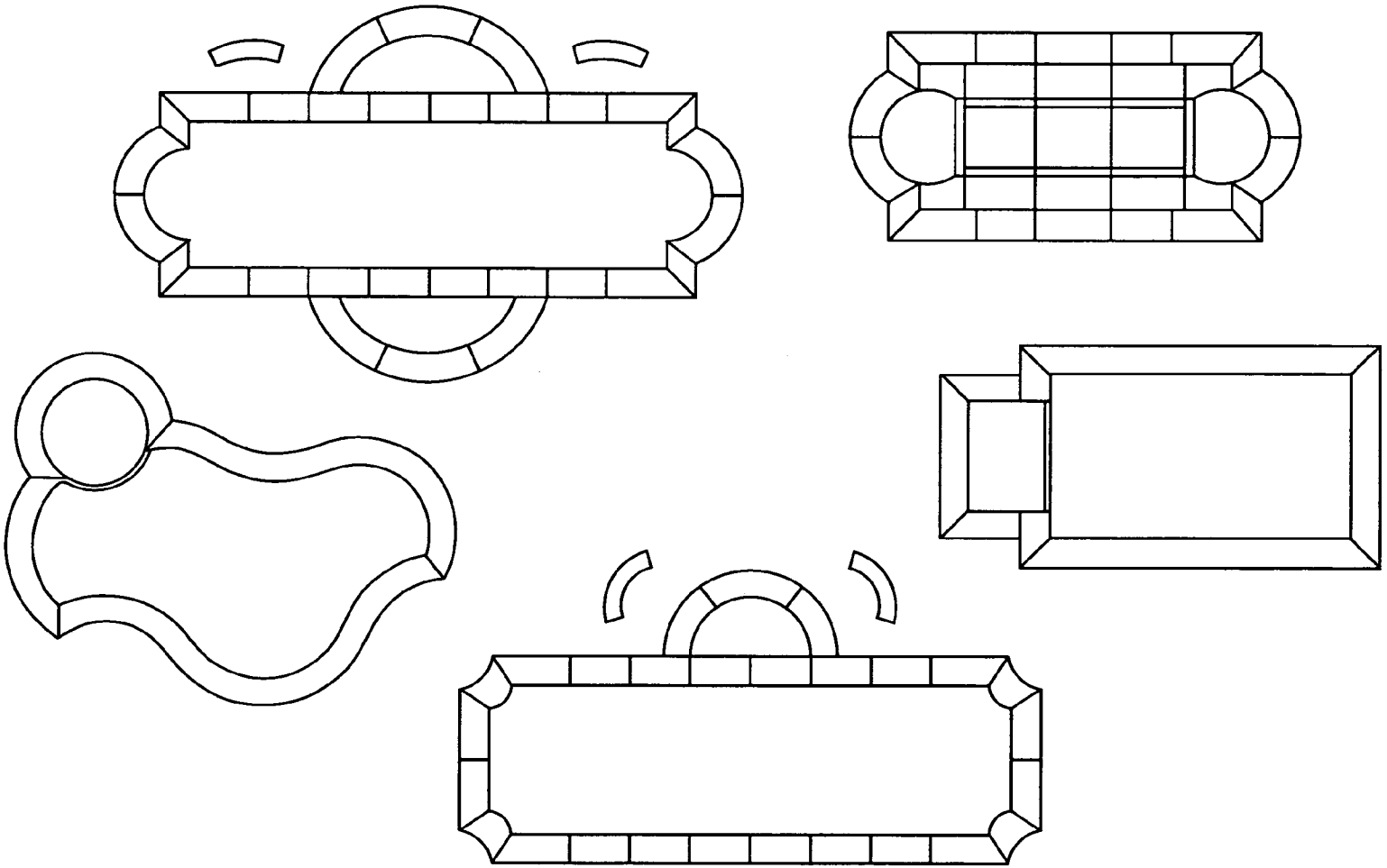
FIG. 25 shows pools of the invention in various shapes.
Figure 26:
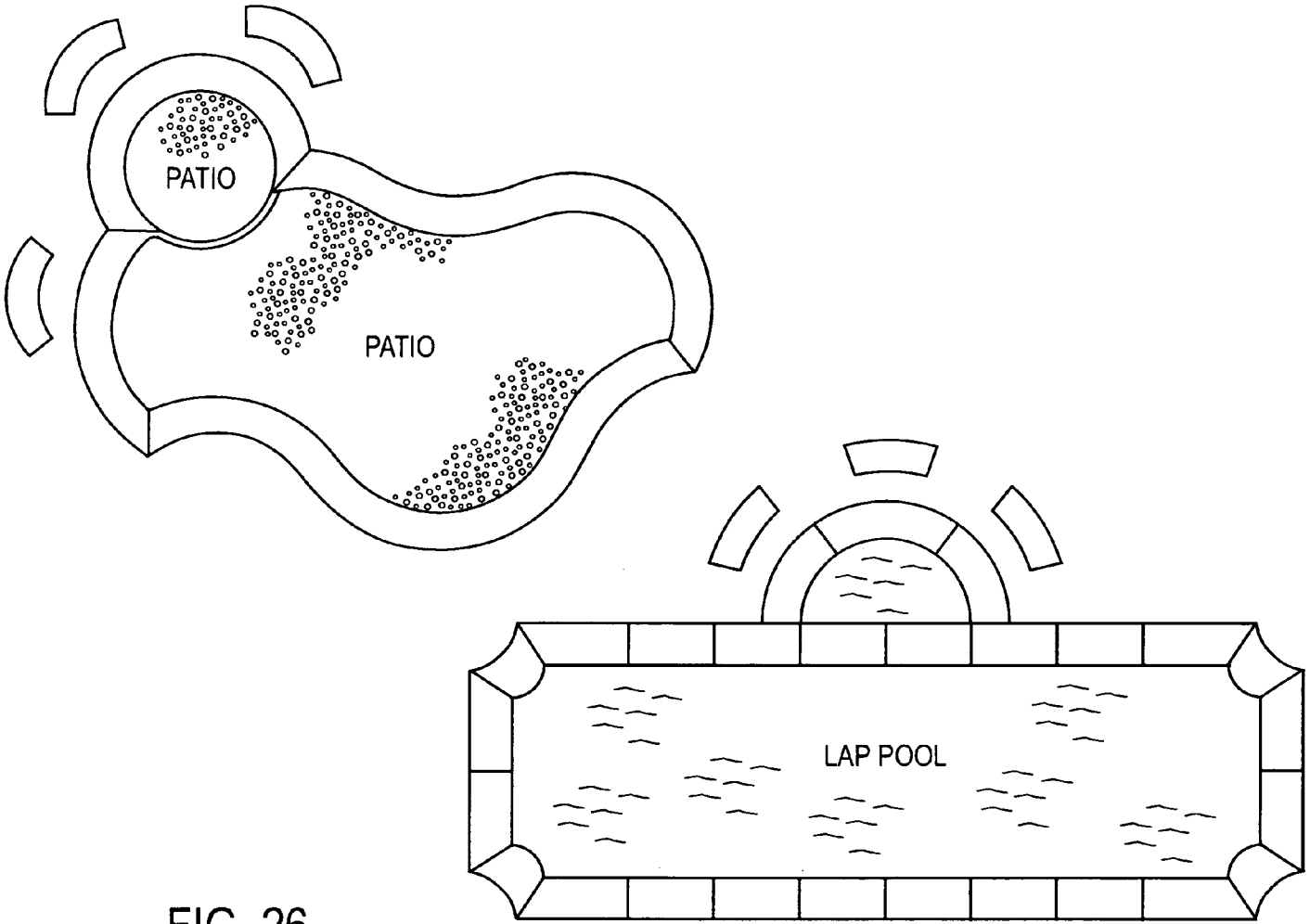
FIG. 26 shows pools of the invention in tandem with conventional pools.
Figure 27:
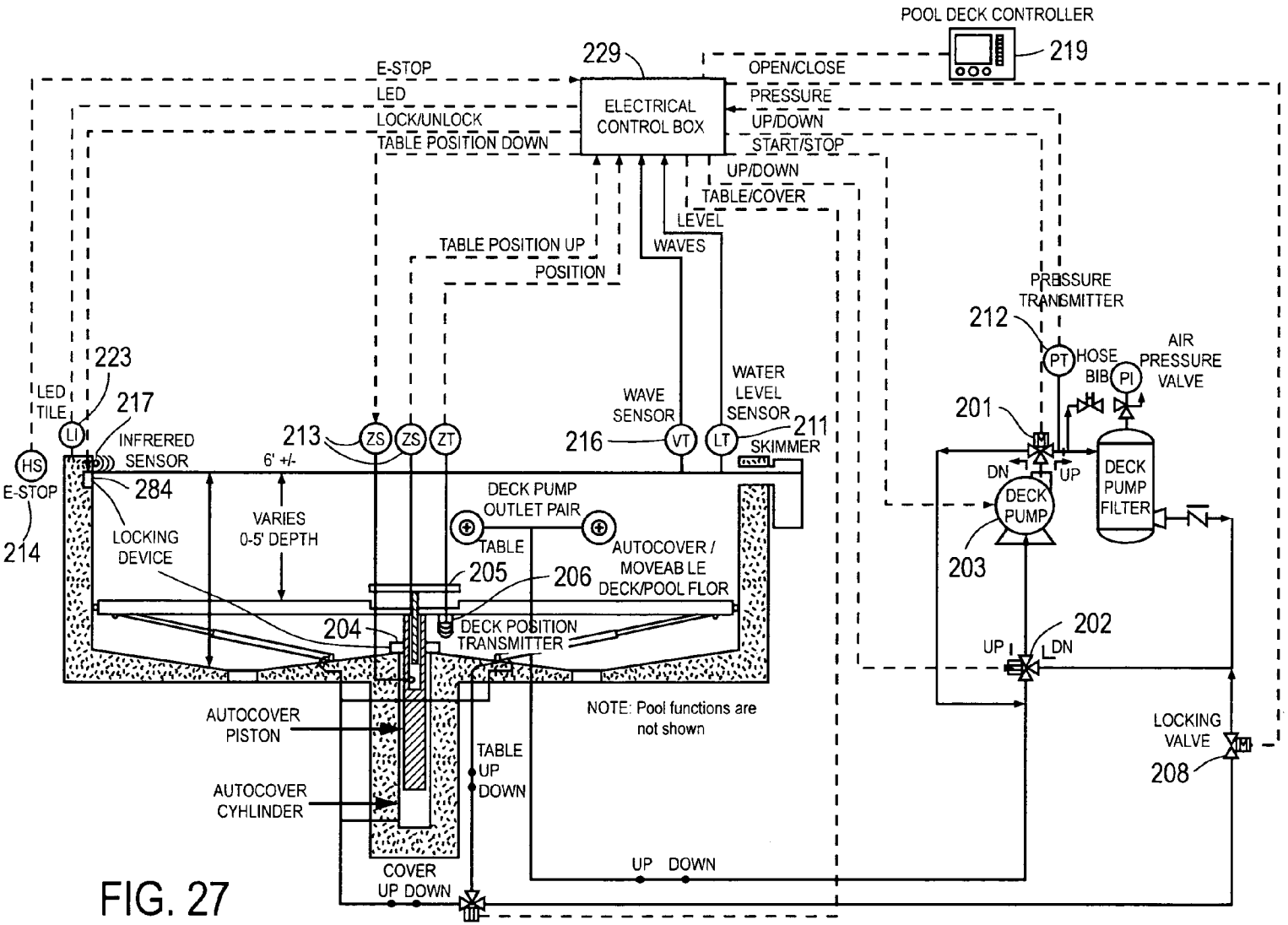
FIG. 27 shows a typical control diagram.
Figure 28:
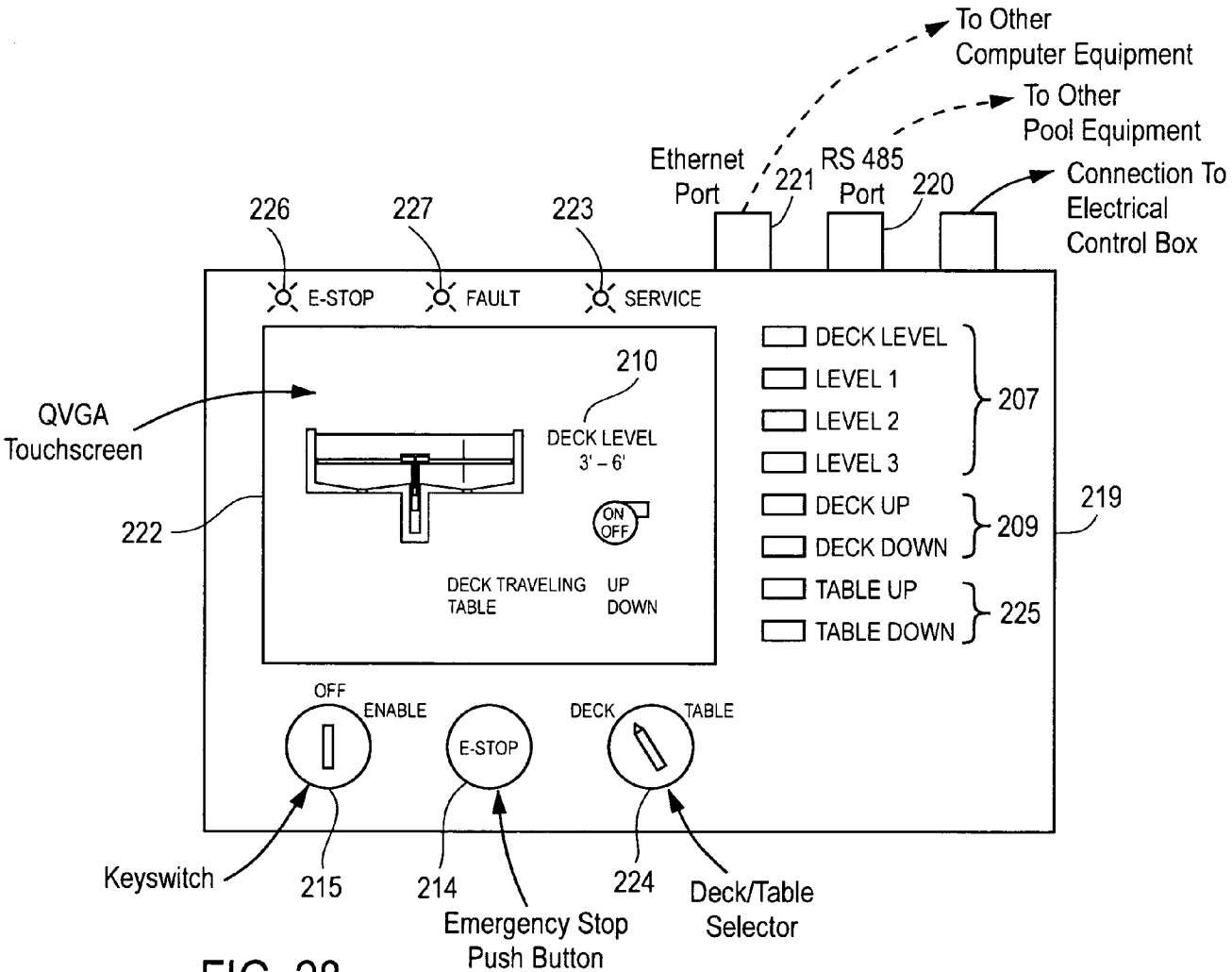
FIG. 28 shows a typical control box.

Pools of the invention may have many beneficial features in addition to those previously described herein. For example, applicant stresses that although many embodiments herein have been described with respect to pools that are round, embodiments of the invention are not so limited and may be of substantially any shape, as shown in FIG. 25. For example, a pool may be a square, rectangle, oval, circle, triangle, parallelogram, or another other shape. Furthermore, a pool of the invention may accompany a conventional pool and offer a pleasing alternative to the conventional pool, perhaps by including various swim and massage jets as described above. FIG. 26 depicts conventional pools accompanied by pools of the invention.

Although small size is not required, the modular construction of some embodiments of the invention makes transport and assembly of a pool easy and convenient. The components used to make a pool may be sufficiently light to allow them to be carried by less than three people. They may be sufficiently small to allow them to be carried through a normal house door. This allows a pool to be constructed, for example, in an area where a conventional pool may not be constructed due to accessibility or size restraints. Ease of modular construction is independent of final pool size.

Pools of the invention may be constructed indoors or out. In one embodiment, a pool of the invention is constructed inside a gazebo or other small outbuilding. This allows the user to create a personalized, relaxing environment. The environment is aesthetically pleasing, and a pool with a cover that raises and lowers is an interesting conversation piece, in addition to all of the functional advantages already described.

Pools of the invention may be equipped with an "automatic overflow" function. This could be made, for example, by having the center of the cover at an elevation slightly greater than the edges, allowing water to flow down and away from the cover. This water could flow into the pool, or, if there are barriers about the coping, away from the pool.

Pools of the invention may be accompanied by containers that are also subterranean and accompanied by lifting mechanisms. Their lifting mechanisms may be independent of those of the pool. For example, a six foot cube could be constructed, then placed into the ground with its own hydraulic lift mechanism. Into the cube could be placed a refrigerator, stereo, entertainment equipment, and pool supplies. Installation of one of these containers in tandem with a pool of the invention could allow an area with seemingly only a patio to quickly be converted to an area of fin and leisure.

A pool of the invention may be incorporated into a home computer network. A user could program the pool's operation remotely. For example, the user could use the internet to set the cover to lower and the water to heat at any desired time. The same could be done by telephone. This would allow the pool user to keep the pool closed, safe, and sanitary during the time the user is at work, and yet the user could still come home to a heated, clean pool, hot tub, or rehabilitation center. The cover could also be set to raise at a desired time; this might be useful, for instance, if the pool were rented for a particular period of time. Computer assistance would also be ideal for those pools incorporating "dancing fountains." These fountains may be integrated into the cover and operated, for example, when the pool is about six inches deep. They may be operated in conjunction with additional lights of varied colors throughout the pool.

Existing pools may also be retrofit with covers of the invention. This could be accomplished, for example, by cutting a hole in the existing pool bottom to insert a lifting mechanism.

A pool of the invention is highly favorable for vacation homes, beach homes, summer homes, or other residences that may not be accessed during the entire year. Safety concerns attendant to a conventional pool may be alleviated by a pool that is locked in as a patio while the primary pool user is not present. Because the water in the pool can be made to be completely inaccessible while the primary user is not present, some municipalities might waive certain fencing restrictions on pools of the invention.

A pool of the invention may be a freshwater pool or a saltwater pool. If the pool is a saltwater pool, a chlorination device such as those available from Intellichlor® may be used to chlorinate the pool.

The pool may be designed to be self-cleaning. For example, if the skimmer is placed two inches below the water surface, the cover can be programmed to first lower to the depth that provides only a two-inch pool. A gasket could then seal this water from the remaining water in the pool. The water in the pool could be agitated and cleaned, removing any dust and debris that might have accumulated on the cover. The cover could then proceed to lower, allowing the water in the pool to remain clean.

The design of the pool could also allow savings on energy and time used to heat the pool. For example, if a pool only two feet deep were desired to be heated, the pool could lower until the water is apparently two feet deep, a gasket could seal that water from the remaining water, and the visible water could be heated.

Although much of this disclosure has been directed to pools and tables, it is contemplated that the lift technology reported herein could be used to raise and lower storage devices as well. For example, an enclosure may be used to store such items as speakers, a television, a barbeque island, or gaming gear. This enclosure may have a lift mechanism as described above, enabling a user to raise and lower the enclosure at will. One could contemplate using such a device to transform a seemingly unremarkable outdoor space into a unique living experience, complete with entertainment. This could be accomplished merely be pressing a switch and allowing the enclosure to raise to ground level. When lowered into the ground, the enclosure could be covered by a surface, such as grass or gravel, that masks the presence of the enclosure. Such an enclosure might also be used for more mundane storage applications. In a further aspect, a pool umbrella may be depressed into the ground and raised by a cylinder as described herein. No enclosure would be required. Storage of the umbrella would be convenient and would prevent weathering.

I. Controller

In some embodiments of the invention, the pool may include a controller. The controller will have the capability to raise and lower the pool deck. The controller will provide signals to motorized valves 201, 202 and 208 to enable a single pump 203 to either raise or lower the deck. At any allowable position the controller will activate a locking mechanism 204 to physically lock the platform in the "deck" position. The controller will enable this lock once the platform has reached the allowable position. Various unallowable positions may will be programmed into the controller to prevent the deck surface from stopping at various levels in the pool where it much block steps and other appurtenances. In this embodiment, when the deck is being lowered the controller will first disable the lock 204, reconfigure valves 201 and 202, open the locking valve 208 and then start the pump 203 to move the platform.

In a further embodiment, the control will be able to stop the deck at several predefined positions. The controller will receive level information from a platform mounted position transmitter 206. This transmitter may be, for example, ultrasonic, laser, or digital encoder. Once the user pushes a button 207 on the controller the controller will examine the platform current position and the requested position. The Controller will then configure the valves 201 and 202 for either a raise or lower, open the locking valve 208, unlock the locking device 204, then start the deck pump 203. Once the deck reaches the desired location the controller will stop the pump, lock the locking device 204, and close the locking valve 208. The controller will also not allow the user to select any unallowable points.

In a further embodiment the controller will allow the operator to stop the deck at any location. The controller will also allow the user to manually raise and lower the deck. The user would enable the controller and then press the raise or lower buttons 209. The display on the controller would display the depth 210 and continuously show how the depth is changing. Once the deck has reached the desired location the user would release the direction button. The Controller would stop the deck pump 203, lock the locking device 204, and close the locking valve 208. The controller will also not allow the user to select any unallowable points.

In a further embodiment the controller will know the position of the pool deck at all times. The controller system would have a position transmitter 206 which measure the distance from the bottom of the pool structure to the current deck position. The pool depth could then be calculated by knowing the distance between the transmitter pool structure, adding the know distance between the transmitter and the top of the deck, and accounting for the water surface level transmitted by a water level transmitter 211.

In a further embodiment, the controller will be provided with safeties to ensure safe operation of the movable pool deck. These safeties would include, for example, but not be limited to the following:

i) Pool deck pump discharge pressure transmitter 212. This device would sense if the deck had jammed in the raising operation and shut down the operation of the controller.

ii) Emergency stop push buttons 214. These switches would be located both on the controller and in close proximity to the pool to shut down the deck moving operation.

iii) Key switch operation 215. The controller would incorporate a key switch so that the controller would not operate without the key in the switch and the switch held in the enable position. The switch would be a spring return to off so that an operator would be required to be present at the controller during all deck movement operations. With a proper authorization code the requirement to hold the enable switch in the enable position could be bypassed and the controller will continue to operate without the enable switch held in the enable position.

iv) Code. A code could also be used for pool deck operation in addition to or instead of the key switch. The operator could enter a password code into the controller prior to deck movement operation.

v) Wave sensor 216. A wave sensor could be used to confirm there are no occupants in the pool prior and during pool deck operation.

vi) An infrared sensor 217. An infrared sensor could also be used to confirm there is nobody in the pool prior to pool deck movement.

In a further embodiment, the controller would be able to lock the deck in any allowable position. When the deck is in an allowable position the controller would be able to lock the deck into position with a locking mechanism 204 to stabilize the deck and prevent the deck from "creeping" down due to possible leakage from the hydraulic elements. The lock mechanism could be located either at the edge of the deck, at the bottom of the pool, or on a supporting member.

The controller in this embodiment will be able to raise and lower an integrated table in the pool cover 205. In the center of the pool deck is an integrated table. This table can be raised when the deck is in the full up position. In one embodiment, the table may rotate freely, in a "Lazy Susan" fashion. The table can also be lowered to fully utilize the deck area, or when the deck is below the water surface. The table will have two limit switches 213 to indicate a full up or full down position of the table. The table will normally be raised and lowered up using the keys 225 on the controller. The controller 219 will be able to interface with other pool devices and be able to communicate with other computers/Internet. The controller would be able to communicate with other pool components or computers. The protocols would include RS-485 port 220 to allow the deck controller to talk to other pool equipment. The pool deck controller could then be integrated with other pool equipment to provide a complete pool control system.

An Ethernet connection 221 would also be available to allow the controller to either be configured by a browser type interface or allow other computers either locally or via the Internet to communicate with the pool deck controller. This Ethernet port could also be connected to a service company or the manufacturer to allow remote diagnostics or system condition alerts.

Typically the controls would consist of two enclosures, a pool deck controller and an electric control box. The pool deck controller 219 would typically normally be mounted indoors within sight of the pool. There would be a communications wire to connect the pool deck controller to the electrical control box 229. The electrical control box would be a separate box mounted at the pool equipment to allow high voltage connection to pump(s), valves, and other sensors. "Service mode" is when control is enabled at the electric control box. When in service mode the pool deck controller functions would be disabled and control would only be available at the electric control box. When in service mode the electric control box would allow service personnel to operate all components of the system for service and diagnostic purposes.

In the further embodiment, the pool deck controller 219 would have customer operator interface controls. The pool deck controller would have a custom designed interface consisting of a display and various lights and switches. The color display 222 could be a 3.5 inch ¼ VGA (QVGA) 320×240 pixels) resolution touch screen to display items including but not limited to pool deck level, table up or down, water level, wave sensor information, upper level lock engaged, pool deck selector valves in up or down position, locking valve open/closed, pool deck traveling up or down, or table traveling up or down. The controller display may incorporate a touch screen to allow operator input of various functions and setpoints. The controller display may could also be simplified to a position setpoint slider and a small LCD deck level readout.

Controller switches may include, for example, a spring return enable off switch 215, an emergency stop switch 214, a table/deck selector switch 224, a deck up command button, a deck down command button 209, a table up command button, a table down command button 225, several preset position command buttons 207. Lights would indicate emergency stop switch pressed 226, sequence fault 227 and in "service" mode 228. The controller may send a level signal to a special LED readout 223 on the edge of the pool to indicate current pool depth. This LED may be manufactured into a tile similar to the type of tile that surrounds the pool. There would be an audible alarm to alert the operator of a system fault.

All claims in this application, and all priority applications, including but not limited to original claims, are hereby incorporated in their entirety into, and form a part of, the written description of the invention. Applicants reserve the right to physically incorporate into this specification any and all materials and information from any such patents, applications, publications, scientific articles, web sites, electronically available information, and other referenced materials or documents. Applicants reserve the right to physically incorporate into any part of this document, including any part of the written description, and the claims referred to above including but not limited to any original claims.

As used herein and in the appended claims, the singular forms "a," "an," and "the" include plural reference unless the context clearly dictates otherwise.

Subheadings herein are included for the benefit of the reader. They should not be used to limit the invention.

The terms and expressions employed herein have been used as terms of description and not of limitation, and there is no intention in the use of such terms and expressions, or any portions thereof, to exclude any equivalents now know or later developed, whether or not such equivalents are set forth or shown or described herein or whether or not such equivalents are viewed as predictable, but it is recognized that various modifications are within the scope of the invention claimed, whether or not those claims issued with or without alteration or amendment for any reason. Thus, it shall be understood that, although the present invention has been specifically disclosed by preferred embodiments and optional features, modifications and variations of the inventions embodied therein or herein disclosed can be resorted to by those skilled in the art, and such modifications and variations are considered to be within the scope of the inventions disclosed and claimed herein.

Specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. Where examples are given, the description shall be construed to include but not to be limited to only those examples. It will be readily apparent to one skilled in the art that varying substitutions and modifications may be made to the invention disclosed herein without departing from the scope and spirit of the invention, and from the description of the inventions, including those illustratively set forth herein, it is manifest that various modifications and equivalents can be used to implement the concepts of the present invention without departing from its scope. A person of ordinary skill in the art will recognize that changes can be made in form and detail without departing from the spirit and the scope of the invention. The described embodiments are to be considered in all respects as illustrative and not restrictive. Thus, for example, additional embodiments are within the scope of the invention and within the following claims.

I claim:

1. A pool comprising:

a water container comprising an open top defined by a peripheral edge, a bottom, and at least one sidewall;

a platform with a top side and a bottom side, the platform being sized and adapted to fit within the peripheral edge of the water container;

a single receiving cavity arranged in the bottom of the water container; and a single column connected with the bottom side of the platform and arranged in the single receiving cavity, the single column being at least partially displaceable from the single receiving cavity to move the platform upward, and at least partially replaceable in the single receiving cavity to move the platform downward, wherein the single column includes one or more pressure release openings configured to prevent the single column from moving the platform upward above a predetermined height.

2. The pool in accordance with claim 1, further comprising a water flow mechanism to pump water into the single receiving cavity below the single column to at least partially displace the single column from the single receiving cavity, and to pump water out of the single receiving cavity to at least partially replace the single column into the single receiving cavity.

3. The pool in accordance with claim 2, wherein the water flow mechanism includes at least one pump, an inlet into the single receiving cavity, and an outlet from the single receiving cavity.

4. The pool in accordance with claim 1, further comprising an O-ring arranged and connected with a top edge of the single receiving cavity.

5. The pool in accordance with claim 1, wherein the sidewall comprises a plurality of interlocking blocks, each block having at least one groove that, when aligned and combined with at least other groove on an adjacent block, defines a channel.

6. The pool in accordance with claim 5, wherein each of the plurality of blocks is formed of foam.

7. The pool in accordance with claim 1, further comprising a gasket arranged on an outer edge of the platform.

8. An apparatus for use with a pool, the pool comprising a water container having an open top defined by a peripheral edge, a bottom, and at least one sidewall, the pool further comprising a water flow mechanism to flow water, the apparatus comprising;

a platform with a top side and a bottom side, the platform being sized and adapted to fit within the peripheral edge of the water container;

a single receiving cavity adapted to be arranged in the bottom of the water container and having a mechanism to receive and expel water from the water container; and a single column connected with the bottom side of the platform and placed in the single receiving cavity, the single column configured to be at least partially displaced from the single receiving cavity to move the platform upward when the water flow mechanism flows water in to the single receiving cavity, and configured to be at least partially replaced in the single receiving cavity to move the platform downward when the water flow mechanism flows water out of the single receiving cavity, wherein the single column includes one or more pressure release openings configured to prevent the single column from moving the platform upward above a predetermined height.

9. An apparatus for use with a pool, the pool comprising a water container having an open top defined by a peripheral edge, a bottom, at least one sidewall, and a platform with a top side and a bottom side, the platform being sized and adapted to fit within the peripheral edge of the water container, the pool further comprising a water flow mechanism to flow water, the apparatus comprising:

a single receiving cavity adapted to be arranged in the bottom of the water container; and a single column adapted to be connected with the bottom side of the platform, and being sized and adapted to be received in the single receiving cavity, the single column configured to be at least partially displaced from the single receiving cavity to move the platform upward when the water flow mechanism flows water in to the single receiving cavity, and configured to be at least partially replaced in the single receiving cavity to move the platform downward when the water flow mechanism flows water out of the single receiving cavity, wherein the single column includes one or more pressure release openings configured to prevent the single column from moving the platform upward above a predetermined height.

* * * * *